US012163675B2

(12) United States Patent
Zhao et al.

(10) Patent No.: US 12,163,675 B2
(45) Date of Patent: Dec. 10, 2024

(54) MOBILE AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Cheng Zhao, Guangdong (CN); Gang Liu, Guangdong (CN); Jingqiang Jiang, Guangdong (CN); Bowen He, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 343 days.

(21) Appl. No.: 17/703,461

(22) Filed: Mar. 24, 2022

(65) Prior Publication Data

US 2022/0214054 A1 Jul. 7, 2022

Related U.S. Application Data

(63) Continuation of application No. PCT/CN2020/081450, filed on Mar. 26, 2020.

(30) Foreign Application Priority Data

Oct. 31, 2019 (CN) ..... 201911057170.2
Oct. 31, 2019 (CN) ..... 201921868337.9
(Continued)

(51) Int. Cl.
*F24F 1/04* (2011.01)
*F24F 13/20* (2006.01)

(52) U.S. Cl.
CPC ..... *F24F 1/04* (2013.01); *F24F 13/20* (2013.01); *F24F 2013/207* (2013.01)

(58) Field of Classification Search
CPC ..... F24F 1/04; F24F 13/20; F24F 2013/207; F24F 11/56; F24F 11/89
See application file for complete search history.

(56) References Cited

U.S. PATENT DOCUMENTS 5,787,717 A * 8/1998 Bang ..... F24F 13/20 62/157
2017/0370605 A1* 12/2017 Makino ..... F24F 11/36

FOREIGN PATENT DOCUMENTS

CN 202468411 U 10/2012
CN 203671839 U 6/2014
(Continued)

OTHER PUBLICATIONS

Extended European Search Report dated Oct. 7, 2022 received in European Patent Application No. EP 20881276.8.
(Continued)

*Primary Examiner* — Joseph F Trpisovsky
(74) *Attorney, Agent, or Firm* — Scully, Scott, Murphy & Presser, P.C.

(57) ABSTRACT

A mobile air conditioner is provided. The mobile air conditioner has a housing and a storage box. The housing is provided with a hidden opening. The storage box has a storage cavity and a storage opening in communication with the storage cavity. The storage box is movably provided on the housing. The storage box has a first position extending out of the hidden opening to expose the storage opening and a second position hidden in the housing.

19 Claims, 27 Drawing Sheets

(30) Foreign Application Priority Data

| | | |
|---|---|---|
| Nov. 11, 2019 | (CN) ..... | 201921942627.3 |
| Nov. 11, 2019 | (CN) ..... | 201921947834.8 |
| Nov. 11, 2019 | (CN) ..... | 201921948196.1 |

(56) References Cited

FOREIGN PATENT DOCUMENTS

| | | | |
|---|---|---|---|
| CN | 203744492 | U | 7/2014 |
| CN | 205339232 | U | 6/2016 |
| CN | 106969446 | A | 7/2017 |
| CN | 206683132 | U | 11/2017 |
| CN | 109708189 | A | 5/2019 |
| CN | 110631247 | A | 12/2019 |
| CN | 210832487 | U | 6/2020 |
| JP | 2003218545 | A | 7/2003 |
| KR | 970018903 | U | 5/1997 |
| KR | 20030043029 | A | 6/2003 |
| KR | 20050090508 | A | 9/2005 |
| KR | 20090043239 | A | 5/2009 |

OTHER PUBLICATIONS

International Search Report and Written Opinion dated Jul. 22, 2020 received in International Application No. PCT/CN2020/081450 together with an English language translation.

* cited by examiner

MOBILE AIR CONDITIONER

CROSS-REFERENCE TO RELATED APPLICATIONS

This application is a continuation application of PCT International Application No. PCT/CN2020/081450, filed on Mar. 26, 2020, which claims priority to and benefits of Chinese Patent Application No. 201911057170.2, filed on Oct. 31, 2019, entitled "MOBILE AIR CONDITIONER", Chinese Patent Application No. 201921942627.3, filed on Nov. 11, 2019, entitled "MOBILE AIR CONDITIONER", Chinese Patent Application No. 201921948196.1, filed on Nov. 11, 2019, entitled "AIR CONDITIONER HOUSING AND MOBILE AIR CONDITIONER", Chinese Patent Application No. 201921947834.8, filed on Nov. 11, 2019, entitled "AIR CONDITIONER HOUSING AND MOBILE AIR CONDITIONER", and Chinese Patent Application No. 201921868337.9, filed on Oct. 31, 2019, entitled "MOBILE AIR CONDITIONER", the entire contents of which are incorporated herein by reference for all purposes. No new matter has been introduced.

FIELD

The present disclosure relates to the field of air-conditioning, and in particular, to a mobile air conditioner.

BACKGROUND

A mobile air conditioner is generally equipped with a remote control, which is usually stored separately. The separate storage of the remote control is unfavorable for product packaging and transportation, and in addition, tends to cause undesirable loss of the remote control during use.

SUMMARY

The main purpose of the present disclosure is to provide a mobile air conditioner, which aims to at least solve the technical problem of inconvenient storage of the remote control of the mobile air conditioner.

In order to achieve the above purpose among others, the present disclosure proposes a mobile air conditioner, including:

a housing provided with a hidden opening; and a storage box including a storage cavity and a storage opening in communication with the storage cavity;

wherein the storage box is movably provided on the housing, and the storage box has a first position extending out of the hidden opening to expose the storage opening, and a second position hidden in the housing.

In an embodiment, the storage box blocks the hidden opening in the second position.

In an embodiment, the storage box is rotatably provided on the housing, such that the storage box has the first position and the second position.

In an embodiment, a support protrusion is protruded on an inner wall surface of the housing, and the storage box is rotatably connected to the support protrusion, such that the storage box is rotatably provided on the housing.

In an embodiment, there are two support protrusions, and the two support protrusions are respectively provided on opposite sides of the hidden opening;

the storage box is provided between the two support protrusions, and two sides of the storage box are respectively rotatably provided on the two support protrusions.

In an embodiment, a rotating shaft is protruded on the storage box, a rotating hole is provided on the support protrusion, the rotating shaft is rotatably disposed in the rotating hole, so that the storage box is rotatably connected to the support protrusion.

In an embodiment, the support protrusion is also provided with a guide groove in communication with the rotating hole, one end of the guide groove away from the rotating hole defines an opening, and the guide groove is configured to guide the rotating shaft to slide into the rotating hole.

In an embodiment, the guide groove is flared; and/or a connection between the guide groove on at least one of the support protrusions and the rotating hole is provided with a locking protrusion, and the locking protrusion is configured to limit the rotating shaft from the rotating hole.

In an embodiment, a thickening portion is provided on a side of the support protrusion facing away from the storage box, and the thickening portion is provided on a periphery of the rotating hole; and/or a protrusion is provided on a side of each support protrusion facing the storage box, and the protrusion is configured to abut against an outer wall surface of the storage box when the storage box is rotated.

In an embodiment, the storage box includes a first side wall covering the hidden opening in the second position, and two second side walls adjacent to the first side wall, an open end of the second side wall is formed with an avoidance notch at the connection with the first side wall, and the avoidance notch is configured to avoid an edge of the hidden opening when the storage box is rotated; or an open end of the storage box is inclined and configured to avoid the edge of the hidden opening when the storage box is rotated.

In an embodiment, a guide structure is provided on the storage box and the housing, and the guide structure is configured to guide the rotation of the storage box.

In an embodiment, an inner wall surface of the housing is provided protrudingly with a guide support portion, the guide structure includes a guide protrusion laterally protruding from the guide support portion, and a guide groove provided on an outer wall surface of the storage box, and the guide protrusion is slidably provided in the guide groove, and is configured to guide the rotation of the storage box.

In an embodiment, a depth of the guide groove is increased from outside to inside; and/or the guide groove is an arc groove.

In an embodiment, the storage box and the housing are provided with a first limiting structure, and the first limiting structure is configured to limit the storage box and the housing in the second position; and/or the storage box and the housing are provided with a second limiting structure, and the second limiting structure is configured to limit the storage box and the housing in the first position.

In an embodiment, the second limiting structure includes a stop protrusion provided on the storage box, and the stop protrusion is provided in the housing, the stop protrusion is in contact with an inner wall surface of the housing in the first position, and is configured to limit the storage box.

In an embodiment, the stop protrusion is away from a rotation axis of the storage box; and/or the stop protrusion is rotatably provided on the storage box.

In an embodiment, an open end of a side wall of the storage box is formed with a gripping notch, and the gripping notch is recessed toward a bottom of the storage cavity.

In an embodiment, the gripping notch is configured to break a guide groove of the storage box to form two guide sub-grooves, and a fracture is formed between the two guide sub-grooves.

In an embodiment, the storage box includes a first side wall covering the hidden opening in the second position, the first side wall is provided with a gripping structure, and the gripping structure is configured for a user to grasp.

In an embodiment, the gripping structure includes a buckle hand formed by the inward concave of the first side wall; or the gripping structure includes a buckle hand formed by the inward concave of the first side wall, the buckle handle has a buckle opening, the buckle handle includes a first buckle wall and a second buckle wall provided on opposite sides of the buckle opening, the first buckle wall extends away from the second buckle wall (in the direction of 2323) obliquely from the outside to the inside; and/or the second buckle wall extends from the outside to the inside to a direction close to the first buckle wall.

In an embodiment, guide ribs are protruded on an inner wall surface of the storage cavity, the guide ribs are extended along a depth direction of the storage cavity, a height of the guide ribs is increased in a direction from the storage opening to a bottom of the storage cavity; and/or a width of the guide ribs is increased in the direction from the storage opening to the bottom of the storage cavity.

In an embodiment, the storage box is slidably provided in the housing, and is configured such that the storage box has the first position and the second position.

In the mobile air conditioner of the embodiment of the present disclosure, a hidden opening is provided on the housing, and the storage box can be hidden in the housing through the hidden opening, so that the remote control can be hidden/stored in the housing. In this way, it is not only possible to avoid the problem of separately storing/packing the remote control when packaging or transporting the mobile air conditioner, but also to prevent the remote control from being lost during use, thereby improving the storage convenience of the remote control. Moreover, hiding the storage box in the housing can not only reduce the risk of damage to the storage box and the remote control, but also avoid damage to the appearance of the housing (i.e., the mobile air conditioner), thereby improving user comfort.

BRIEF DESCRIPTION OF THE DRAWINGS

In order to more clearly illustrate the technical solutions of the embodiments of the present disclosure or the prior art, drawings used in the embodiments or the prior art will be briefly described below. Obviously, the drawings in the following description are only some embodiments of the present disclosure. It will be apparent to those skilled in the art that other figures can be obtained according to the structures shown in the drawings without creative work.

Figure 1:
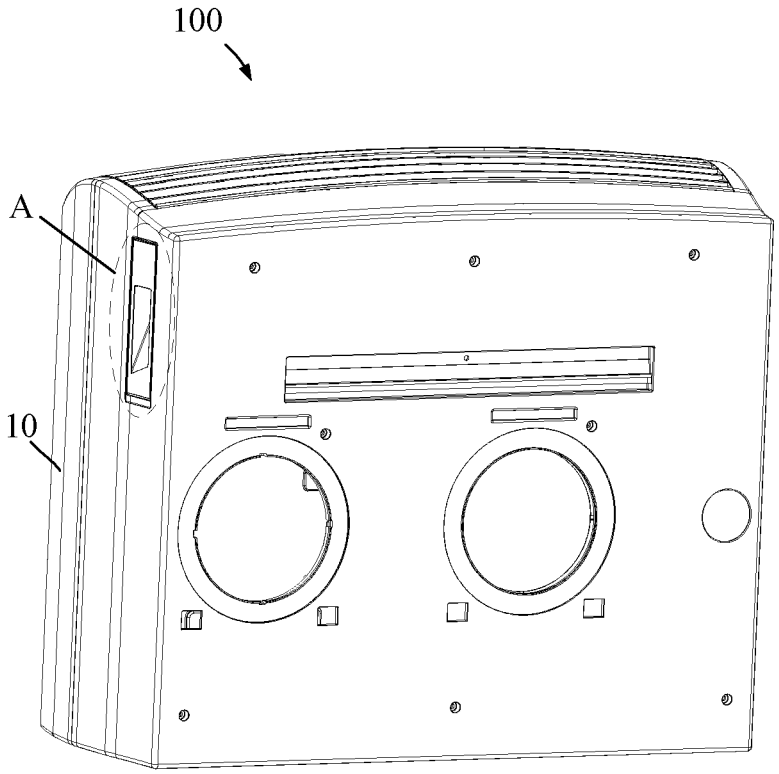
FIG. 1 is a schematic structural view of a mobile air conditioner in a state according to an embodiment of the present disclosure; the storage box is in a second position.

The reference numerals shown in the figures are described as follows:

100, mobile air conditioner; 10, housing; 11, hidden opening; 12, reinforcing ring protrusion; 121, second blocking protrusion; 13, support protrusion; 131, rotating hole; 132, guide groove; 133, thickening portion; 134, protrusion; 14, connecting protrusion; 15, guide support portion; 151, guide protrusion; 20, storage box; 21, storage cavity; 22, storage opening; 23, first side wall; 231, first blocking protrusion; 232, buckle hand; 2321, buckle opening; 2322, first buckle wall; 2323, second buckle wall; 2324, buckle bottom; 24, second side wall; 241, rotating shaft; 242, avoidance notch; 243, gripping notch; 244, guide groove; 2441, limiting groove; 245, thinning groove; 25, guide rib; 26, stop protrusion; 27, bottom wall; 271, through hole;

11*c*, indoor air inlet; 12*c*, indoor air outlet; 2*c*, guide grille; 21*c*, longitudinal grille strip; 22*c*, horizontal grille strip; 3, volute assembly; 31, volute; 32, volute cover; 321, top plate; 322, water diversion groove; 322*a*, first side wall; 322*b*, bottom plate; 322*c*, second side wall; 323, water-stop flange; 324, first side plate; 325, second side plate; 326, water diversion notch; 327, fan installation hole; 328, drainage structure; 4, indoor heat exchanger; 5, middle baffle; 6, water storage groove; 7, drainage groove;

1, housing body; 11*a*, front housing; 111, lug; 113, clamping protrusion; 12*a*, rear housing; 121*a*, clamping slot; 13*a*, top plate; 14*a*, chassis; 2, reinforcing housing; 2*a*, accommodating cavity; 21*a*, front plate; 22*a*, rear plate; 23*a*, left plate; 231*a*, first folded edge;

232*a*, first through hole; 24*a*, right plate; 241*a*, second folded edge; 242*a*, second through hole; 25*a*, support member; 26*a*, second through hole; 27*a*, first fixing hole; 28, second fixing hole; 29, first connecting hole; 51, second connecting hole; and

11*a*1, front panel; 11*a*11, buckle; 11*a*12, guide slope; 11*a*13, first connecting plate; 11*a*14, second connecting plate; 11*a*2, front side plate; 121*b*, connecting portion; 122, via hole; 123, socket; 124, avoidance space; 13*a*1, insertion hole; 13*a*2, guide surface; 13*a*3, connecting hole; 13*a*4, buckle position.

The realization of the objective, functional characteristics, and advantages of the present disclosure are further described with reference to the accompanying drawings.

DETAILED DESCRIPTION OF EMBODIMENTS

The technical solutions in the embodiments of the present disclosure will be clearly and completely described below with reference to the accompanying drawings in the embodiments of the present disclosure. Obviously, the described embodiments are only a part of the embodiments of the present disclosure, but not all of the embodiments. Based on the embodiments in the present disclosure, all other embodiments obtained by those of ordinary skill in the art without creative work fall within the scope of the present disclosure.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature.

Besides, the meaning of "and/or" appearing in the disclosure includes three parallel schemes. For example, "A and/or B" includes only A, or only B, or both A and B.

The present disclosure provides a mobile air conditioner.

In an embodiment of the present disclosure, as shown in FIG. 1 to FIG. 8, the mobile air conditioner 100 includes a housing 10 and a storage box 20.

Figure 6:
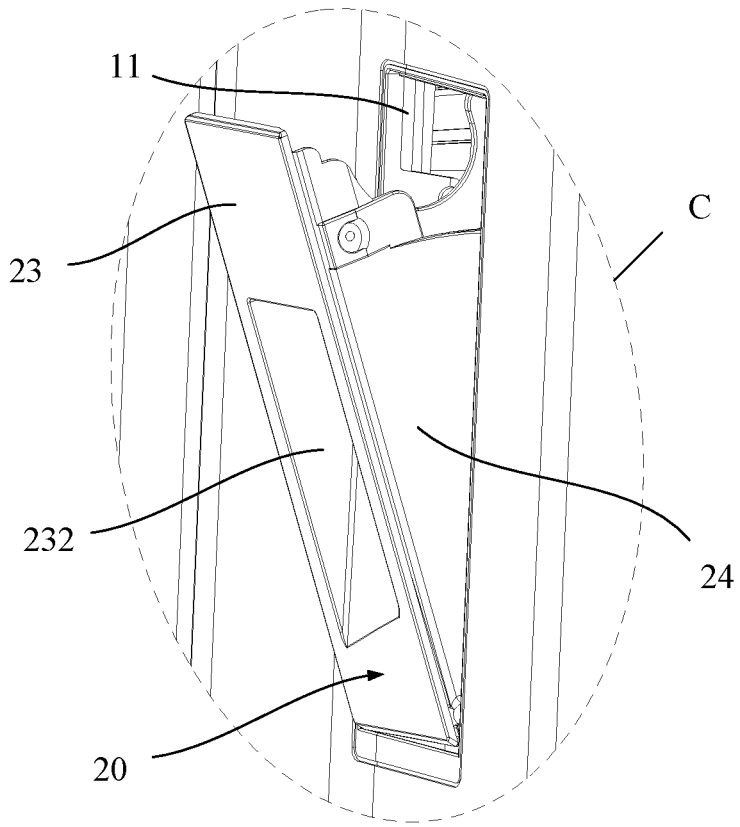
FIG. 6 is a partial enlarged view of portion C in FIG. 5.
Figure 8:
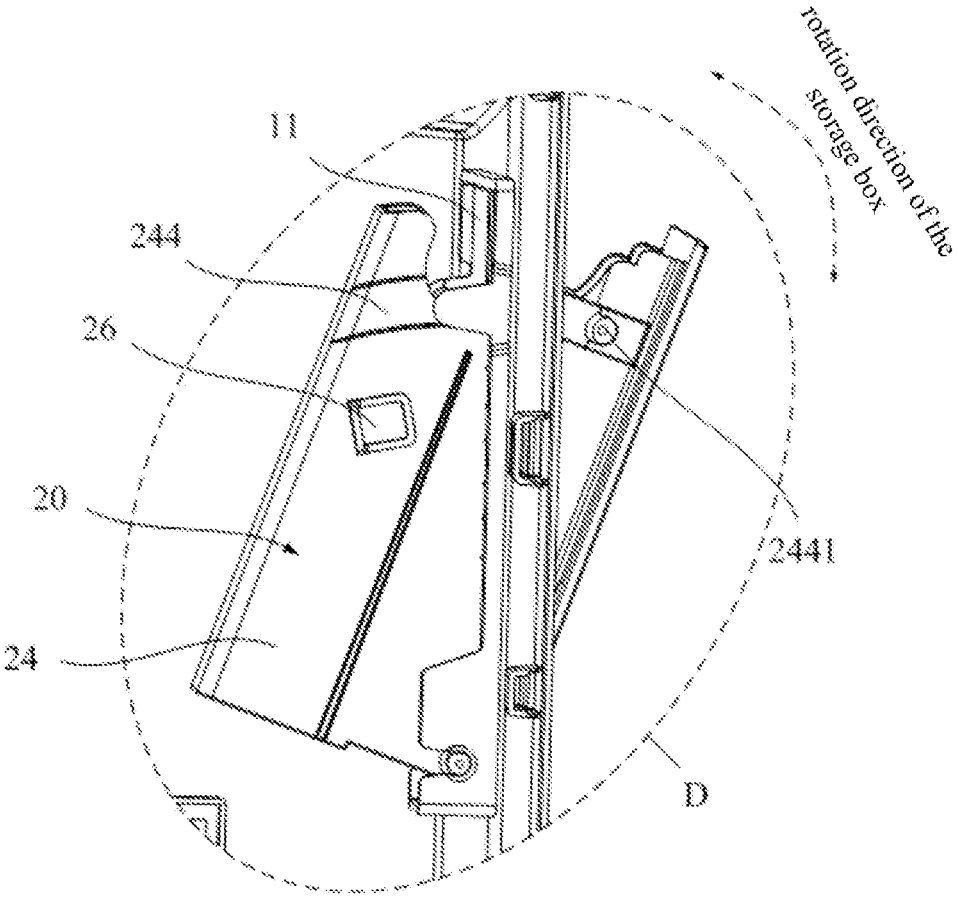
FIG. 8 is a partial enlarged view of portion D in FIG. 7.
Figure 9:
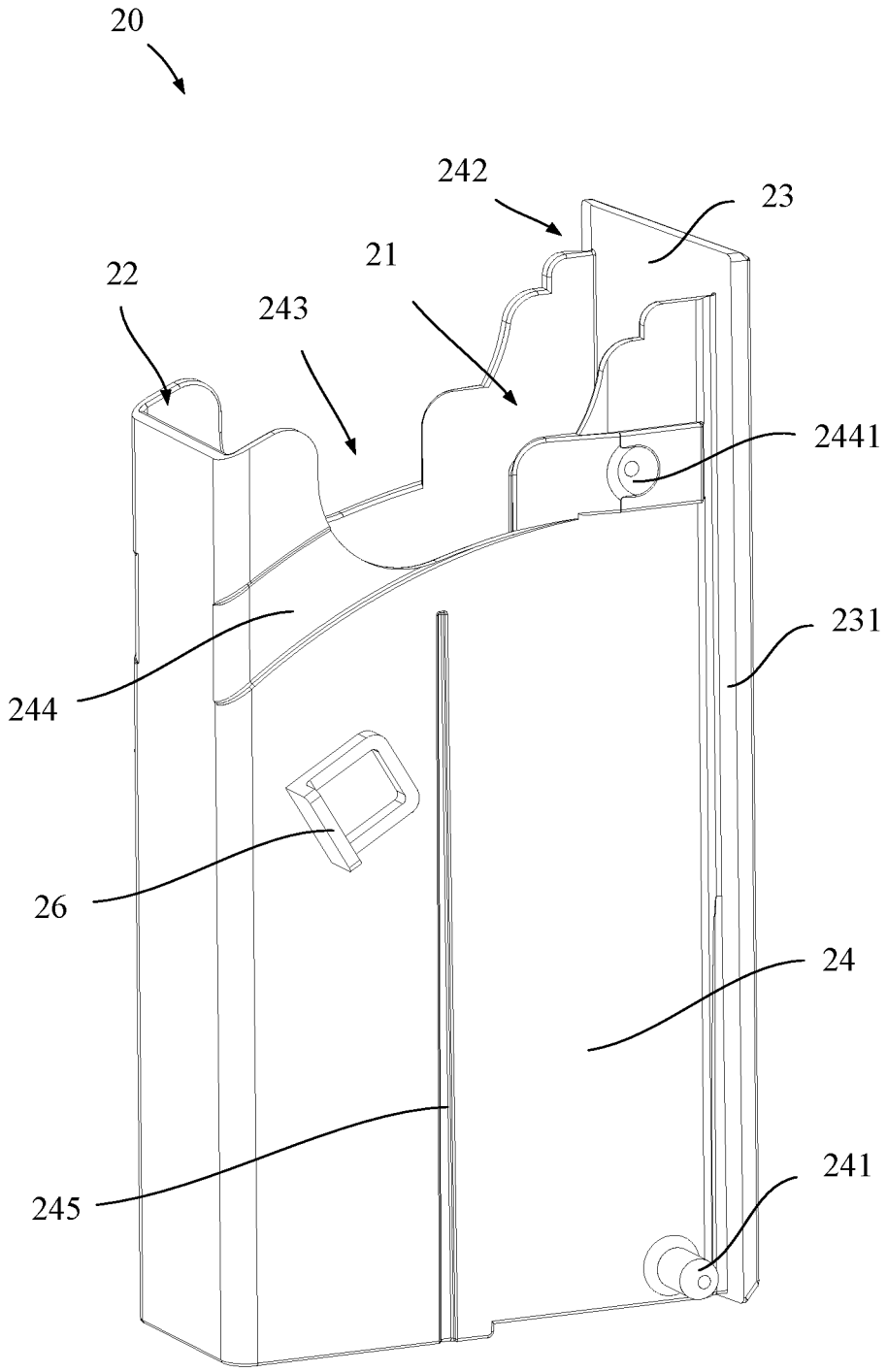
FIG. 9 is a schematic structural view of the storage box in FIG. 5 from a perspective.

For example, as shown in FIG. 6, FIG. 8 and FIG. 9, the storage box 20 includes a storage cavity 21 and a storage opening 22 in communication with the storage cavity 21. The storage cavity 21 is usually used for accommodating the remote controller. The remote controller can be stored in the storage cavity 21 through the storage opening 22, or can be separated from the storage cavity 21 through the storage opening 22. The storage opening 22 can also be used to store other items, such as mobile phones, antiseptics, and air stimulants.

For example, as shown in FIG. 6, FIG. 8, FIG. 12 and FIG. 13, the housing 10 is provided with a hidden opening 11. The hidden opening 11 penetrates the wall of housing 10. The storage box 20 is movably disposed on the housing 10, and the storage box 20 has a first position extending out of the hidden opening 11 to expose the storage opening 22, and a second position hidden in the housing 10. The storage box 20 is movably provided at the hidden opening 11. The storage box 20 can be rotatably provided on the housing 10; alternatively, the storage box 20 can be slidably provided on the housing 10; alternatively, the storage box 20 is detachably provided on the housing 10, and so on. As a result, the storage box 20 is movably provided on the housing 10.

As shown in FIG. 1 to FIG. 4, in the second position (that is, when the storage box 20 is in the second position, this abbreviation is used for description below), the storage box 20 (the side wall) blocks the hidden opening 11 or the storage box 20 is completely moved into the housing 10, so that the storage box 20 is hidden in the housing 10.

For example, when it is necessary to store or pack the mobile air conditioner 100, the storage box 20 can be moved to the first position first, so that (the open end or the whole of the storage box 20) extends out of the hidden opening 11 and exposes the storage opening 22, so that the remote control can be stored in the storage box 20. Subsequently, the storage box 20 is moved to the second position to hide the storage box 20 in the housing 10, so that the remote controller is hidden/stored in the housing 10. In this way, hiding the storage box 20 in the housing 10 can reduce the risk of the storage box 20 being collided during transportation, so as to reduce the risk of damage to the storage box 20. During the use of the mobile air conditioner 100, the risk of collision/interference between the storage box 20 and the user can be reduced, thereby not only reducing the risk of damage to the storage box 20, but also improving the user comfort.

When the remote controller needs to be used, the storage box 20 can be moved to the first position for the user to take the remote controller.

In the mobile air conditioner 100 of the embodiment of the present disclosure, a hidden opening 11 is provided on the housing 10, and the storage box 20 can be hidden in the housing 10 through the hidden opening 11, so that the remote control can be hidden/stored in the housing 10. In this way, it is not only possible to avoid the problem of separately storing/packing the remote control when packaging or transporting the mobile air conditioner 100, but also to prevent the remote control from being lost during use, thereby improving the storage convenience of the remote control. Moreover, hiding the storage box 20 in the housing 10 can not only reduce the risk of damage to the storage box 20 and the remote control, but also avoid damage to the appearance of the housing 10 (i.e., the mobile air conditioner 100), thereby improving user comfort.

It should be noted that for the solution of "when in the second position, the storage box 20 is completely moved into the housing 10 to realize that the storage box 20 is hidden in the housing 10", a switch door can be provided at the hidden opening 11 to close/cover the hidden opening 11 when the storage box 20 is in the second position. For example, the switch door is slidably arranged on the inner wall surface of the housing 10 to close or open the hidden opening 11. Optionally, an escape chute is formed on the inner wall surface of the housing 10, and the switch door is slidably provided in the escape chute. In this way, not only can the storage box 20 be limited to prevent it from slipping out of the hidden opening 11, but also the integrity of the housing 10 can be improved to ensure the appearance of the housing 10 and the mobile air conditioner 100. In a further improvement of this solution, a storage cavity can be provided on the inner wall surface of the housing 10 corresponding to the hidden opening 11 to accommodate the storage box 20.

Figure 2:
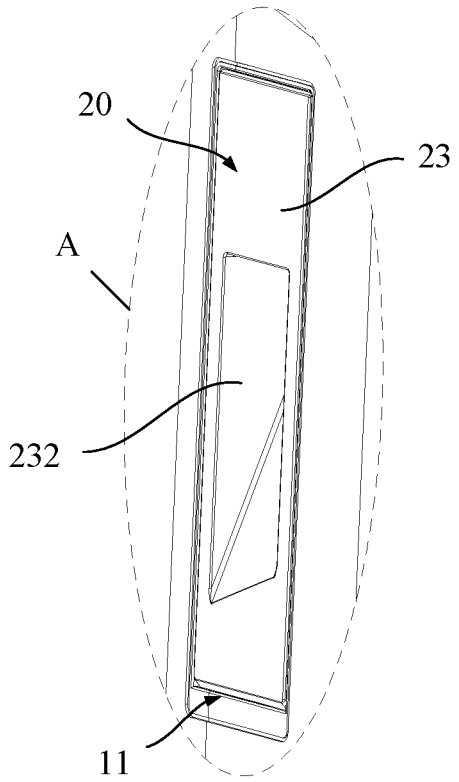
FIG. 2 is a partial enlarged view of portion A in FIG. 1.

In the following examples of the present disclosure, as shown in FIG. 1 to FIG. 4, in the second position, the storage box 20 blocks the hidden opening 11. In the second position, the box wall of the storage box 20 blocks the hidden opening 11. For example, as shown in FIG. 2, the storage box 20 includes a first side wall 23, and when in the second position, the first side wall 23 covers the hidden opening 11. In this way, the hidden opening 11 can be covered by the structure of the storage box 20 itself, so that the structure of the mobile air conditioner 100 can be simplified.

As shown in FIG. 2, the outer wall surface of the first side wall 23 is flush with or approximately flush with the outer wall surface of the housing 10; in this way, the risk of collision of the storage box 20 can be further reduced, and the aesthetics of the housing 10 can also be improved.

Figure 5:
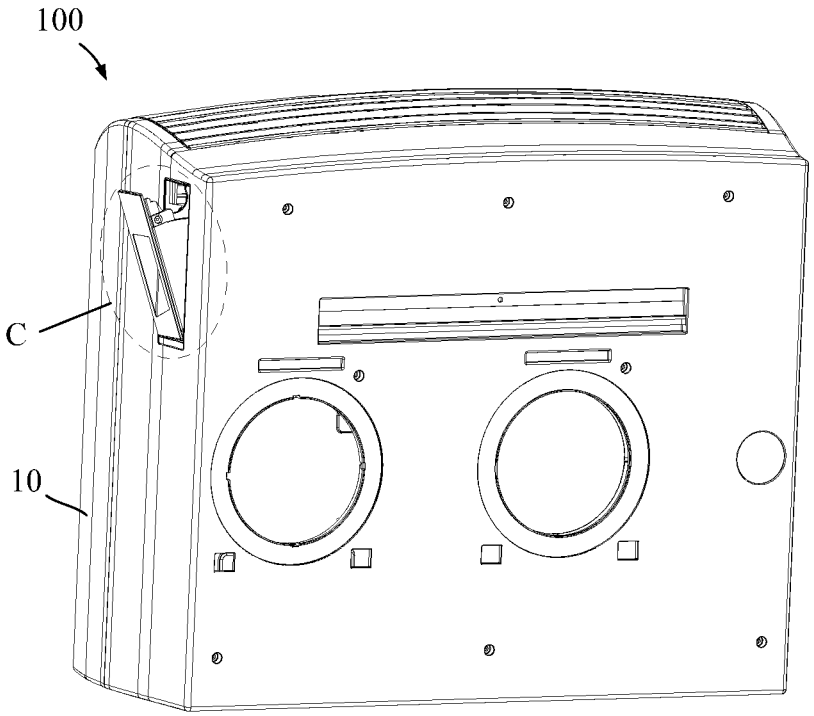
FIG. 5 is a schematic structural view of the mobile air conditioner in another state in FIG. 1; the open end of the storage box partially extends out of the hidden opening.

In this embodiment, as shown in FIG. 1 and FIG. 5, the housing 10 is in the shape of a cuboid or substantially in the shape of a cuboid. Optionally, the housing 10 includes a bottom plate, a top housing (i.e., a top plate) opposite to the bottom plate, and an enclosure. The enclosure has a front housing wall, a rear housing wall, a left housing wall and a right housing wall. Optionally, the enclosure includes a front housing and a rear housing, and the front housing and the rear housing are enclosed to form an enclosure.

Optionally, the hidden opening 11 can be provided on the top housing (i.e., the top plate) or the enclosure. For example, the hidden opening 11 is provided on the left housing wall or the right housing wall, and the hidden opening 11 can be provided on the front housing or the rear housing.

Figure 3:
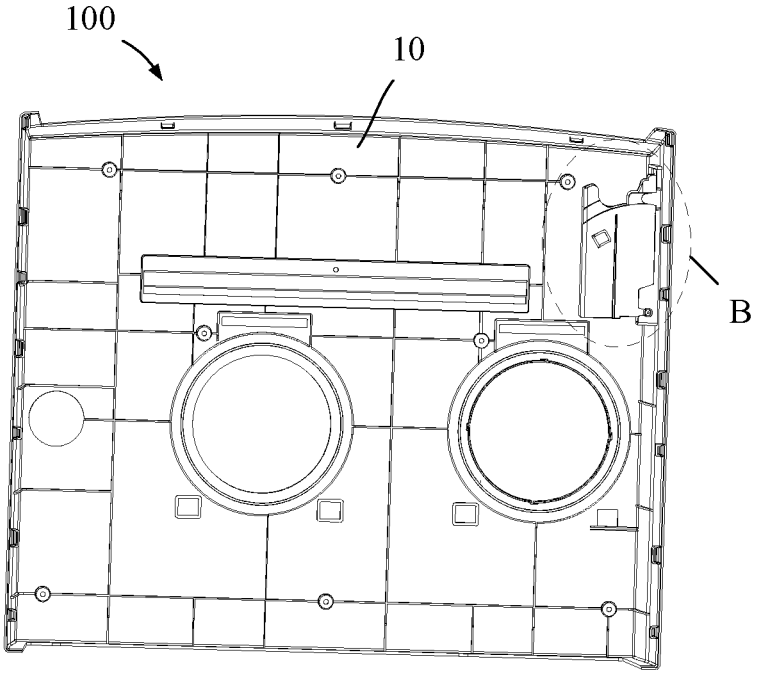
FIG. 3 is a schematic structural view of the inner of the mobile air conditioner in FIG. 1.
Figure 4:
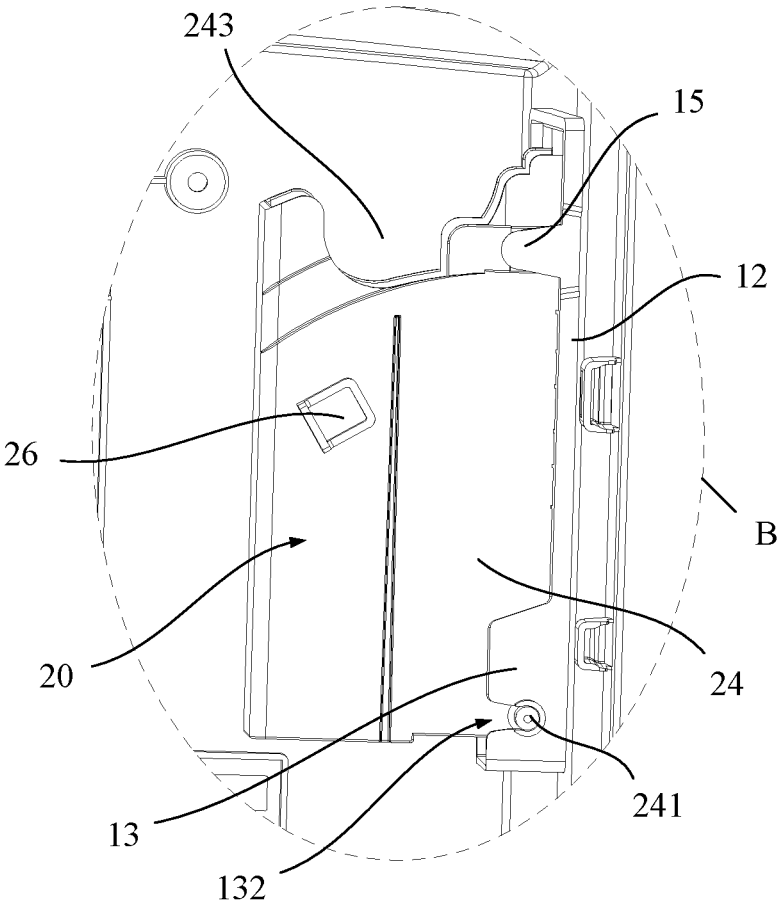
FIG. 4 is a partial enlarged view of portion B in FIG. 3.

As shown in FIG. 3 and FIG. 4, when in the second position, the length direction of the storage box 20 is parallel or substantially parallel to the housing wall where the hidden opening 11 is located.

Figure 10:
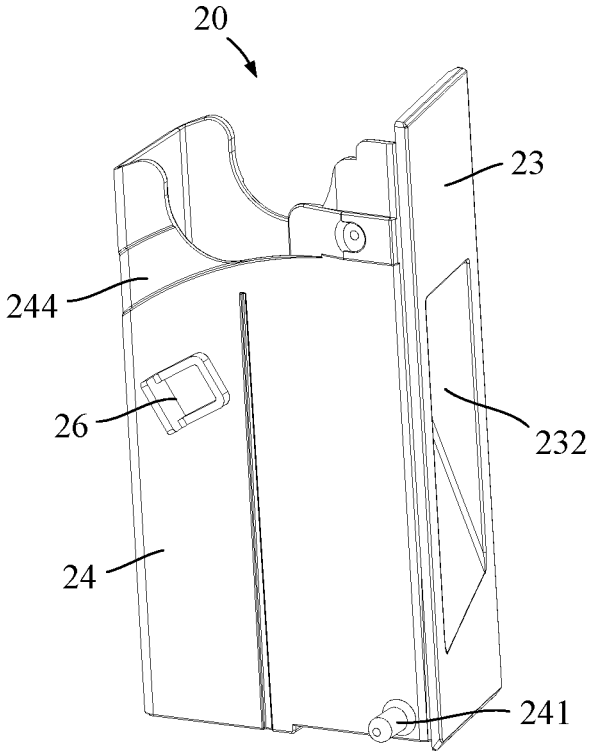
FIG. 10 is a schematic structural view of the storage box in FIG. 9 from another perspective.
Figure 11:
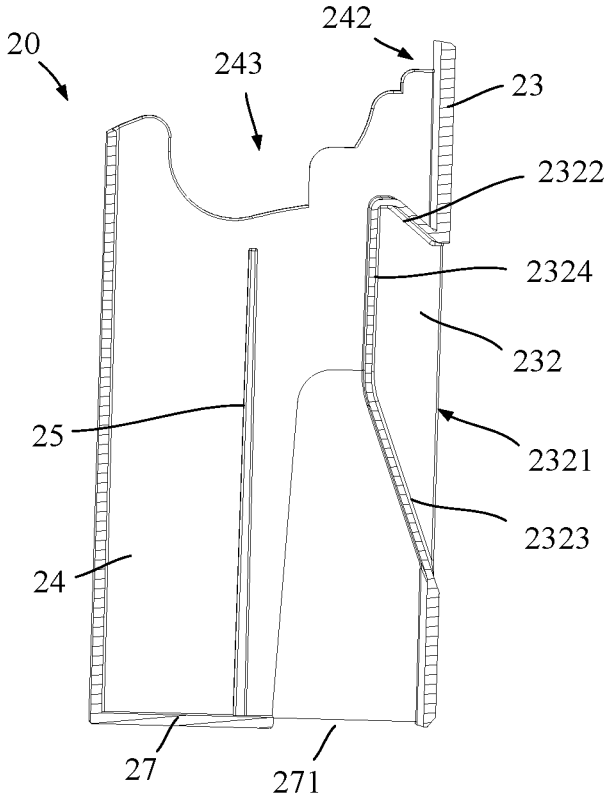
FIG. 11 is a schematic cross-sectional view of the storage box in FIG. 10.

In this embodiment, as shown in FIG. 9 to FIG. 11, the storage box 20 is in the shape of a cuboid or substantially in the shape of a cuboid; the storage box 20 is vertically arranged in the second position.

Figure 12:
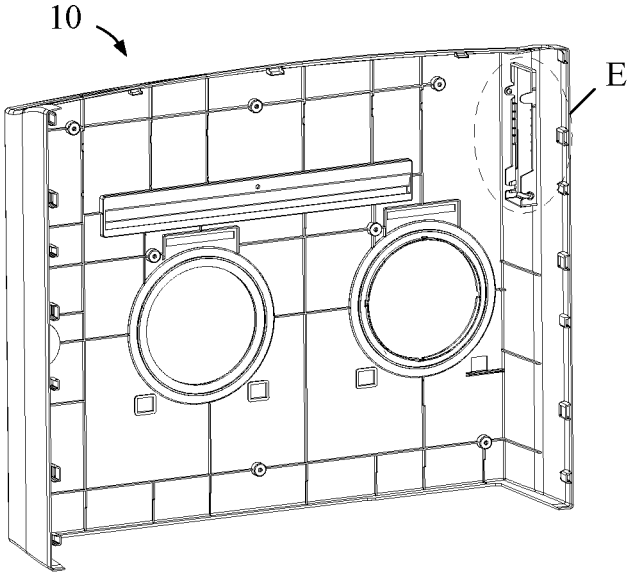
FIG. 12 is a schematic structural view of the inner of the housing in FIG. 5.
Figure 13:
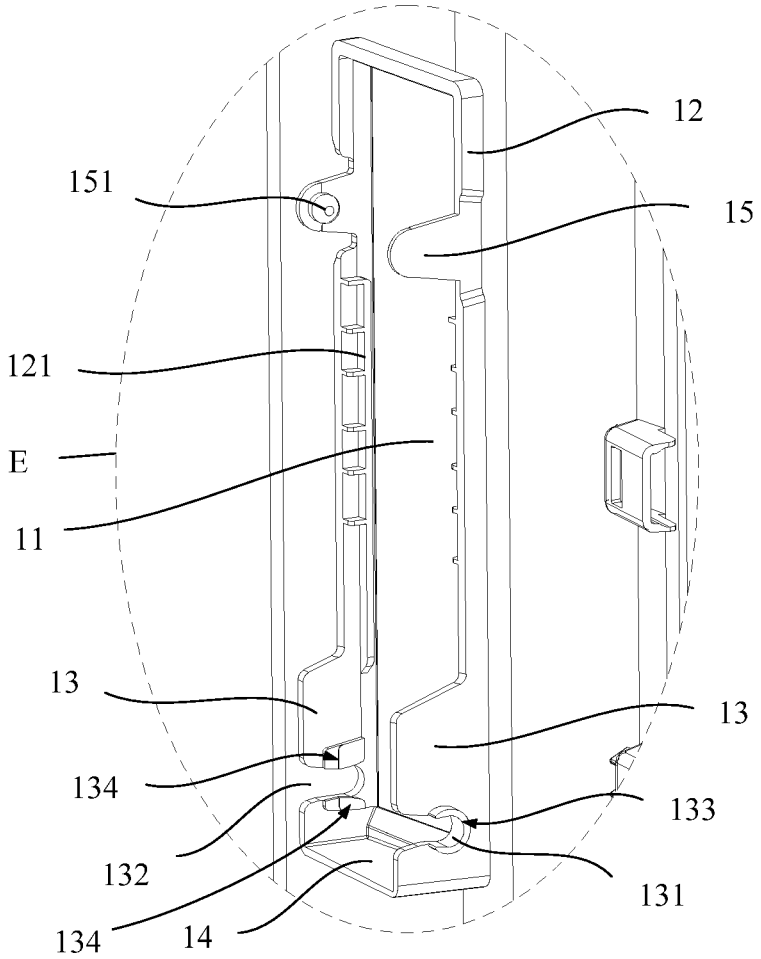
FIG. 13 is a partial enlarged view of portion E in FIG. 12.

Further, as shown in FIG. 12 and FIG. 13, a reinforcing ring protrusion 12 is formed on the inner wall surface of the housing 10, and the reinforcing ring protrusion 12 is arranged on the periphery of the hidden opening 11. In this way, not only the structural strength of the housing wall at the hidden opening 11 can be enhanced, but also the risk of damage to the housing 10 at the hidden opening 11 can be reduced. It is also convenient to provide a structure matching with the storage box 20 on the housing 10.

For example, as shown in FIG. 12 and FIG. 13, the reinforcing ring protrusion can be formed by folding the periphery of the hidden opening 11 inward.

Optionally, the reinforcing ring protrusion is in the shape of a plate or a sheet.

Further, the storage box 20 and the housing 10 are provided with a first limiting structure, and the first limiting structure is used to limit the storage box 20 and the housing 10 in the second position. In this way, the storage box 20 can be prevented from moving too much and the storage box 20 is positioned at the second position, and the storage box 20 can also be prevented from being buckled/sunk into the housing 10.

In an exemplary embodiment, there are multiple forms of the first limiting structure, including but not limited to one or more of a magnetic attraction structure, a snap-fit structure, and a stop structure, etc., which will be described with examples below.

For example, as shown in FIG. 9, FIG. 12 and FIG. 13, the first limiting structure includes a first blocking protrusion 231 provided on the storage box 20 and a second blocking protrusion 121 provided on the inner wall surface of the housing 10. The second blocking protrusion 121 protrudes toward the center of the hidden opening 11. In the second position, the first blocking protrusion 231 abuts the second blocking protrusion 121 to limit the storage box 20 and prevent its excessive movement.

In this embodiment, as shown in FIG. 9, the first side wall 23 protrudes from the other side walls (including the second side wall 24) to form a first blocking protrusion 231.

In this embodiment, as shown in FIG. 12 and FIG. 13, the second blocking protrusion 121 can be protruded on the inner (ring) surface of the reinforcing ring protrusion.

Optionally, as shown in FIG. 12 and FIG. 13, the second blocking protrusion 121 extends along the side edge of the hidden opening 11.

Optionally, as shown in FIG. 12 and FIG. 13, the inner side (ring) surface of the reinforcing ring protrusion is further provided with a reinforcing rib (not shown) connecting the second blocking protrusion 121 and the reinforcing ring protrusion.

In other embodiments, the first blocking protrusion 231 can also cooperate with other structures, for example, the hidden opening 11 is a stepped hole.

Further, the storage box 20 and the housing 10 are provided with a second limiting structure, and the second limiting structure is used to limit the storage box 20 and the housing 10 in the first position. In this way, excessive movement of the storage box 20 can be prevented, so that the storage box 20 is positioned in the first position, so as to prevent the storage box 20 from being separated from the housing 10. In other embodiments, the second limiting structure may not be provided, and the storage box 20 can be taken out from the hidden opening 11 when necessary (using a remote controller).

In an exemplary embodiment, there are many forms of the second limiting structure, including but not limited to one or more of a magnetic attraction structure, a buckle structure, and a stop structure, etc. The following will give an example in conjunction with the movement form of the storage box 20 and the like.

It should be noted that, in some embodiments, in order to simplify the structure, the first limiting structure and the second limiting structure may share a part of the structure.

Further, as shown in FIG. 1 to FIG. 8, the storage box 20 is rotatably disposed in the hidden opening 11 so that the storage box 20 has a first position and a second position. For example, when necessary, the storage box 20 can be driven to rotate to the first position, so that the open end of the storage box 20 extends out of the hidden opening 11 to expose the storage opening 22. Thus, the remote control is taken out or the storage box 20 is put into the storage cavity 21. When necessary, the storage box 20 can be driven to rotate to the second position, so that the storage box 20 is hidden from the housing 10. In this way, the storage opening 22 can be exposed or the storage box 20 can be hidden through the rotation of the storage box 20, and the operation is simple and convenient. Moreover, the rotation of the storage box 20 requires less space for operation, which is beneficial to saving the internal space of the housing 10.

For example, as shown in FIG. 7, FIG. 8, FIG. 12 and FIG. 13, the inner wall surface of the housing 10 is provided protrudingly with a support protrusion 13. The support protrusion 13 extends away from the housing wall where the hidden opening 11 is located, and the storage box 20 is rotatably connected to the support protrusion 13, so that the storage box 20 is rotatably disposed on the housing 10. In this way, by arranging the support protrusion 13 on the inner wall surface of the housing 10, it is convenient to implement the rotational connection with the storage box 20, and can help to enhance the structural strength of the rotational connection structure between the storage box 20 and the housing 10.

Optionally, the support protrusion 13 is in the shape of a plate or a sheet.

Optionally, the support protrusion 13 is integrally formed with the reinforcing ring protrusion 12 to simplify the structure.

Further, as shown in FIG. 7 to FIG. 11, a rotating shaft 241 is protruded on the storage box 20, a rotating hole 131 is provided on the support protrusion 13, and the rotating shaft 241 is rotatably disposed in the rotating hole 131, so that the storage box 20 is rotatably connected to the support protrusion 13. In this way, it is beneficial to set the installation structure of the rotating shaft 241 and the rotating hole 131. In other embodiments, the rotating shaft 241 may also be disposed on the support protrusion 13, and correspondingly, the rotating hole 131 is disposed on the storage box 20.

Optionally, as shown in FIG. 9 to FIG. 11, the rotating hole 131 penetrates through the support protrusion 13.

For example, as shown in FIG. 9 to FIG. 11, the storage box 20 further includes two second side walls 24 adjacent to the first side wall 23, and the two second side walls 24 are respectively connected to two sides of the first side wall 23. The rotating shaft 241 is protruded from the outer wall surface of the second side wall 24. Optionally, a reinforcing protrusion (not shown) is provided at the connection between the rotating shaft 241 and the second side wall 24, to enhance the connection strength between the rotating shaft 241 and the second side wall 24, such that the connection stability of the rotating shaft 241 is improved.

Further, as shown in FIG. 7, FIG. 8, FIG. 12 and FIG. 13, there are two support protrusions 13, and the two support protrusions 13 are respectively provided on opposite sides of the hidden opening 11.

The storage box 20 is disposed between the two support protrusions 13, and two sides of the storage box 20 are respectively rotatably disposed on the two support protrusions 13.

In this way, the rotational stability of the storage box 20 can be enhanced.

It should be noted that, in other embodiments, the position and number of the support protrusions 13 can also be designed in other ways. For example, the support protrusion 13 can be provided on one side of the hidden opening 11. The number of the support protrusions 13 can be set to one or more. One side of the storage box 20 (e.g., the side opposite to the side where the storage opening 22 is located) is rotatably provided on the support protrusion 13; and so on.

Further, as shown in FIG. 7, FIG. 8, FIG. 12 and FIG. 13, the support protrusion 13 is also provided with a guide groove 132 communicating with the rotating hole 131, one end of the guide groove 132 away from the rotating hole 131 has an opening, and the guide groove 132 is used to guide the rotating shaft 241 to slide into the rotating hole 131.

For example, when installing the storage box 20, the rotating shaft 241 can be slid into the guide groove 132 through the opening of the guide groove 132, and can be slid into the rotating hole 131 through the guide groove 132. In this way, the rotating shaft 241 can be easily assembled into the rotating hole 131.

Optionally, as shown in FIG. 7, FIG. 8, FIG. 12 and FIG. 13, the guide groove 132 is flared, the rotating shaft 241 can be easily slid into the guide groove 132 during assembly, so that the rotating shaft 241 can be inserted into the rotating hole 131.

Optionally, the guide groove 132 is disposed on the side of the rotating hole 131 away from the housing wall where the hidden opening 11 is located; thus, it is additionally convenient to assemble the rotating shaft 241.

Optionally, as shown in FIG. 7, FIG. 8, FIG. 12 and FIG. 13, the guide groove 132 penetrates through the support protrusion 13.

Optionally, the guide groove 132 is smoothly connected with the rotating hole 131.

For example, as shown in FIG. 12 and FIG. 13, a connection between the guide groove 132 on at least one of the support protrusions 13 and the rotating hole 131 is provided with a locking protrusion (not shown). The locking protrusion is used to limit the rotating shaft 241 to prevent it from escaping from the rotating hole 131. In this embodiment, only one of the support protrusions 13 is provided with the locking protrusion.

For example, as shown in FIG. 7, FIG. 8, FIG. 12 and FIG. 13, a thickening portion 133 is protruded on the periphery of the rotating hole 131 on the support protrusion 13. In this way, on the one hand, the structural strength of the rotating hole 131 can be improved, and the wear resistance of the rotating hole 131 can be increased. On the other hand, the contact area between the rotating shaft and the rotating hole 131 can also be increased, thereby increasing the rotational stability of the storage box. Optionally, the thickening portion 133 is provided on the side of the support protrusion 13 facing away from the storage box 20.

For example, as shown in FIG. 12 and FIG. 13, a protrusion 134 is provided on the side of the support protrusion 13 facing the storage box 20 (i.e., the inner side of the support protrusion 13). The protrusion 134 is used to abut the outer wall surface of the second side wall 24 during the rotation of the storage box 20.

Optionally, the protrusion 134 is disposed proximally to the rotating hole 131 and the guide groove 132, so that the structural strength of the support protrusion 13 at the rotation hole 131 and the guide groove 132 can be improved.

Optionally, the protrusion 134 extends in a direction away from the hidden opening 11, so as to improve the structural strength of the support protrusion 13 at the rotating hole 131 and the guide groove 132.

It can be understood that during the rotation of the storage box 20, the protrusion 134 can abut the outer wall surface of the second side wall 24. In this way, direct contact between the inner side surface of the support protrusion 13 and the outer wall surface of the second side wall 24 can be avoided. Therefore, the contact area between the support protrusion 13 and the outer wall surface of the second side wall 24 during rotation can be reduced, so as to reduce the rotation resistance of the storage box 20.

Optionally, the protrusion 134 is high in the middle and low at both ends, so as to further reduce the rotational resistance of the storage box 20.

Optionally, there are two protrusions 134, and the two protrusions 134 are respectively provided on opposite sides of the rotating hole 131. As shown in FIG. 13, one of the protrusions 134 is provided on the upper side of the rotating hole 131, and the other protrusion 134 is provided on the lower side of the rotating hole 131.

Further, as shown in FIG. 12 and FIG. 13, the inner wall surface of the housing 10 is further provided protrudingly with a connecting protrusion 14, and the connecting protrusion 14 is disposed on one side of the hidden opening 11 to connect the two support protrusions 13. In this way, the structural strength and stability of the support protrusions 13 can be enhanced, so that the rotational stability of the storage box 20 can be enhanced. It can be understood that the two support protrusions 13 and the connecting protrusions 14 are enclosed on the outside of the storage box 20, and can also protect the storage box 20, to reduce the risk of damage caused by the collision between the storage box 20 and other components in the housing 10.

Optionally, as shown in FIG. 12 and FIG. 13, the connecting protrusion 14 is integrally formed with the reinforcing ring protrusion 12. Optionally, the connecting protrusion 14 is in the shape of a plate or a sheet.

Further, the rotating shaft 241 is disposed close to the first side wall 23. In this way, on the one hand, the protruding length of the support protrusion 13 can be reduced, and the rotation stability of the storage box 20 can be improved. In this embodiment, as shown in FIG. 7, FIG. 8, FIG. 12 and FIG. 13, the rotating shaft 241 is provided on the side of the second side wall 24 close to the first side wall 23.

Further, as shown in FIG. 7, FIG. 8, FIG. 12 and FIG. 13, the storage box 20 also has a box bottom end opposite to its open end, and the rotating shaft 241 is disposed at the box bottom end. In this way, the rotation range of the storage box 20 can be reduced, so as to save the inner space of the housing 10.

Optionally, as shown in FIG. 7, FIG. 8, FIG. 12 and FIG. 13, the rotating shaft 241 is disposed adjacent to the connection between the first side wall 23 and the second side wall 24.

For example, as shown in FIG. 12 and FIG. 13, the hidden opening 11 has a first side edge (not shown) corresponding to the open end of the storage box 20, a second side edge (not shown) opposite to the first side edge, and two third side edges (not shown) adjacent to the first side edge. Optionally, the hidden opening 11 is a square hole or is substantially a square hole.

Figure 7:
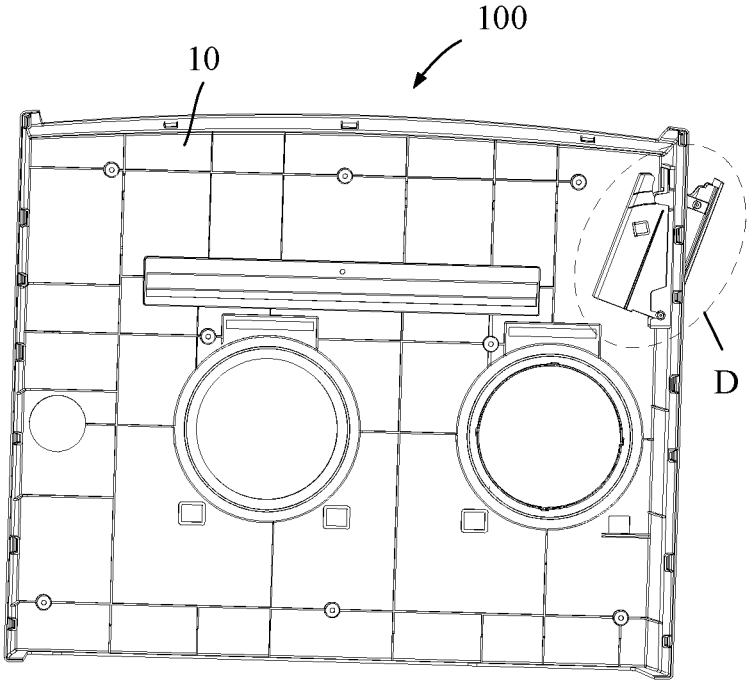
FIG. 7 is a schematic structural view of the inner of the mobile air conditioner in FIG. 5.

It can be understood that as shown in FIG. 7 and FIG. 8, when the storage box 20 is rotated from the second position to the first position, the open end of the storage box 20 will move in a direction close to the first side edge of the hidden opening 11. In this way, interference between the open end of the storage box 20 and the first side edge of the hidden opening 11 is avoided. Thus, when in the second position, the open end of the storage box 20 is spaced from the first side edge of the hidden opening 11 to avoid interference with the edge (i.e., the first side edge) of the hidden opening 11 when the storage box 20 is rotated. Alternatively, the opening end of the second side wall 24 is formed with an avoidance notch 242 at the connection with the first side wall 23. The avoidance notch 242 avoids the edge of the hidden opening 11 (i.e., the first side edge) when the storage box 20 is rotated, so as to avoid interference with the edge of the hidden opening 11 (i.e., the first side edge) when the storage box 20 is rotated. Alternatively, the open end of the storage box 20 is inclined to avoid the edge (i.e., the first side edge) of the hidden opening 11 when the storage box 20 is rotated, to avoid interference with the edge (i.e., the first side edge) of the hidden opening 11 when the storage box 20 is rotated. Other escape structures may also be provided on the storage box 20 and/or the housing 10 to avoid interference with the edge (i.e., the first side edge) of the hidden opening 11 when the storage box 20 is rotated.

In some embodiments, as shown in FIG. 9 to FIG. 11, the open end of the second side wall 24 is formed with an avoidance notch 242 at the connection with the first side wall 23, and the avoidance notch 242 extends for a predetermined length in the extending direction of the first side wall 23. Optionally, the avoidance notch 242 is a stepped notch.

In this embodiment, as shown in FIG. 9 to FIG. 11, the open end of the first side wall 23 protrudes from the open end of the second side wall 24 to form the avoidance notch 242. Optionally, the open end of the first side wall 23 also protrudes from the open end of the third side wall (i.e., the side wall of the storage box 20 opposite to the first side wall 23).

Further, as shown in FIG. 9 to FIG. 11, a gripping notch 243 is formed on the open end of the side wall of the storage box 20, and the gripping notch 243 is recessed toward the bottom of the storage cavity 21. In this way, by providing the gripping notch 243, when the remote control is stored in the storage cavity 21, the gripping notch 243 can expose the upper end of the remote control, so that it is convenient for the user to store or take the remote control.

For example, as shown in FIG. 9 to FIG. 11, the gripping notch 243 is provided on the second side wall 24, so that it is convenient for the user to hold the remote control.

Optionally, as shown in FIG. 9 to FIG. 11, each second side wall 24 is provided with a gripping notch 243, and the two gripping notch 243 are opposite to each other, so that it is additionally convenient for the user to hold the remote control.

Optionally, the gripping notch 243 is provided at the middle of the second side wall 24.

Further, as shown in FIG. 3, FIG. 4, FIG. 7 and FIG. 8 to FIG. 13, a guide structure is provided on the storage box 20 and the housing 10, and the guide structure is used to guide the rotation of the storage box 20. For example, the guide structure can be used to guide the storage box 20 to rotate from the first position to the second position; alternatively, the guide structure can be used to guide the storage box 20 to rotate from the second position to the first position. In this way, the rotational stability of the storage box 20 can be improved.

Further, as shown in FIG. 12 and FIG. 13, an inner wall surface of the housing 10 is provided protrudingly with a guide support portion 15, a guide protrusion 151 is provided on one side of the hidden opening 11. The guide structure includes a guide protrusion 151 laterally protruding from the guide support portion 15, and a guide groove 144 provided on the outer wall surface of the storage box 20, and the guide protrusion 151 is slidably provided in the guide groove 244, and is configured to guide the rotation of the storage box 20. For example, the guide protrusion 151 is provided on the side of the guide support portion 15 facing the hidden opening 11, and the guide groove 244 is provided on the outer wall surface of the second side wall 24. In this way, the storage box 20 can be guided to rotate with a simple structure.

Optionally, the guide groove 244 is an arc groove.

Optionally, the distal end of the guide protrusion 151 is provided with a spherical portion to reduce frictional force and rotational resistance. Optionally, the spherical portion may be spherical, spheroid, ellipsoid, or the like.

For example, the guide groove 244 has an outer end close to the first side wall 23 and an inner end away from the first side wall 23, and the groove depth of the guide groove 244 increases from the outside to the inside. In this way, it is convenient to turn the storage box 20 from the second position to the first position, and it is also beneficial to limit the storage box 20 and the housing 10 when the storage box 20 is in the second position.

Optionally, the groove bottom of the guide groove 244 is an inclined surface or an arc surface.

Optionally, the guide support portion 15 is in the shape of a plate or a sheet.

Optionally, the guide support portion 15 is integrally formed with the reinforcing ring protrusion 12 to simplify the structure.

Further, as shown in FIG. 12 and FIG. 13, there are two guide support portions 15, the two guide support portions 15 are respectively disposed on opposite sides of the hidden opening 11, and guide grooves 244 are provided on the outer wall surfaces of the two second side walls 24 of the storage box 20. Optionally, each guide support portion 15 is provided with at least one guide protrusion 151. Optionally, the two guide support portions 15 are disposed opposite to each other.

In this way, the rotational stability of the storage box 20 can be enhanced.

Further, as shown in FIG. 7 to FIG. 10, the guide groove 244 is disposed adjacent to the open end of the storage box 20.

For example, the gripping notch 243 breaks the guide groove 244 to form two guide sub-grooves (not shown), and a fracture (not shown) is formed between the two guide sub-grooves. In this way, when the storage box 20 is rotated, the guide protrusions 151 can be rotated within the fracture, thereby reducing the rotation resistance of the storage box 20.

Further, the guide protrusion 151 can be shared by the guide structure and the first limiting structure to simplify the structure. For example, as shown in FIG. 5 to FIG. 13, the first limiting structure further includes a guide protrusion 151 and a limiting groove 2441 provided at the bottom of the guide groove 244. In the second position, the guide protrusion 151 is limited to the limiting groove 2441. In this way, the storage box 20 can be positioned/fixed at the second position. It can be understood that when the storage box 20 needs to be rotated, the user can force (i.e., pull) the storage box 20 to make the guide protrusion 151 escape from the limiting groove 2441.

It should be noted that when the storage box 20 moves (e.g., rotates) to the second position, the first blocking protrusion 231 on the storage box 20 abuts the second blocking protrusion 121 on the housing 10 to prevent the storage box 20 from moving excessively. Meanwhile, the guide protrusion 151 slides into the limiting groove 2441 to further limit the storage box 20 and the housing 10 to position/fix the storage box 20 in the second position.

In other embodiments, the guide structure can also be provided in other forms or other positions. For example, the guide structure includes a guide arc protrusion on the second side wall 24 and a guide notch on the second side edge of the hidden opening 11. The guide arc protrusion is arc-shaped, and the guide arc protrusion is slidably disposed in the guide notch to guide the rotation of the storage box 20. Optionally, the height of the guide arc protrusion increases from the inside to the outside, which is not repeated herein.

In this embodiment, as shown in FIG. 12 and FIG. 13, the second blocking protrusion 121 is disposed corresponding to the third side edge of the hidden opening 11. For example, the second blocking protrusion 121 is spaced apart from the second side edge of the hidden opening 11. An avoidance space is formed between the second blocking protrusion 121 and the second side edge of the hidden opening 11. In this way, on the one hand, the avoidance space can avoid the first blocking protrusion 231 when the storage box 20 is rotated. On the other hand, when the storage box 20 is assembled from the inside of the housing 10, the first blocking protrusions 231 on the storage box 20 can pass through the avoidance space and be assembled to the outside of the housing 10.

For example, there are two second blocking protrusions 121, and the two second blocking protrusions 121 are respectively disposed corresponding to the two third side edges of the hidden opening 11.

Further, as shown in FIG. 1, FIG. 2 and FIG. 7 to FIG. 11, the second limiting structure includes a stop protrusion 26 provided on the storage box 20, and the stop protrusion 26 is provided in the housing 10. In the first position, the stop protrusion 26 is in contact with the inner wall surface of the housing 10 to limit the storage box 20 and prevent it from moving too much. For example, when the storage box 20 is rotated to the first position, the stop protrusion 26 is in contact with the inner wall surface of the housing 10. In this way, depending on the structure of the housing 10, the housing 10 is matched with the stop protrusion 26 to form the second stop structure, the structure can be simplified. In other embodiments, a matching structure may also be provided on the inner wall surface of the housing 10 to abut the stop protrusion 26 at the first position.

For example, as shown in FIG. 1, FIG. 2 and FIG. 7 to FIG. 11, the stop protrusion 26 is disposed away from the rotation axis of the storage box 20 to increase the distance between the stop protrusion 26 and the rotation axis of the storage box 20, to increase the moment arm, thus the risk of damage to the stop protrusion 26 and the rotating shaft 241 is reduced.

For example, as shown in FIG. 1, FIG. 2 and FIG. 7 to FIG. 11, the stop protrusion 26 is provided on the second side wall 24 of the storage box 20. Optionally, the stop protrusion 26 is disposed close to the open end of the storage box 20, and the stop protrusion 26 is disposed away from the first side wall 23.

Further, the stop protrusion 26 is rotatably provided on the storage box 20. In this way, when the storage box 20 is rotated to the first position, the stop protrusion 26 can be rotated in the process of interacting with the inner wall surface of the housing 10 so as to be rotated to a suitable position to abut the inner wall surface of the housing 10, thereby reducing the design accuracy and difficulty (that is, when designing, it is not necessary to consider the relationship between the inclination angle of the contact surface of the stop protrusion 26 and the maximum rotation angle of the storage box 20).

For example, the stop protrusion 26 may be in the shape of a plate, a sheet, or a block. In this embodiment, as shown in FIG. 1, FIG. 2 and FIG. 7 to FIG. 11, the stop protrusion 26 is in the shape of a bent plate, which includes a rotating portion and a stop portion. The rotating portion is rotatably connected to the storage box 20, and the stop portion is used for abutting the inner wall surface of the housing 10.

In other embodiments, the stop protrusion 26 can also be set in a cylindrical shape or a quasi-cylindrical shape. At this time, the stop protrusion 26 can be integrally formed with the storage box 20 (it is not necessary to be rotatably connected).

Further, as shown in FIG. 1, FIG. 2 and FIG. 7 to FIG. 11, there are two stop protrusions 26. The two stop protrusions 26 are respectively disposed on the outer wall surface of the second side wall 24 of the storage box 20. In this way, the force applied to the storage box 20 in the first position can be more symmetrically balanced, thereby reducing the risk of damage to the stop protrusion 26.

Further, as shown in FIG. 1, FIG. 2, FIG. 5, FIG. 6, FIG. 10 and FIG. 11, the first side wall 23 is provided with a gripping structure, and the gripping structure is used for the user to grasp. In this way, the user can drive the storage box 20 to rotate through the gripping structure, so as to facilitate the user to apply force, thereby improving the user's comfort.

For example, as shown in FIG. 1, FIG. 2, FIG. 5, FIG. 6, FIG. 10 and FIG. 11, the gripping structure includes a buckle handle 232 formed by the indentation of the first side wall 23.

In this embodiment, as shown in FIG. 11, the buckle handle 232 has a buckle opening 2321. The buckle handle 232 includes a first buckle wall 2322 and a second buckle wall 2323 disposed on opposite sides of the buckle opening 2321. The first buckle wall 2322 extends obliquely in a direction away from the second buckle wall 2323 from the outside to the inside. The second buckle wall 2323 extends obliquely toward the first buckle wall 2322 from the outside to the inside. The direction towards the bottom of the buckle handle 232 is inward, and the direction away from the bottom of the buckle handle 232 is outward.

In this embodiment, as shown in FIG. 11, the first buckle wall 2322 extends obliquely from the outside to the inside in a direction away from the second buckle wall 2323, so that the user interacts with the first buckle wall 2322 to drive the storage box 20 to move. Optionally, the first buckle wall 2322 is disposed on the side of the buckle opening 2321 toward the open end of the storage box 20.

In this embodiment, as shown in FIG. 11, the second buckle wall 2323 extends obliquely toward the first buckle wall 2322 from the outside to the inside, so as to guide the user to interact with the first buckle wall 2322.

In this embodiment, the buckle handle 232 further includes a buckle bottom 2324, and the buckle bottom 2324 is disposed opposite to the buckle opening 2321.

The gripping structure can also be provided in other structural forms, such as a lifting handle, etc., as long as it can be grasped by the user.

Further, as shown in FIG. 11, guide ribs 25 are protruded on the inner wall surface of the storage cavity 21. The guide ribs 25 extend along the depth direction of the storage cavity 21. The height of the guide ribs 25 increases in the direction from the storage opening 22 to the bottom of the storage cavity 21. For example, the height of the guide rib 25 increases in the insertion direction of the remote controller. In this way, when storing the remote control, the guide rib 25 can be used to guide the remote control to be inserted into the storage cavity 21, so that the remote control can be stored in the storage cavity 21. After the remote controller is stored, the guide ribs 25 can also be used to limit the remote controller to prevent the remote controller from shaking, so as to avoid noise caused by the shaking of the remote controller during the process of moving the mobile air conditioner 100.

For example, the width of the guide rib 25 increases in the direction from the storage opening 22 to the bottom of the storage cavity 21. In this way, on the one hand, the contact area between the guide rib 25 and the remote control can be increased to enhance the limiting effect, and on the other hand, the structural strength of the storage box 20 can also be increased.

For example, there are two guide ribs 25. The two guide ribs 25 are respectively disposed on the inner wall surfaces of the two second side walls 24.

It can be understood that when the remote controller is stored in the storage box 20, the mobile air conditioner 100 is transported, the remote controller may be separated from the storage cavity 21 from the storage opening 22 and fall into the housing 10.

For example, the outer wall surface of the storage box 20 is provided with a thinning groove 245 corresponding to the guide rib 25, so that the thickness of the box wall of the storage box 20 can be uniform or relatively uniform.

In order to solve the problem, the mobile air conditioner 100 further includes a limiting member, and the limiting member is cooperatively connected with the storage box 20 for preventing the remote controller from being separated from the storage cavity 21. Optionally, the limiting member is a box cover or protective foam (which can be sandwiched between the remote control and the inner wall surface of the storage cavity 21) or the like.

Alternatively, the housing 10 includes a first housing wall (i.e., the upper housing wall in the state of FIG. 3) that is opposite to the storage opening 22 in the first position. The hidden opening 11 is disposed close to the first housing wall to prevent the remote controller from being separated from the storage cavity 21. Optionally, the distance between the storage opening 22 and the first housing wall is smaller than the length of the remote control.

Alternatively, the inner wall surface of the housing 10 is provided with a shift protrusion, and the shift protrusion is disposed corresponding to the storage opening 22 for preventing the remote control from being separated from the storage cavity 21.

It should be noted that in this embodiment, the use process of the storage box 20 is roughly as follows: 1) when the storage box 20 is rotated to the second position, the first blocking protrusion 231 on the storage box 20 is in contact with the second blocking protrusion 121 on the housing 10, and the guide protrusion 151 is limited to the limiting groove 2441; 2) when the storage opening 22 needs to be exposed, the user drives the storage box 20 to rotate through the buckle handle 232, and the guide protrusion 151 disengages from the guide groove 244 and slides along the guide groove 244, until the stop protrusion 26 abuts the inner wall surface of the housing 10, the storage box 20 is rotated to the second position and the storage opening 22 is exposed.

For example, the storage box 20 further includes a bottom wall 27 disposed opposite to the storage opening 22, and a through hole 271 is formed on the bottom wall 27. Optionally, the through hole 271 is disposed close to the first side wall 23. In this way, it is easy to open the mold.

In order to further understand the technical solutions of the present disclosure, as shown in FIG. 14 and FIG. 15, and FIG. 7, FIG. 8, FIG. 3 and FIG. 4, the present disclosure further provides a method for assembling a storage box 20, including following operations.

At Operation S100, an open end of the storage box 20 is inserted into a hidden opening 11 from an inner side of a housing 10.

Figure 14:
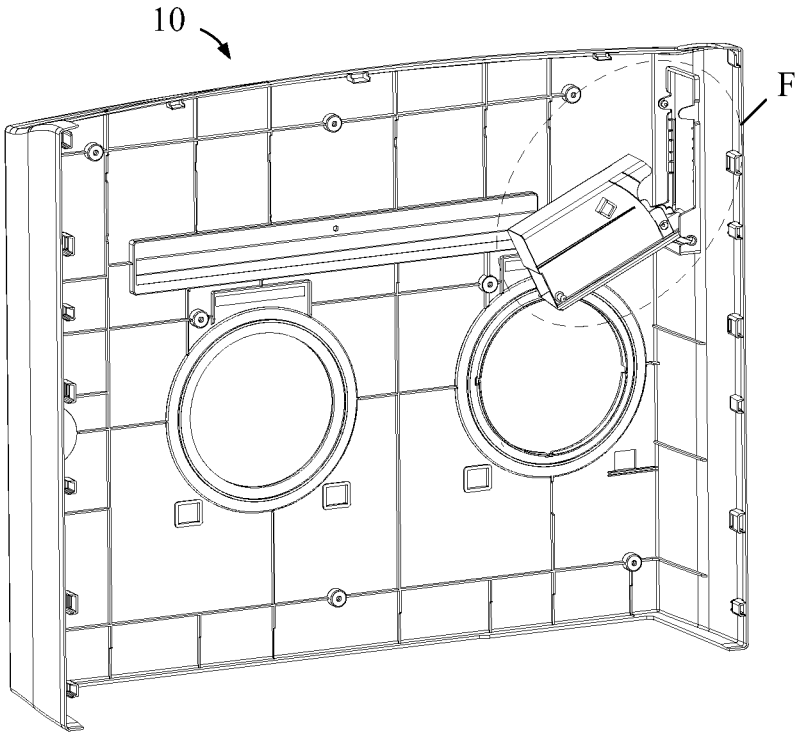
FIG. 14 is the assembly schematic view of the storage box in the present disclosure.
Figure 15:
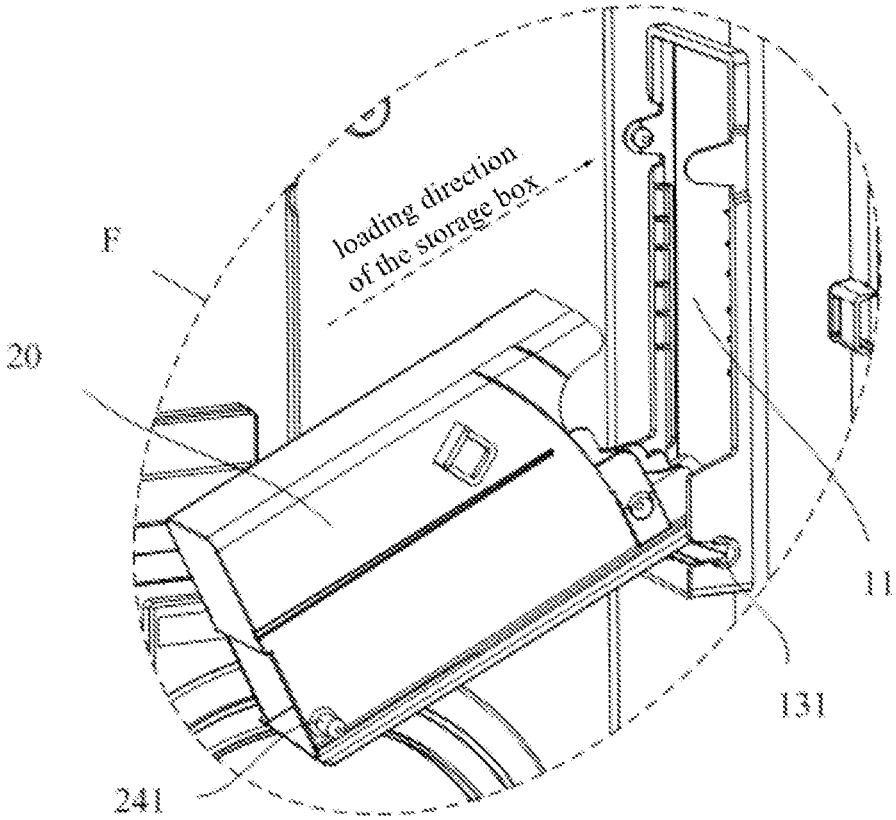
FIG. 15 is a partial enlarged view of portion F in FIG. 14.

For example, as shown in FIG. 14 and FIG. 15, the storage box 20 is inclined in the housing 10, and the open end of the storage box 20 (i.e., the upper end in FIG. 15) faces the hidden opening 11. The storage box 20 is subsequently moved to the direction close to the hidden opening 11, so that the open end of the storage box 20 is inserted into the hidden opening 11 from the inner side of the housing 10, and moved to the outside of the housing 10. The first blocking protrusion 231 of the storage box 20 can pass through the avoidance space.

At Operation S200, the rotating shaft 241 on the storage box 20 is assembled into the rotating hole 131 through the guide groove 132.

For example, after the operation S100, as shown in FIG. 7 and FIG. 8, it is continued to control the bottom end of the storage box 20 (i.e., the lower end in FIG. 15) to move towards the direction close to the hidden opening 11. The rotating shaft 241 slides into the guide groove 132 through the opening of the guide groove 132, and slides into the rotating hole 131 through the guide groove 132.

It should be noted that after the rotating shaft 241 is assembled into the rotating hole 131, the assembly of the storage box 20 is completed, and the storage box 20 is in the second position at this time.

Optionally, as shown in FIG. 3 and FIG. 4, the method further includes operation S300, which includes controlling the rotation of the storage box 20 and rotating the open end of the storage box 20 into the hidden opening 11, so that the first blocking protrusion 231 on the storage box 20 is in contact with the second blocking protrusion 121 on the housing 10. The guide protrusion 151 slides into the limiting groove 2441 to rotate the storage box 20 to the first position, so that the storage box 20 is hidden from the housing 10.

In this way, the assembly of the storage box 20 is simple and convenient.

In another embodiment of the present disclosure, the storage box 20 is slidably disposed on the housing 10, so that the storage box 20 has a first position and a second position.

In this embodiment, further, the hidden opening 11 is close to the housing wall adjacent to the housing wall where the hidden opening 11 is located, and the storage box 20 is slidably disposed on the housing wall adjacent to the housing wall where the hidden opening 11 is located. In this way, the structure is simplified. In an example, the hidden opening 11 is provided on the left or right housing wall of the housing 10. The hidden opening 11 is provided close to the front housing wall or the rear housing wall of the housing 10, and the storage box 20 is slidably disposed on the inner wall surface of the front housing wall or the rear housing wall.

In this embodiment, further, the storage box 20 is slidably connected to the inner wall surface of the housing 10 through the guide rail structure. Optionally, the storage box 20 is slidably connected to the inner wall surface of the housing 10 through a double guide rail structure.

Figure 16:
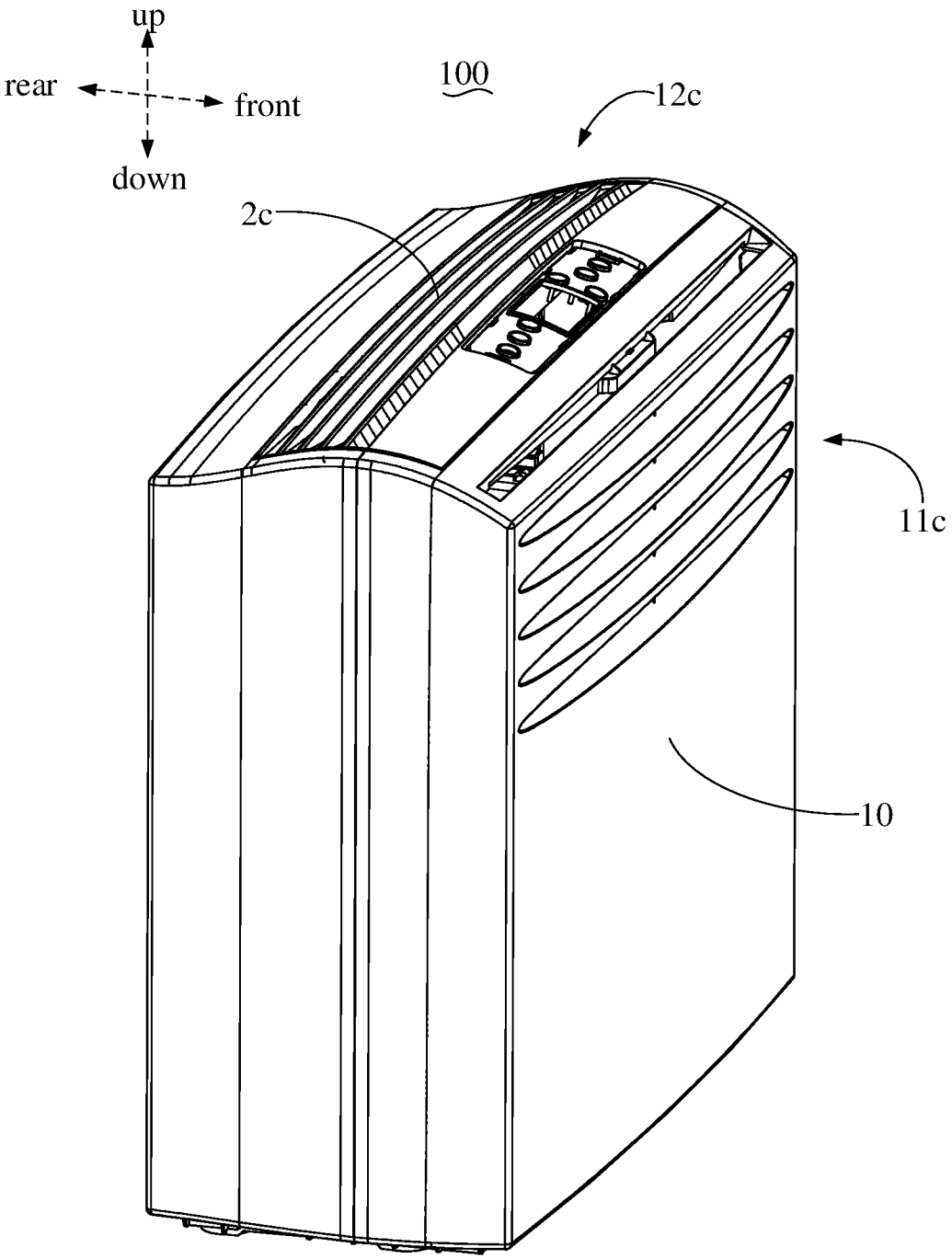
FIG. 16 is a schematic structural view of the mobile air conditioner according to another embodiment of the present disclosure.

As shown in FIG. 16, in another exemplary embodiment of the present disclosure, the mobile air conditioner 100 includes a housing 10 and a cross-flow fan (not shown). The housing 10 is provided with an indoor air inlet 11*c*, and the top of the housing 10 is provided with an indoor air outlet 12*c*. An indoor air duct communicating the indoor air inlet 11*c* with the indoor air outlet 12*c* is formed inside the housing 10. The cross-flow fan is installed in the indoor air duct. In the above technical solutions, the indoor air outlet 12*c* is provided on the top of the housing 10. When the cross-flow fan is running, the indoor air enters the indoor air duct from the indoor air inlet 11*c*, and then blows out from the indoor air outlet 12*c* at the top. When the indoor air needs rapid heat exchange, the rotation speed of the cross-flow fan can be directly increased to increase the air output from the indoor air outlet 12*c*. Since the indoor air outlet 12*c* is provided on the top of the housing 10, when the air is blown out, it will not directly act on the user. On the premise of ensuring that there is sufficient air volume for cooling and heating indoor air, and the cold air or hot air blown from the indoor air outlet 12*c* is prevented from directly blowing on the user, so as to prevent the user from feeling uncomfortable, such as excessive cold and overheating, and optimize the user experience.

Figure 17:
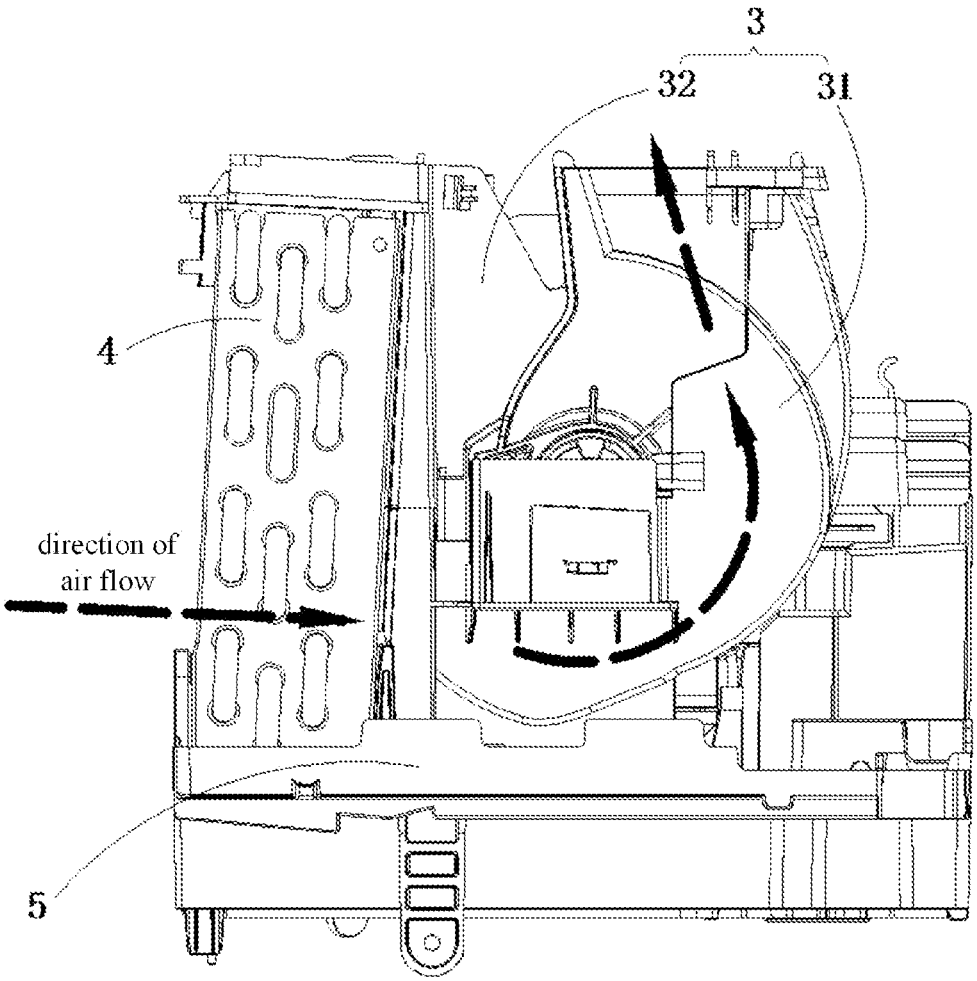
FIG. 17 is a schematic structural view of the connection of a volute assembly, an indoor heat exchanger and a middle partition according to an embodiment of the present disclosure.

As shown in FIG. 16 and FIG. 17, in order to implement the heat exchange function of the mobile air conditioner 100, an indoor heat exchanger 4 needs to be provided on the air inlet of the volute assembly 3. When the cross-flow fan rotates, the indoor air enters the interior of the housing 10 from the indoor air inlet 11*c*, and enters the indoor air duct after heat exchange with the indoor heat exchanger 4.

The indoor air inlet 11*c* is optionally provided at the front or the rear of the housing 10. During the actual use of the mobile air conditioner 100, the user can move the position of the mobile air conditioner 100 according to actual needs. Take the direction the user is facing as the front, when the indoor air inlet 11*c* is provided at the front of the housing 10, the cross-flow fan directly extracts the air on the side of the user for heat exchange. A weak airflow is formed in the room so that the ambient temperature in the area where the user is located quickly reaches the target value. When the indoor air inlet 11*c* is provided at the rear of the housing 10, the air on the user's side will not form airflow, and follow the ambient temperature to change evenly and slowly, improving comfort.

Figure 21:
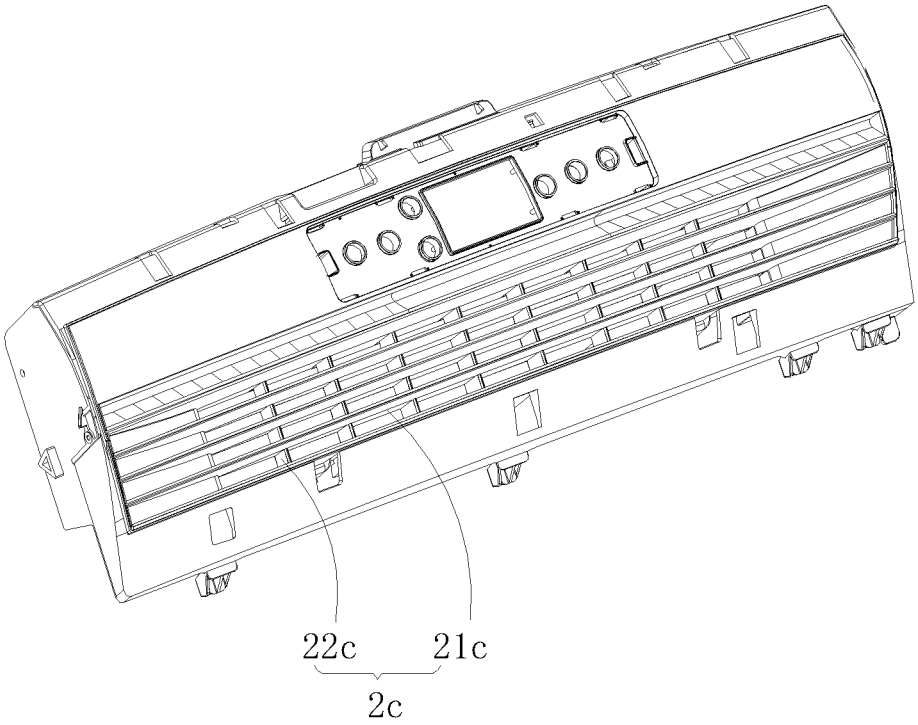
FIG. 21 is a schematic structural view of the top of the housing according to an embodiment of the present disclosure.
Figure 22:
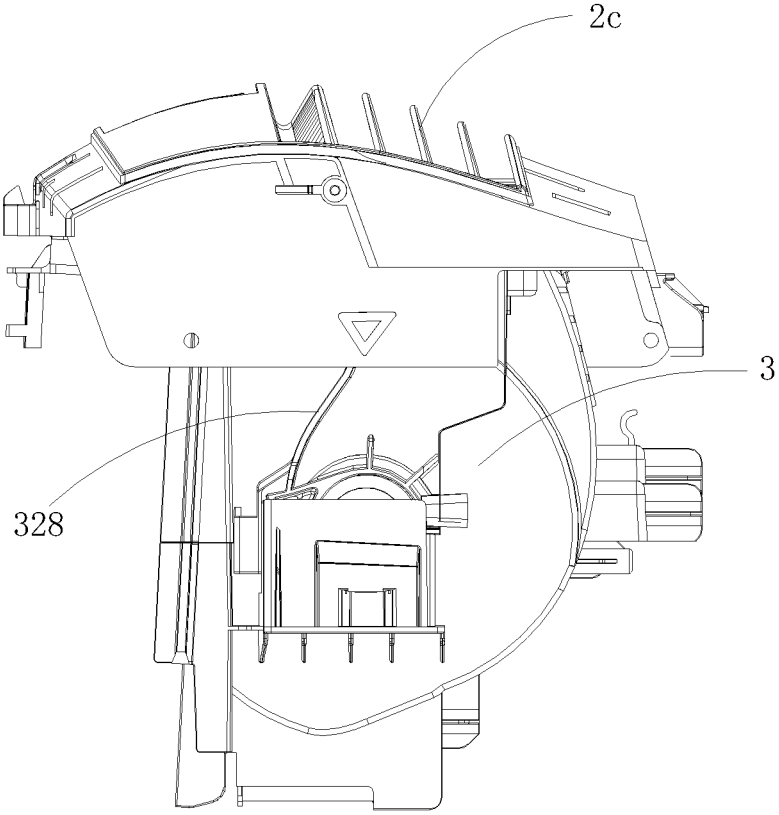
FIG. 22 is a schematic structural view of the connection of the volute assembly and the housing according to an embodiment of the present disclosure.
Figure 23:
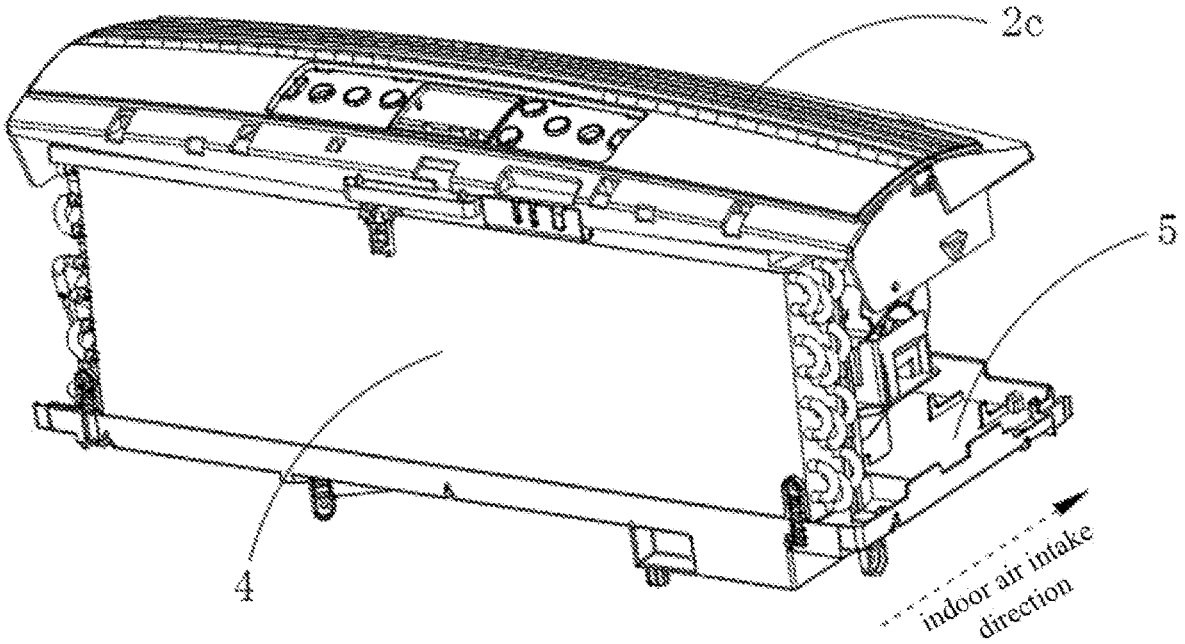
FIG. 23 is a schematic structural view of the connection of the volute assembly and the middle partition according to an embodiment of the present disclosure.
Figure 24:
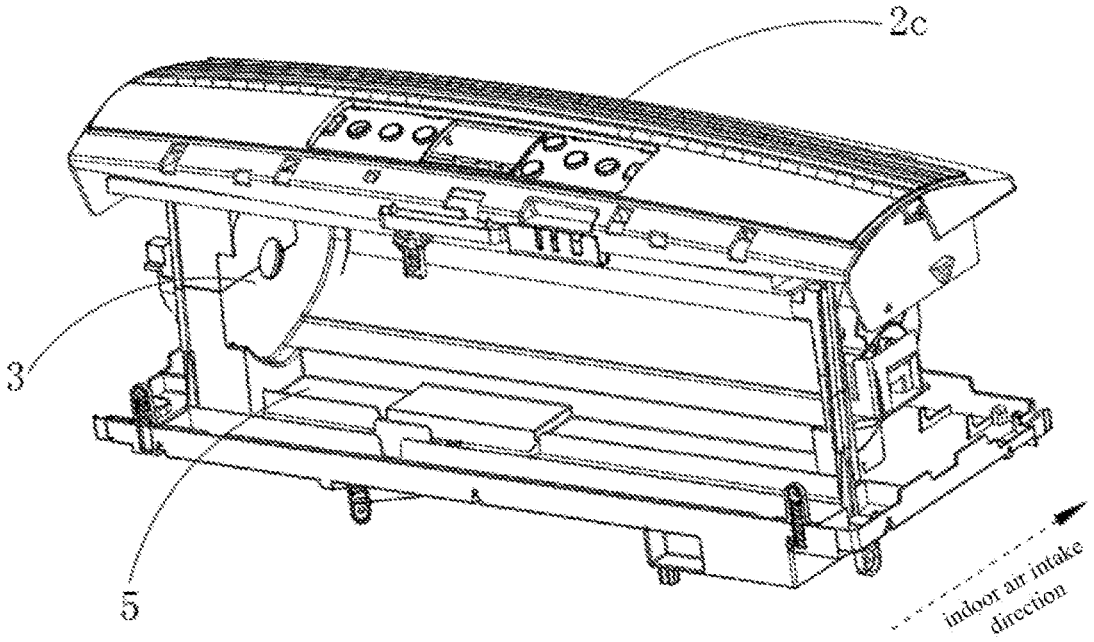
FIG. 24 is a schematic structural view of the connection of the volute assembly, the middle partition, and the indoor heat exchanger according to an embodiment of the present disclosure.

As shown in FIG. 16, FIG. 21 and FIG. 22, the indoor air outlet 12*c* is provided with a guide grille 2*c*, and the guide grille includes 2*c* a plurality of longitudinal grille strips 21*c* extending along a length direction of the indoor air inlet 11*c*. The longitudinal grille strips 21*c* are inclined forwardly, that is, the direction of air outlet is consistent with the inclination direction of the longitudinal grille strips 21*c*. Since the longitudinal grille strips 21*c* are inclined forward, the hot air or cold air formed after the heat exchanger treatment directly acts on the upper part of the side where the user is located. The hot air or cold air will quickly exchange heat with the indoor ambient air during the blowing process, so that the ambient temperature on the user's side can quickly reach the target value. While the ambient temperature on the user's side is prioritized, the cold air or hot air blown from the indoor air outlet 12*c* is prevented from blowing directly on the user.

The guide grille 2*c* further includes a plurality of horizontal grille strips 22*c* extending along a width direction of the indoor air outlet 12*c*. The horizontal grille strips 22*c* and the longitudinal grille strips 21*c* are alternately arranged, and the longitudinal grille strips 21*c* protrude upward from the horizontal grille strips 22*c*. That is, the guide grille 2*c* includes an inner grille layer and an outer grille layer. The inner grille layer is formed by crisscrossing longitudinal grille strips 21*c* and horizontal grille strips 22*c*, and the outer grille is formed by the parts of the longitudinal grille strips 21*c* protruding outward from the horizontal grille strips 22*c*. The crisscrossed inner grille can make the air outlet more uniform and has a dust-proof effect, and the outer grille is more aesthetically appealing, and has the effect of guiding the air and reducing the loss of air volume.

Figure 18:
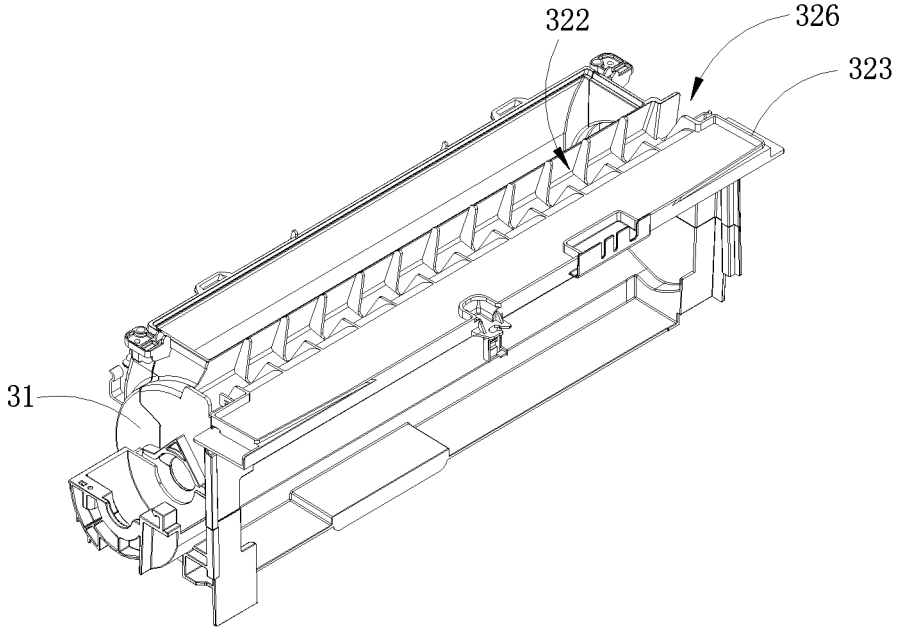
FIG. 18 is a schematic structural view of the volute assembly according to an embodiment of the present disclosure.
Figure 19:
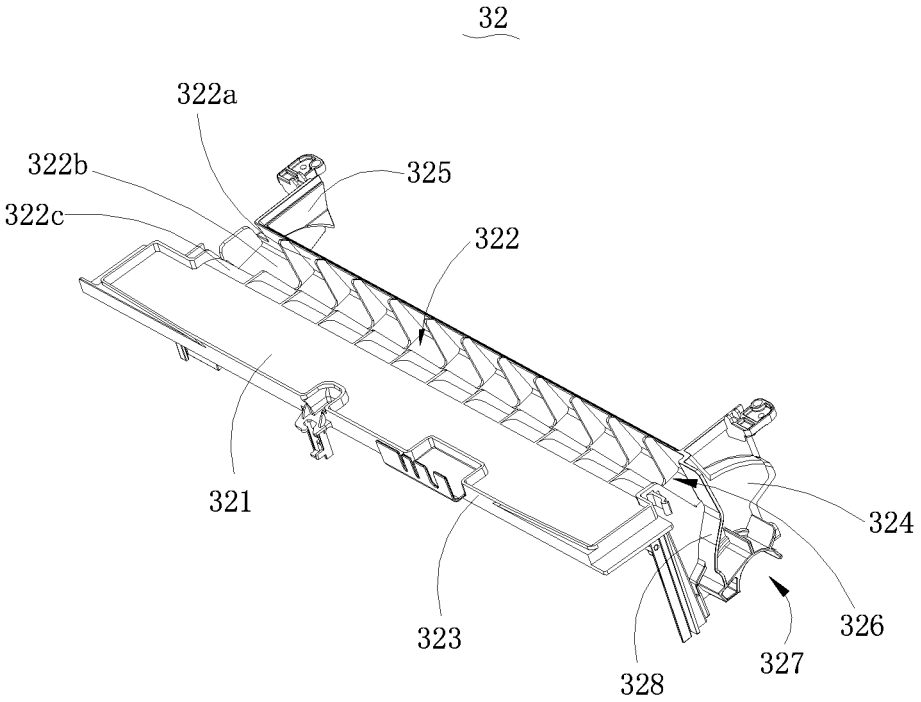
FIG. 19 is a schematic structural view of a volute cover according to an embodiment of the present disclosure.
Figure 20:
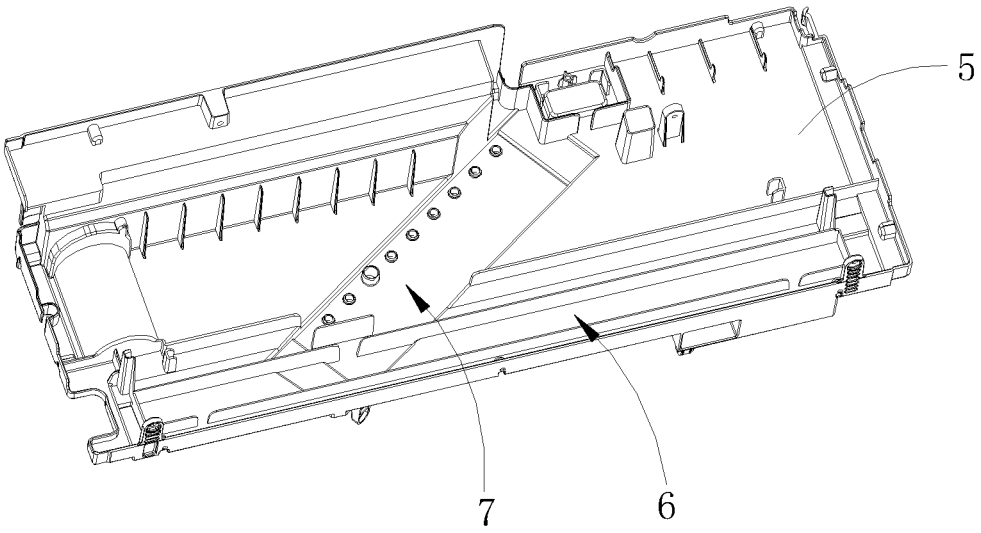
FIG. 20 is a schematic structural view of the middle partition according to an embodiment of the present disclosure.

As shown in FIG. 17, FIG. 18 and FIG. 19, the mobile air conditioner 100 further includes a volute assembly 3, and the volute assembly 3 includes a volute 31 and a volute cover 32, and the volute 31 and the volute cover 32 cooperate to form an indoor air duct. That is, the volute assembly 3 is formed by splicing the volute 31 and the volute cover 32. When installing the cross-flow fan, it is possible to first fix the cross-flow fan with the volute 31 or the volute cover 32, and then combine the volute 31 and the volute cover 32. The cross-flow fan is provided in the indoor air duct formed by splicing the volute 31 and the volute cover 32.

The mobile air conditioner 100 further includes an indoor heat exchanger 4 provided on the air inlet of the volute assembly 3. The volute cover 32 includes a top plate 321 disposed above the indoor heat exchanger 4, and the top plate 321 is recessed downward on the air outlet of the indoor heat exchanger 4 to form a water diversion groove 322. The air treated by the indoor heat exchanger 4 is blown out from the top, which makes it easy to exchange heat with the ambient air to form condensed water. The water diversion groove 322 is provided to collect the condensed water. The top plate 321 shields the indoor heat exchanger 4 to prevent the condensed water from dripping on the indoor heat exchanger 4, thereby preventing the condensed water from entering the indoor air duct.

The water diversion groove 322 is surrounded by the first side wall 322*a*, the bottom plate 322*b* and the second side wall 322*c*. The air outlet of the volute assembly 3 is formed between the first side wall 322*a* and the air duct plate of the volute 31, and the air outlet is connected to the indoor air outlet 12*c*. The hot air or cold air is prevented from overflowing from the gap between the air outlet and the indoor air outlet 12*c*, which affects the air outlet effect of the entire mobile air conditioner 100.

The top plate 321 is provided with a water-stop flange 323 with an opening on one side, and the opening of the water-stop flange 323 faces the water diversion groove 322. The condensed water formed at the indoor air outlet 12*c* will adhere to the top plate 321 and accumulate and flow on the top plate 321. The water-stop flange 323 provided on the top plate 321 can restrict the flow direction of the condensed water. The condensed water flows down the second side wall 322*c* of the water diversion groove 322 and enters the water diversion groove 322 to prevent the condensed water from flowing down from the side of the top plate 321 to the indoor heat exchange air duct. The water-stop flange 323 can be provided on the edge of the top plate 321, and the shape of the water-stop flange 323 and the connection position between the water-stop flange 323 and the top plate 321 can also be designed according to specific needs.

The volute cover 32 further includes a first side plate 324 and a second side plate 325 respectively disposed at both ends of the top plate 321. The bottom of the water diversion groove 322 is inclined downward from the second side plate 325 to the first side plate 324. The first side plate 324 is provided with a water diversion notch 326 communicating with the water diversion groove 322. The first side plate 324 and the second side plate 325 can support the cross-flow fan. The bottom of the water diversion groove 322 is inclined downward from the direction of the second side plate 325 to the first side plate 324 for guiding the condensed water to flow in the inclined direction until it is discharged from the water diversion notch 326.

The lower end of the first side plate 324 is provided with a fan installation hole 327 for installing the cross-flow fan. The outer side of the first side plate 324 is further provided with a drainage structure 328, and the drainage structure 328 is used to guide the water flowing out of the water diversion notch 326 away from the fan installation hole 327. The cross-flow fan is rotatably connected to the first side plate 324 through the installation hole, and the cross-flow fan rotates relative to the first side plate 324 to form an air flow. The drainage structure 328 can prevent the condensed water from entering the indoor air duct from the fan installation hole 327. The drainage structure 328 may be two water-stop ribs disposed on the first side plate 324 and located on the upper side of the fan installation hole 327, the two water-stop ribs are arranged oppositely, and the high ends of the two water-stop ribs are connected. In this way, the condensed water flows down along the water-stop rib, and it is ensured that the condensed water flowing out from the water diversion notch 326 will not flow to the fan installation hole 327 and the axial flow fan. The drainage structure 328 may also be a water-stop rib disposed on the first side plate 324 and connected to the first side wall 322*a*. The upper edge of the water-stop rib is flush with the upper edge of the first side wall 322*a*, and the lower edge of the water-stop rib is located on the side of the fan installation hole 327 close to the indoor heat exchanger 4. Thereby, the condensed water flowing out from the water diversion notch 326 flows along the extending direction of the water-stop rib to ensure that the condensed water flowing out from the water diversion notch 326 will not flow to the fan installation hole 327 and the axial flow fan.

As shown in FIG. 16, FIG. 20, FIG. 23 and FIG. 24, the mobile air conditioner 100 further includes a middle baffle 5 provided in the housing 10 and an indoor heat exchanger 4. The volute assembly 3 and the indoor heat exchanger 4 are both provided on the middle baffle 5. The indoor heat exchanger 4 is provided on the middle baffle 5 of the volute assembly 3 at the air inlet, and is provided with a water storage groove 6 and a drainage groove 7 communicating with the water storage groove 6. The drainage groove 7 is provided below the volute assembly 3, and is arranged corresponding to the outdoor heat exchanger of the mobile air conditioner 100. The bottom of the water storage groove 6 is inclined in the direction of the drainage groove 7, and the indoor heat exchanger 4 is installed in the water storage groove 6. When the mobile air conditioner 100 blows out, the condensed water can flow into the drainage groove 7 through the water storage groove 6, and then the condensed water can flow into the outdoor heat exchanger through the drainage groove 7. By inclining the bottom of the water storage groove 6 toward the drainage groove 7, when the condensed water flows in the water storage groove 6, not only can the condensed water be better guided to the drainage groove 7, but also the flow rate of the condensed water in the water storage groove 6 can be increased, so as to improve the discharge rate of the condensed water. Therefore, the discharge effect of the condensed water in the mobile air conditioner 100 is improved, and the condensed water can be effectively prevented from accumulating in the water storage groove 6.

The indoor heat exchanger 4 may be inclined in a direction close to the volute assembly 3. The inclined arrangement of the indoor heat exchanger 4 is convenient to cooperate with the bottom of the water storage groove 6, and the heat exchange area can be increased.

The embodiment of the present disclosure also provides a housing 10. It can be understood that the housing 10 can be applied to a mobile air conditioner. The specific structure of the housing 10 will be mainly described below.

As shown in FIG. 25, FIG. 26, FIG. 27, FIG. 28, FIG. 30 and FIG. 31, in an embodiment of the present disclosure, the housing 10 includes a housing body 1 and a reinforcing housing 2. The reinforcing housing 2 is provided in the housing body 1 and is fixedly connected with the inner surface of the housing body 1.

It can be understood that the housing body 1 is roughly in the shape of a quadrangular prism with a quadrangular bottom surface. The housing body 1 can be made of metal, such as stainless steel, aluminum, aluminum alloy, copper, copper alloy, iron, iron alloy, or the like. The housing body 1 can also be made of rigid plastics, such as ABS (acrylonitrile-butadiene-styrene terpolymer), POM (polyoxymethylene), PS (polystyrene), PMMA (polymethyl methacrylate), PC (polycarbonate), PET (polyethylene terephthalate), PBT (polybutylene terephthalate), PPO (polyphenylene ether), or the like. The housing body 1 can also be made of other alloy materials, or a mixture of metal materials and plastics, as long as the stability of the housing body 1 can be better improved. In this way, it is more beneficial to improve the installation stability of the housing body 1, thereby effectively improving the practicability, reliability, and durability of the housing body 1.

In this embodiment, in order to make the appearance of the housing 10 aesthetically appealing and make the overall weight of the housing 10 light, the housing body 1 can be optionally made of plastic material. It can be understood that, in order to further improve the overall structural strength of the housing 10, by arranging a reinforcing housing 2 in the housing body 1, the overall strength of the housing 10 can be improved by using the reinforcing housing 2. Optionally, the reinforcing housing 2 is a sheet metal housing or a rigid plastic housing. In this embodiment, the reinforcing housing 2 can be made of sheet metal material or metal casting.

In technical solutions of the present disclosure, the housing 10 is provided with the reinforcing housing 2. The reinforcing housing 2 is provided in the housing body 1 and is fixedly connected with the inner surface of the housing body 1, so that the reinforcing housing 2 strengthens the housing body 1 to improve the overall strength of the housing 10. In this way, the housing 10 is applied to the mobile air conditioner, thereby improving the structural strength and installation stability of the mobile air conditioner.

Figure 25:
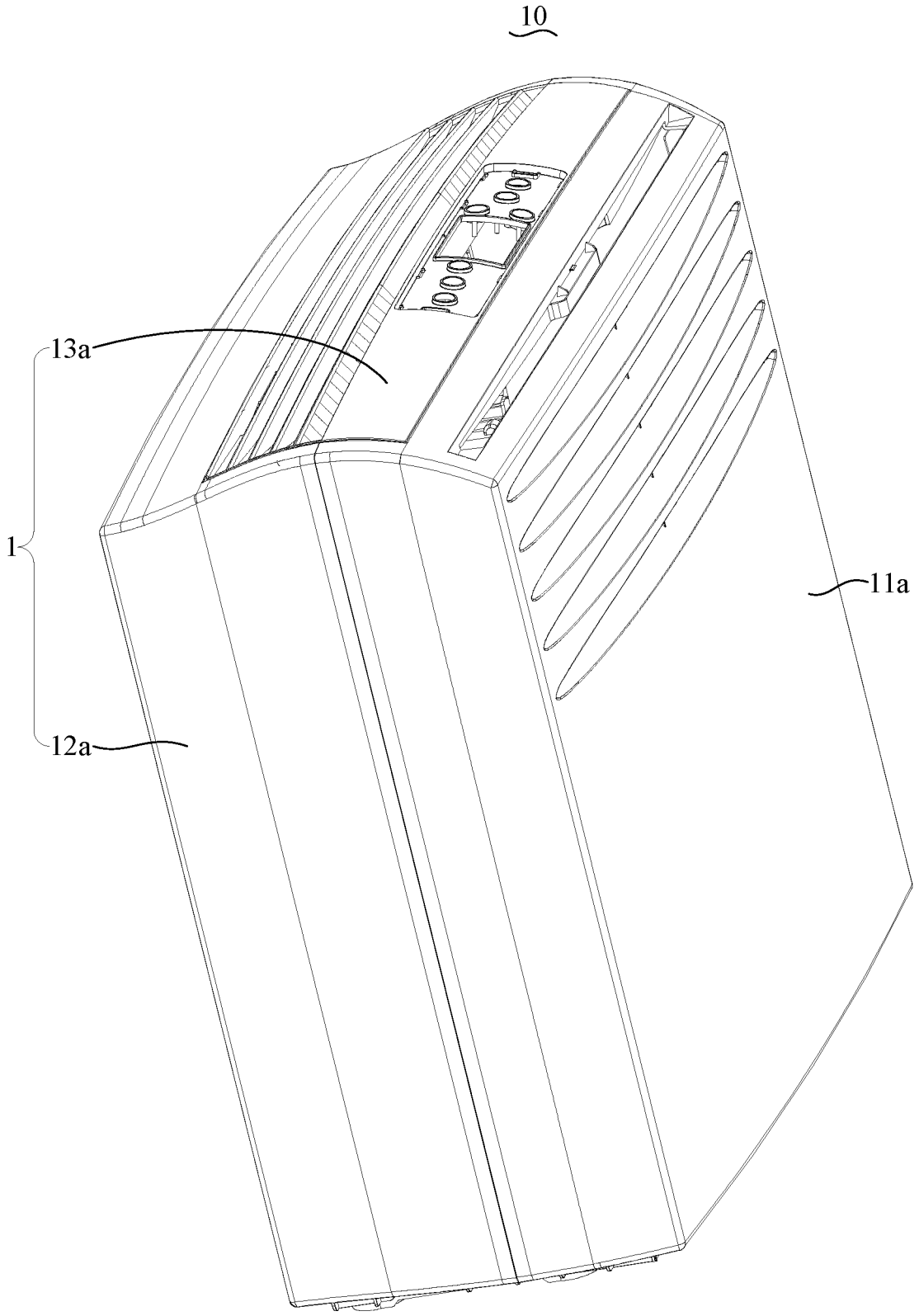
FIG. 25 is a schematic structural view of the housing according to an embodiment of the present disclosure.
Figure 26:
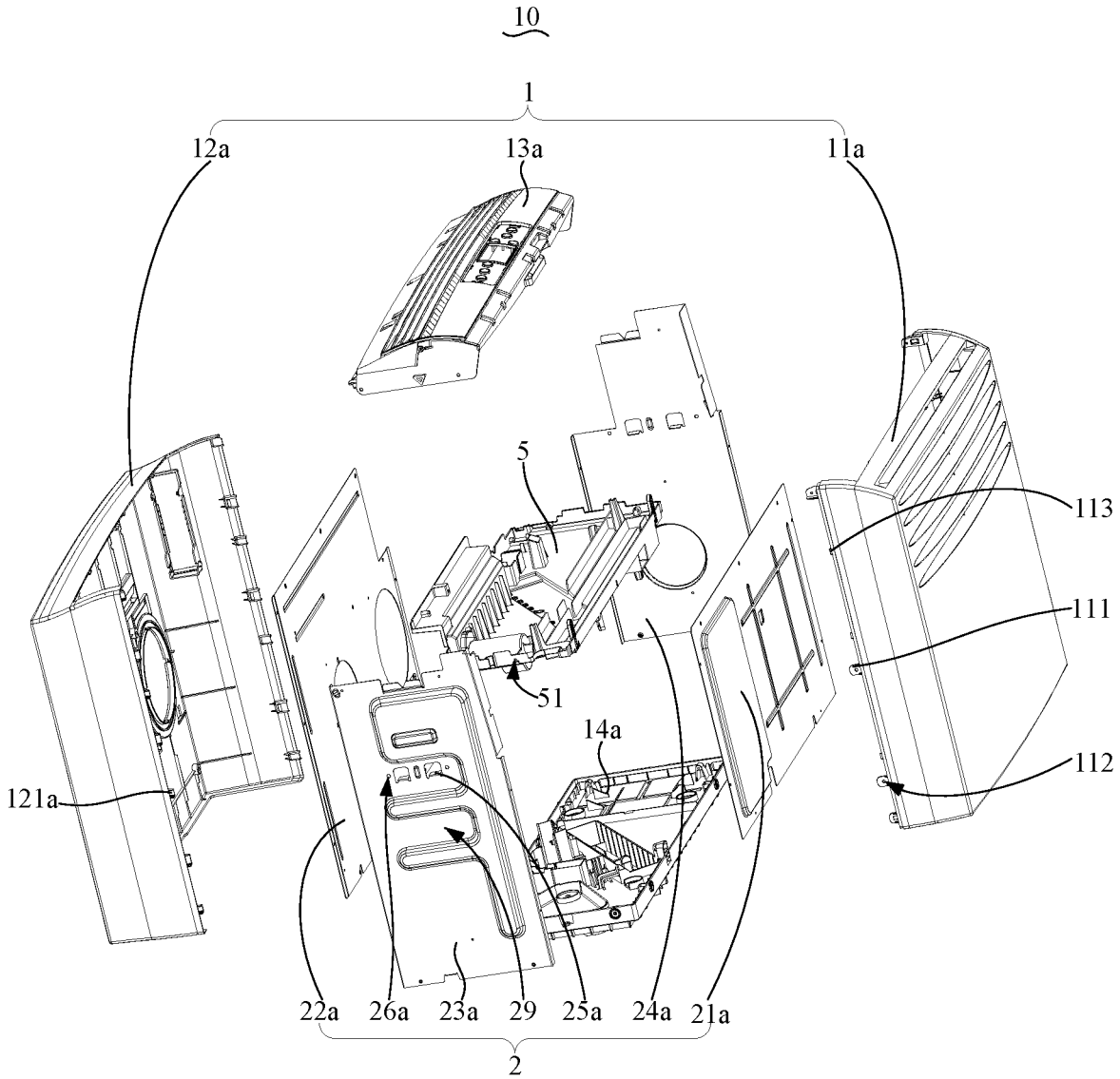
FIG. 26 is an exploded schematic view of the housing according to an embodiment of the present disclosure.
Figure 27:
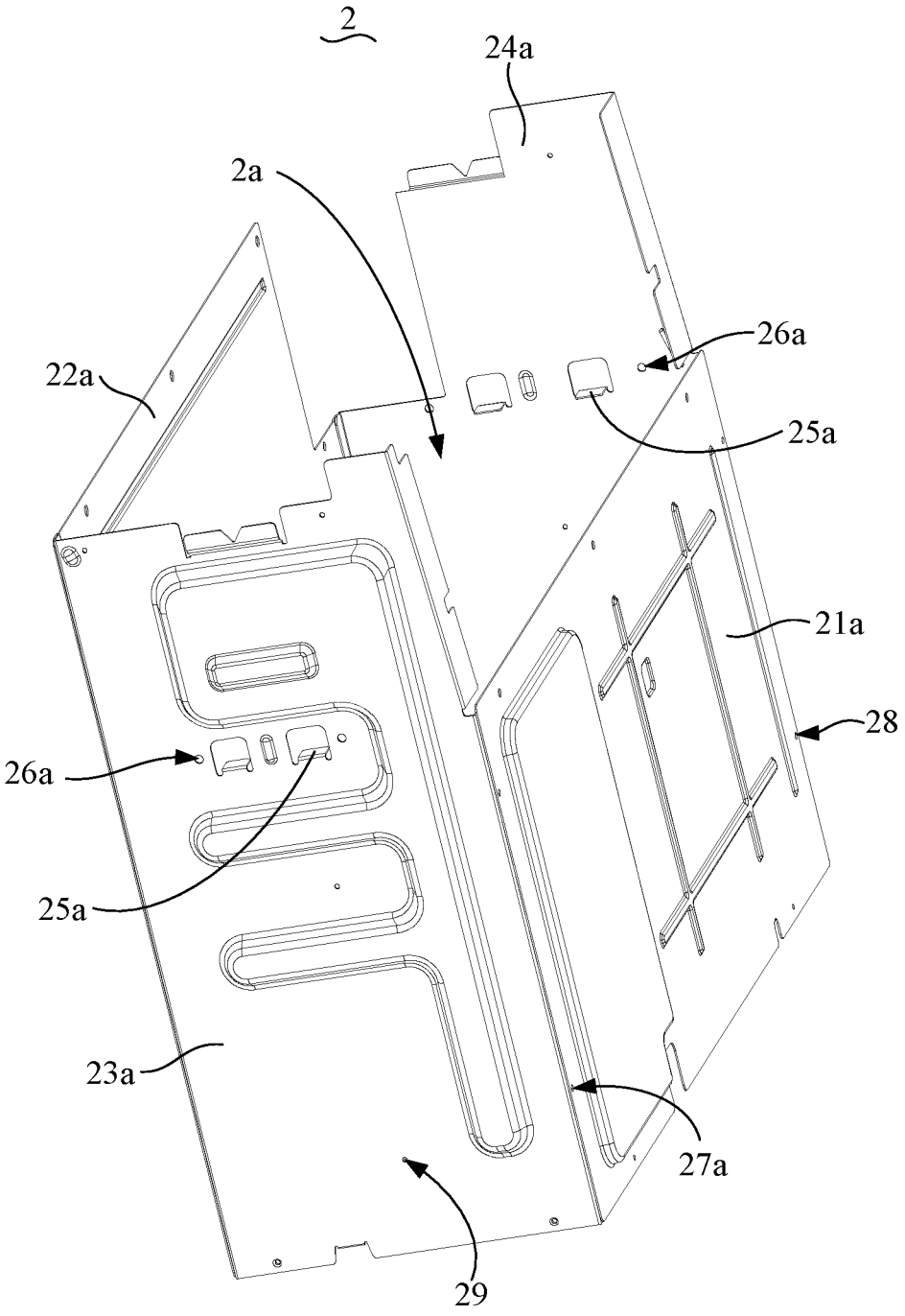
FIG. 27 is a schematic structural view of a reinforcing housing according to an embodiment of the present disclosure.
Figure 31:
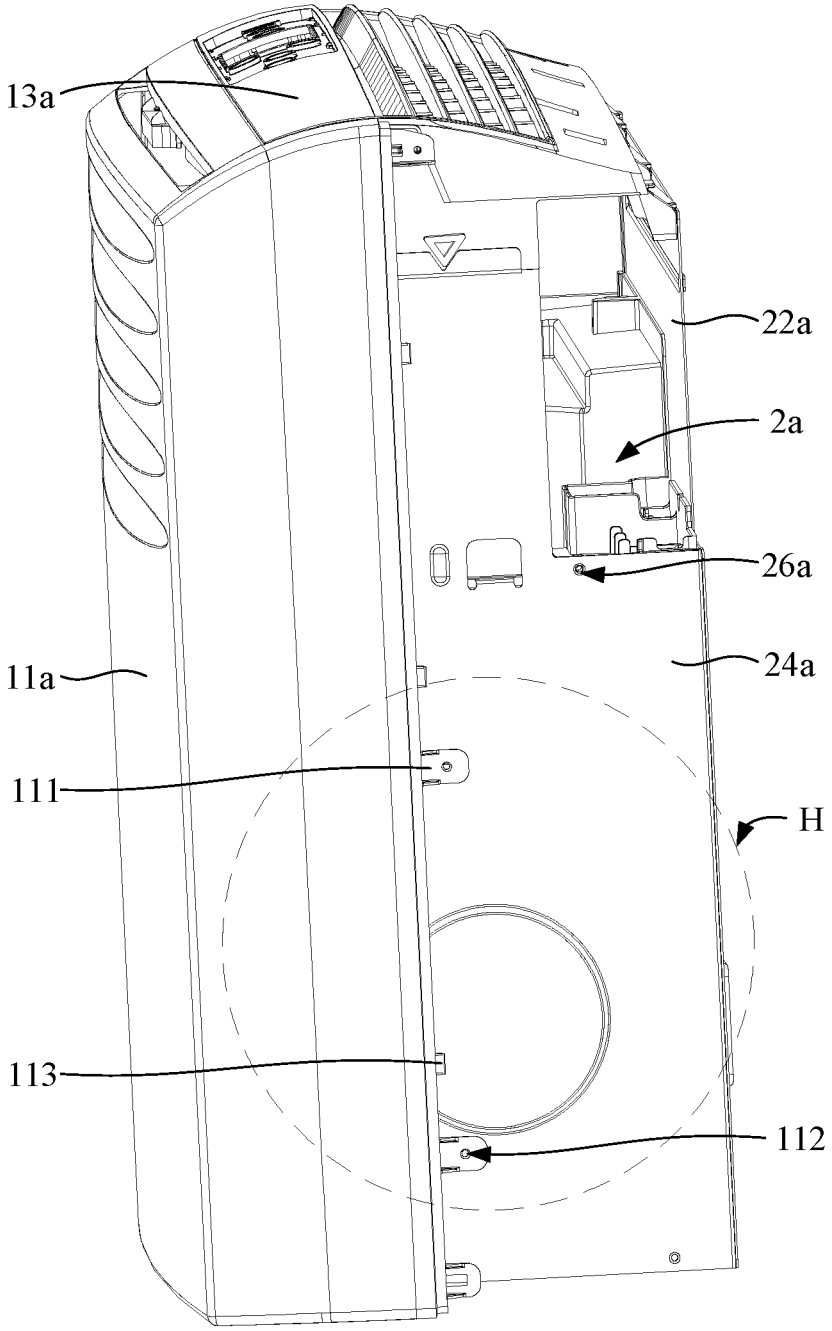
FIG. 31 is a schematic structural view of the housing with a rear housing removed according to an embodiment of the present disclosure.

In an embodiment, as shown in FIG. 25, FIG. 26 and FIG. 31, the housing body 1 includes a front housing 11*a* and a rear housing 12*a* which are detachably connected. It can be understood that the front housing 11*a* and the rear housing 12*a* enclose an installation space, and the reinforcing housing 2 is installed in the installation space. In order to make the reinforcing housing 2 improve the overall strength of the housing 10, the reinforcing housing 2 abuts or connects with the inner wall of the housing body 1, that is, the shape outline of the reinforcing housing 2 is equivalent to the shape outline of the installation space enclosed by the front housing 11*a* and the rear housing 12*a*.

It can be understood that in order to improve the installation convenience of the housing 10, the front housing 11*a* and the rear housing 12*a* are connected in a detachable manner, such as snap connection, plug fit, screw connection or pin connection, or the like, as long as the structure can implement the detachable connection between the front housing 11*a* and the rear housing 12*a*, which is not limited herein.

Figure 32:
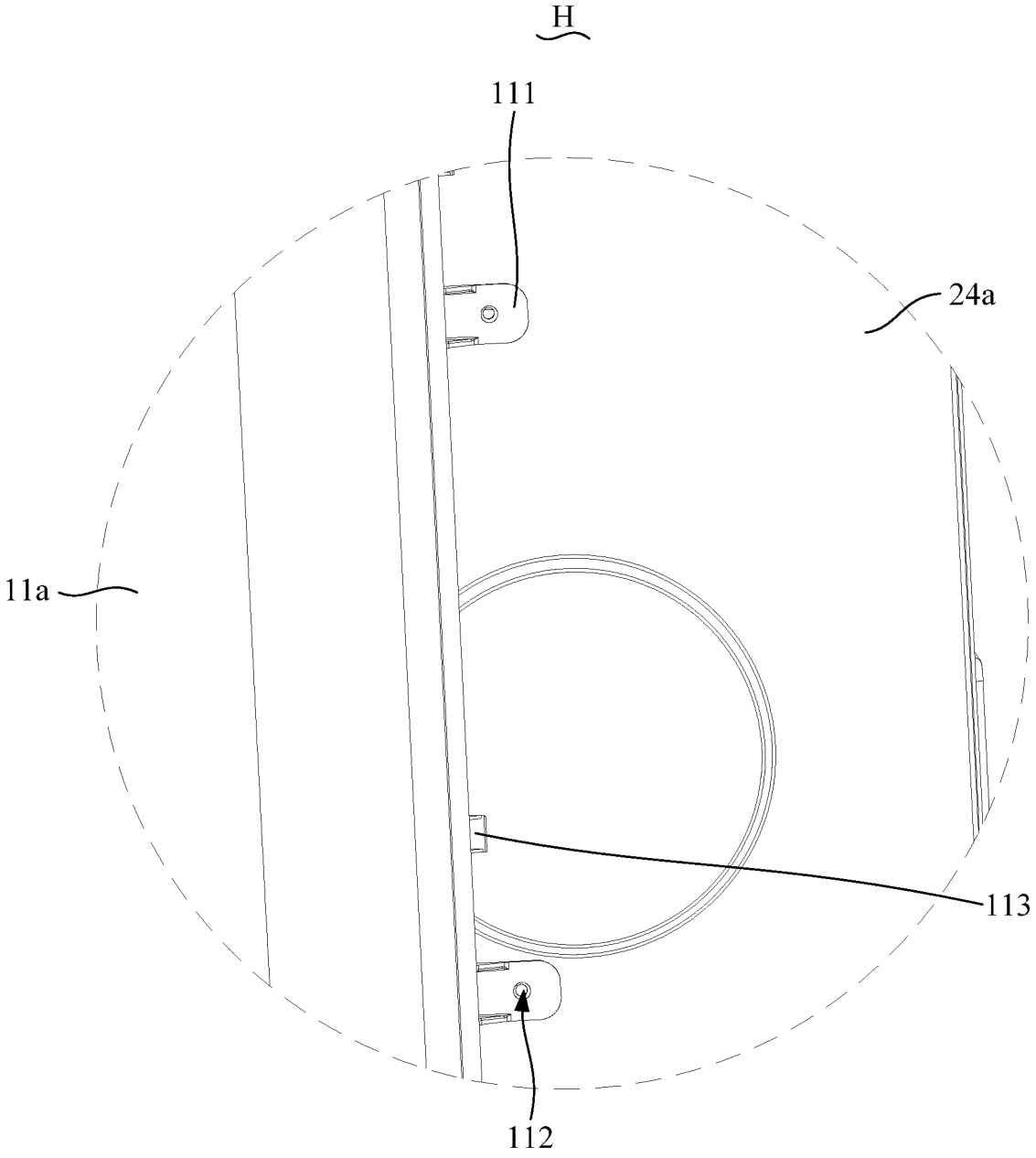
FIG. 32 is an enlarged view of portion H in FIG. 31.

In an embodiment, as shown in FIG. 26, FIG. 31 and FIG. 32, one of the front housing 11*a* and the rear housing 12*a* is provided with a clamping protrusion 113, another of the front housing 11*a* and the rear housing 12*a* is provided with a clamping slot 121*a*, and the front housing 11*a* is detachably connected to the rear housing 12*a* through the cooperation of the clamping protrusion 113 and the clamping slot 121*a*.

It can be understood that the front housing 11*a* is provided with the clamping protrusion 113, the rear housing 12*a* is provided with the clamping slot 121*a*, and the front housing 11*a* is detachably connected to the rear housing 12*a* through the cooperation of the clamping protrusion 113 and the clamping slot 121*a*. In other embodiments, the front housing 11*a* can also be provided with the clamping slot 121*a*, and the rear housing 12*a* is provided with the clamping protrusion 113.

The housing 10 is a housing of the mobile air conditioner, the front housing 11*a* is located at the front of the mobile air conditioner, and the rear housing 12*a* is located at the rear of the mobile air conditioner. In this embodiment, in order to enable the front housing 11*a* and the rear housing 12*a* to be connected to each other and enclose an installation space, the front housing 11*a* includes a front panel and front side plates on both sides of the front panel, the two front side plates are formed by bending two sides of the front panel, that is, the front panel and the two front side plates are integrally formed. Optionally, the front housing 11*a* is U-shaped. Correspondingly, the rear housing 12*a* includes a rear panel and rear side panels on both sides of the rear panel. The two rear side panels are formed by bending two sides of the rear panel, that is, the rear panel and the two rear side panels are integrally formed. Optionally, the rear housing 12*a* is U-shaped.

In this embodiment, the sides of the two front side plates of the front housing 11*a* away from the front panel are provided with a plurality of spaced-apart clamping protrusions 113 and the sides of the two rear side panels of the rear housing 12*a* away from the rear panel are provided with a plurality of spaced-apart clamping slots 121*a*. In this way, when the front housing 11*a* and the rear housing 12*a* are connected, each clamping protrusion 113 is snap-fitted or plug-fitted with each clamping slot 121*a*.

In an embodiment, the reinforcing housing 2 can also be integrally formed on the inner wall of the housing body 1. That is, the reinforcing housing 2 also includes two parts, and the front housing 11*a* and the rear housing 12*a* of the housing body 1 both correspond to a part of the reinforcing housing 2. Optionally, the front housing 11*a*, the rear housing 12*a* and the reinforcing housing 2 can be made by using interference fit, heat fusion and integral molding processes.

In order to further improve the use convenience of the housing 10, the reinforcing housing 2 is detachably connected to the front housing 11*a* and/or the rear housing 12*a*, that is, the front housing 11*a* and/or the rear housing 12*a* and the reinforcing housing 2 are connected by a split structure, for example, a snap connection, a plug fit, a screw connection or a pin connection, or the like, as long as the structure can implement the detachable connection between the front housing 11*a* and/or the rear housing 12*a* and the reinforcing housing 2, which is not limited herein.

In an embodiment, as shown in FIG. 26, FIG. 27, FIG. 28, FIG. 29, FIG. 30 and FIG. 32, the side edges of the front housing 11*a* or the rear housing 12*a* are provided protrudingly with a plurality of spaced-apart lugs 111. Each lug 111 defines a first via hole 112. The reinforcing housing 2 is provided with a first connection hole 29 corresponding to each of the first via holes 112. The reinforcing housing 2 is connected to the front housing 11*a* or the rear housing 12*a* through the first through hole 112 and the first connection hole 29 in sequence through fasteners.

It can be understood that a lug 111 is protruded from the side of the front housing 11*a* or the rear housing 12*a*, and the lug 111 defined the first through hole 112. After the housing 10 is assembled, the front housing 11*a* or the rear housing 12*a* can be used to hide the lug 111, the first through hole 112 and the fastener, which effectively ensures the overall appearance of the housing body 1.

In this embodiment, the sides of the two front side plates of the front housing 11*a* away from the front panel are provided protrudingly with a plurality of spaced-apart lugs 111, each lug 111 defines a first via hole 112, and the reinforcing housing 2 defines a first connection hole 29 corresponding to each first via hole 112. In this way, the fasteners can be passed through the first through hole 112 and the first connection hole 29 in sequence, so that the lugs 111 of the front housing 11*a* can be connected to the reinforcing housing 2. In other embodiments, the lugs 111 may also be disposed on the sides of the two rear side panels of the rear housing 12*a* away from the rear panel, which is not limited herein.

In an embodiment, as shown in FIG. 26, FIG. 27, FIG. 28 and FIG. 29, the reinforcing housing 2 includes a front plate 21*a*, a rear plate 22*a*, a left plate 23*a* and a right plate 24*a*. The front plate 21*a*, the rear plate 22*a*, the left plate 23*a* and the right plate 24*a* are fixedly connected to the inner surface of the housing body 1.

It can be understood that the front plate 21*a* of the reinforcing housing 2 is disposed opposite to the front plate of the front housing 11*a*, and the rear plate 22*a* is disposed opposite to the rear plate of the rear housing 12*a*. The left plate 23*a* and the right plate 24*a* are respectively disposed to face the two front side plates of the front housing 11*a* and the two rear side panels of the rear housing 12*a*. In this embodiment, the two front side plates of the front housing 11*a* are connected to the left plate 23*a* and the right plate 24*a* of the reinforcing housing 2 through the lugs 111. That is, the left plate 23*a* and the right plate 24*a* respectively define the first connection holes 29 corresponding to the lugs 111 of the two front side plates of the front housing 11*a*.

In other embodiments, the front plate 21*a*, the rear plate 22*a*, the left plate 23*a* and the right plate 24*a* can also be integral structural parts, so that the integral structural parts fixed on the housing body 1 are simpler and easier to fix than the discrete structural parts.

In an embodiment, as shown in FIG. 26, FIG. 27, FIG. 28 and FIG. 29, a first folded edge 231*a* is formed on the side of the left plate 23*a* adjacent to the front plate 21*a* and/or the rear plate 22*a*, and the first folded edge 231*a* is provided with a first through hole 232*a*. The front plate 21*a* and/or the rear plate 22*a* are provided with first fixing holes 27*a* corresponding to the first through hole 232*a*, the front plate 21*a* and/or the rear plate 22*a* are connected to the first folded edge 231*a* through the first fixing hole 27*a* and the first through hole 232*a* in sequence through fasteners.

It can be understood that the two sides of the left plate 23*a* are bent to form a first folded edge 231*a*. The front plate 21*a* and the rear plate 22*a* are in contact with the first folded edges 231*a* on both sides of the left plate 23*a*, respectively, and pass through the first fixing hole 27*a* and the first through hole 232*a* in sequence through fasteners, thereby achieving the fixed connection of the left plate 23*a* to the front plate 21*a* and the rear plate 22*a*. In other embodiments, the side edges of the front plate 21*a* and/or the rear plate 22*a* may also be bent to form the first folded edge 231*a*, which is not limited herein.

In an embodiment, as shown in FIG. 26, FIG. 27, FIG. 28 and FIG. 29, a second folded edge 241*a* is formed on the side of the right plate 24*a* adjacent to the front plate 21*a* and/or the rear plate 22*a*, and the second folded edge 241*a* is provided with a second through hole 242*a*. The front plate 21*a* and/or the rear plate 22*a* are provided with second fixing holes 28 corresponding to the second through holes 242*a*, the front plate 21*a* and/or the rear plate 22*a* are connected to the second folded edge 241*a* through the second fixing hole 28 and the second through hole 242*a* in sequence through fasteners.

It can be understood that the two sides of the right plate 24*a* are bent to form a second folded edge 241*a*. The front plate 21*a* and the rear plate 22*a* are in contact with the second folded edges 241*a* on both sides of the right plate 24*a*, respectively, and pass through the second fixing hole 28 and the second through hole 242*a* in sequence through fasteners, thereby achieving the fixed connection of the right plate 24*a* to the front plate 21*a* and the rear plate 22*a*. In other embodiments, the side edges of the front plate 21*a* and/or the rear plate 22*a* may also be bent to form the second folded edge 241*a*, which is not limited herein.

Figure 28:
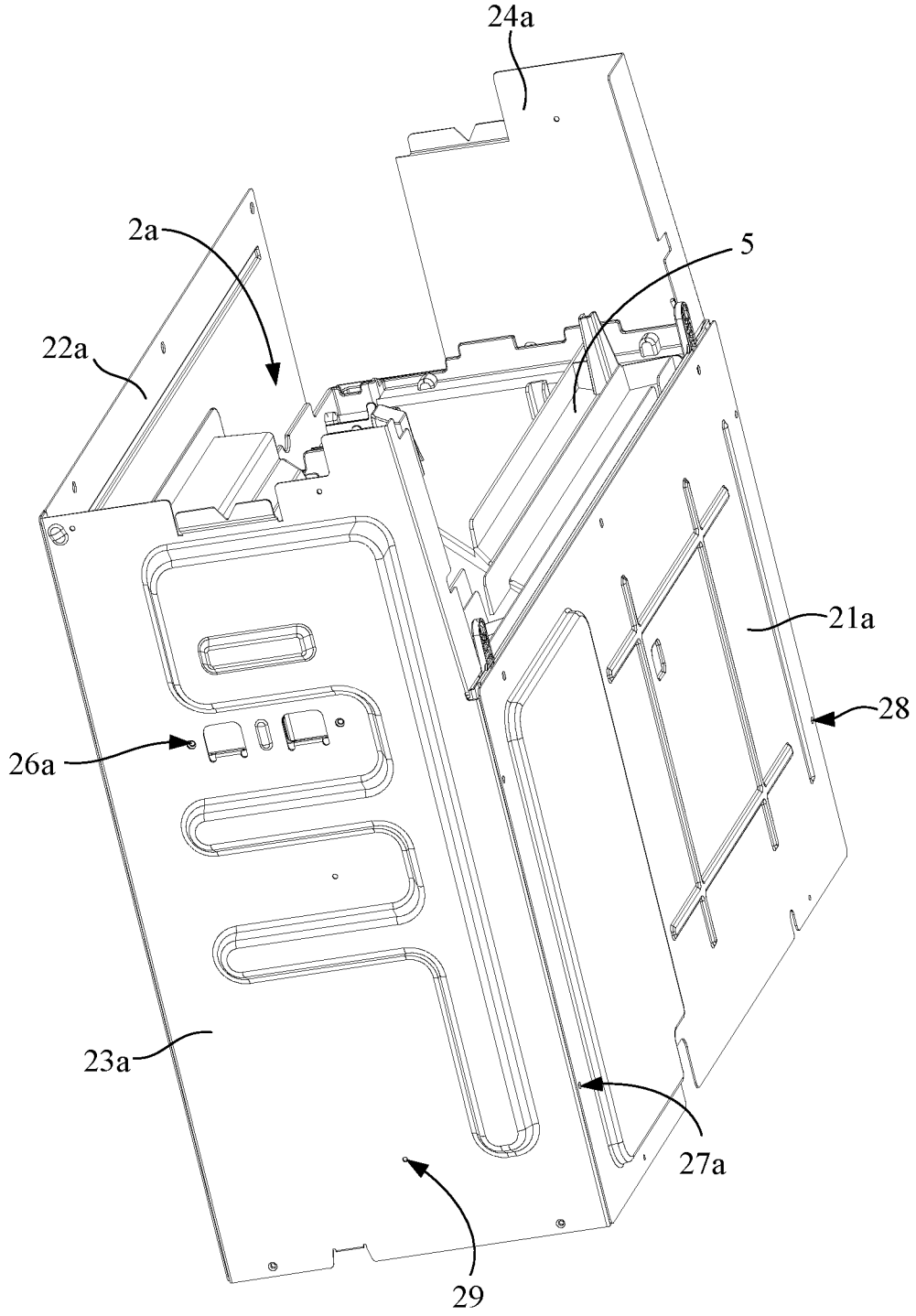
FIG. 28 is a schematic structural view of the installation of the reinforcing housing and the middle partition according to an embodiment of the present disclosure.
Figure 29:
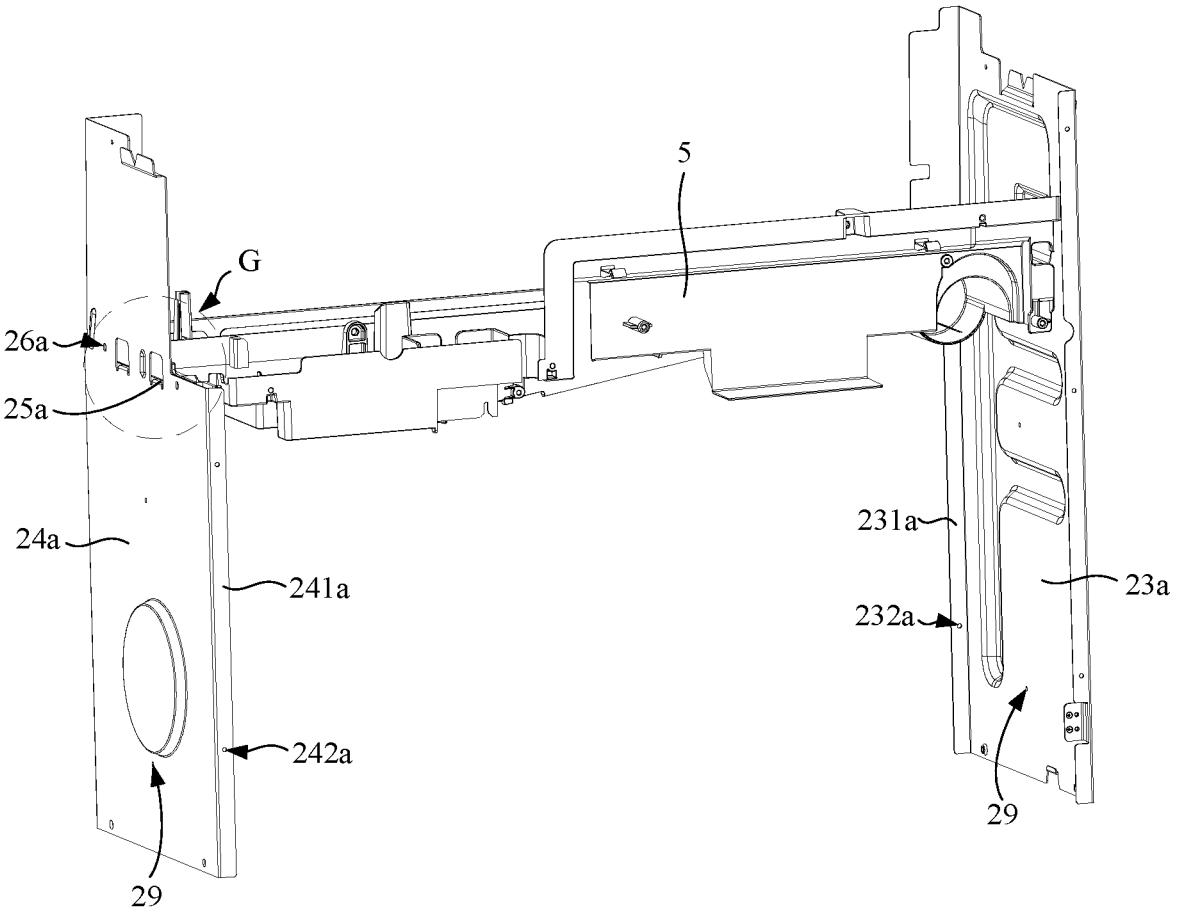
FIG. 29 is a partial schematic structural view of the installation of the reinforcing housing and the middle partition according to an embodiment of the present disclosure.
Figure 30:
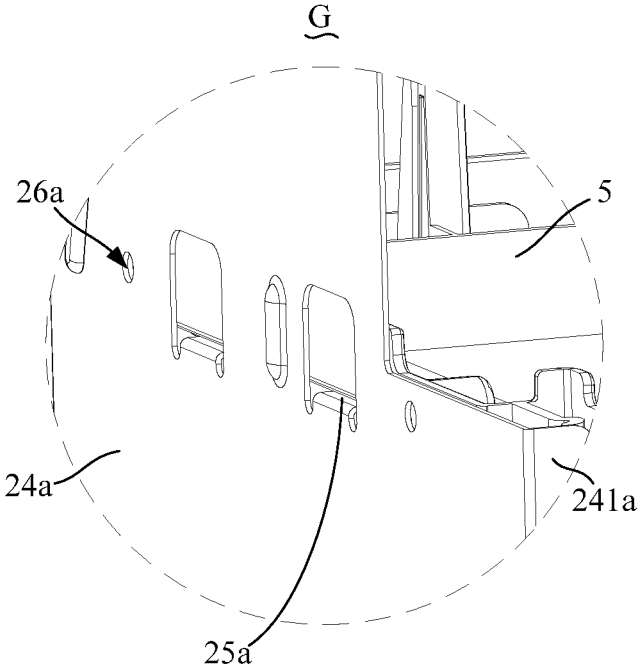
FIG. 30 is an enlarged view of portion G in FIG. 29.

In an embodiment, as shown in FIG. 26, FIG. 28 and FIG. 29, the housing 10 further includes a middle baffle 5, the reinforcing housing 2 is formed with an accommodating cavity 2*a*, and the middle baffle 5 is provided in the accommodating cavity 2*a* to separate the accommodating cavity 2*a*.

As shown in FIG. 26, FIG. 27, FIG. 28 and FIG. 29, in this embodiment, the front plate 21*a*, the rear plate 22*a*, the left plate 23*a* and the right plate 24*a* of the reinforcing housing 2 are enclosed to form an accommodating cavity 2*a*, and the middle baffle 5 is provided in the accommodating cavity 2*a*. It can be understood that the periphery of the middle baffle 5 is connected with the front plate 21*a*, the rear plate 22*a*, the left plate 23*a* and the right plate 24*a*, such that the middle baffle 5 divides the accommodating cavity 2*a* into upper and lower installation spaces for installing other components of the mobile air conditioner. By connecting the middle baffle 5 with the reinforcing housing 2, the reinforcing housing 2 is used to implement the stable installation of the middle baffle 5, thereby improving the installation stability of the middle baffle 5.

In an embodiment, as shown in FIG. 26, FIG. 27, FIG. 28, FIG. 29 and FIG. 30, a support member 25*a* is provided on the side of the reinforcing housing 2 facing the middle baffle 5, and the middle baffle 5 is in limited contact with the support member 25*a*.

It can be understood that when the reinforcing housing 2 is an integral structural member, the surface of the reinforcing housing 2 facing the middle baffle 5 is provided with a support member 25*a*, that is, the support member 25*a* is a support plate, a support sheet or a support strip. In order to ensure the installation stability of the middle baffle 5, the support member 25*a* can be arranged around the middle baffle 5, that is, the periphery of one surface of the middle baffle 5 is in limited contact with the support member 25*a*. The support members 25*a* may also be provided only on the surfaces of opposite sides of the reinforcing housing 2. For example, the support member 25*a* is provided on the front plate 21*a* and the rear plate 22*a* of the reinforcing housing 2, or on the left plate 23*a* and the right plate 24*a* of the reinforcing housing 2, which are not limited herein.

In an embodiment, as shown in FIG. 26, FIG. 27, FIG. 28, FIG. 29 and FIG. 30, the side of the reinforcing housing 2 facing the middle baffle 5 is provided with a plurality of support members 25*a* arranged at intervals, and the middle baffle 5 is in limited contact with the plurality of support members 25*a*. It can be understood that this arrangement is beneficial to saving materials and reducing costs.

In this embodiment, the surfaces of the left plate 23*a* and the right plate 24*a* of the reinforcing housing 2 facing the side of the middle baffle 5 are provided with a plurality of support members 25*a* arranged at intervals. The plurality of support members 25*a* are arranged in a linear manner, so as to ensure the stability of the middle baffle 5 after installation.

It can be understood that the support member 25*a* may also be formed by bending a part of the left plate 23*a* or the right plate 24*a*. That is, a gap is formed at the left plate 23*a* or the right plate 24*a* corresponding to the support member 25*a*, and one end of the support member 25*a* is integrally connected with the inner wall of the gap, so that the size of the gap is equivalent to that of the support member 25*a*.

In order to further improve the connection stability of the middle baffle 5 and the reinforcing housing 2, as shown in FIG. 26, FIG. 27, FIG. 28, FIG. 29 and FIG. 30, in an embodiment, a plurality of second via holes 26*a* are defined in the reinforcing housing 2 adjacent to the support member 25*a*, and the middle baffle 5 is provided with a second connection hole 51 corresponding to each second via hole 26*a*. The middle baffle 5 is connected to the reinforcing housing 2 through the second through hole 26*a* and the second connection hole 51 in sequence through fasteners.

In this embodiment, the left plate 23*a* and the right plate 24*a* of the reinforcing housing 2 are provided with support members 25*a*. The left plate 23*a* and the right plate 24*a* of the reinforcing housing 2 have a plurality of second via holes 26*a* adjacent to the support member 25*a*. A second connection hole 51 is formed on the periphery of the middle baffle 5 corresponding to each second via hole 26*a*. The middle baffle 5 is connected to the left plate 23*a* and the right plate 24*a* of the reinforcing housing 2 through the second through hole 26*a* and the second connection hole 51 in sequence through fasteners, thereby further improving the installation stability of the middle baffle 5.

In an embodiment, as shown in FIG. 25, FIG. 26 and FIG. 31, the housing body 1 further includes a top plate 13*a* located on top of the front housing 11*a* and the rear housing 12*a*. It can be understood that the top plate 13*a* and the front housing 11*a* and the rear housing 12*a* are detachably connected, such as snap connection, plug fit, screw connection or pin connection, etc., which are not limited herein. In this embodiment, the top plate 13*a* is further provided with an air outlet, which can be used for air intake or air outlet.

In order not to affect the air inlet or outlet of the air vent of the top plate 13*a*, the reinforcing housing 2 forms a hollow area for the air vent of the top plate 13*a*, that is, the reinforcing housing 2 is not provided. In other embodiments, the top plate 13*a* may not be provided with air vents, but the air vents may be provided on the front housing 11*a*, so that the top plate 13*a* can be provided with a reinforcing housing 2, which can be selectively provided according to specific conditions.

In an embodiment, as shown in FIG. 26, the housing body 1 further includes a chassis 14*a* located at the bottoms of the front housing 11*a* and the rear housing 12*a*. It can be understood that the chassis 14*a* is detachably connected with the front housing 11*a* and the rear housing 12*a*, such as snap connection, plug fit, screw connection or pin connection, which is not limited herein.

In this embodiment, the chassis 14*a* is provided with a limiting groove, and the bottom of the reinforcing housing 2 is limited in the limiting groove, so that the limit installation of the reinforcing housing 2 and the chassis 14*a* can be implemented, thereby improving the overall stability of the housing 10.

It can be understood that the housing 10 is applied to a mobile air conditioner. In order to facilitate the movement of the mobile air conditioner, the chassis 14*a* is provided with rollers.

The embodiment of the present disclosure also provides a housing 10. It can be understood that the housing 10 can be applied to a mobile air conditioner. The specific structure of the housing 10 will be mainly described below.

As shown in FIG. 33, FIG. 34, FIG. 36 and FIG. 38, in an embodiment of the present disclosure, the housing 10 includes a front housing 11*a* and a top plate 13*a*, the front housing 11*a* is provided with a first positioning member and a first locking member, and the top plate 13*a* is provided with a second positioning member and a second locking member. The top plate 13*a* is connected to the front housing 11*a* through the cooperation of the first positioning member and the second positioning member, and is fixedly connected by the first locking member and the second locking member, so that the top plate 13*a* is fixedly connected to the front housing 11*a*.

It can be understood that the housing 10 is substantially a quadrangular prism with a quadrangular bottom. The housing 10 can be made of metal, such as stainless steel, aluminum, aluminum alloy, copper, copper alloy, iron, iron alloy, or the like. The housing 10 can also be made of rigid plastics, such as ABS, POM, PS, PMMA, PC, PET, PBT, PPO, or the like. The housing 10 can also be made of other alloy materials, or a mixture of metal materials and plastics, as long as the stability of the housing 10 can be better improved. In this way, it is more beneficial to improve the installation stability of the housing 10, thereby effectively improving the practicability, reliability, and durability of the housing 10.

In this embodiment, in order to make the appearance of the housing 10 aesthetically appealing and the overall weight of the housing light, the housing 10 can be optionally made of plastic material. In order to further improve the overall structural strength of the housing 10, a reinforcing structure or a reinforcing housing can be provided in the housing 10, and the overall strength of the housing 10 can be improved by using the reinforcing structure or the reinforcing housing. Optionally, the reinforcing structure or the reinforcing housing may be made of sheet metal material or metal casting, which is not limited herein.

Figure 33:
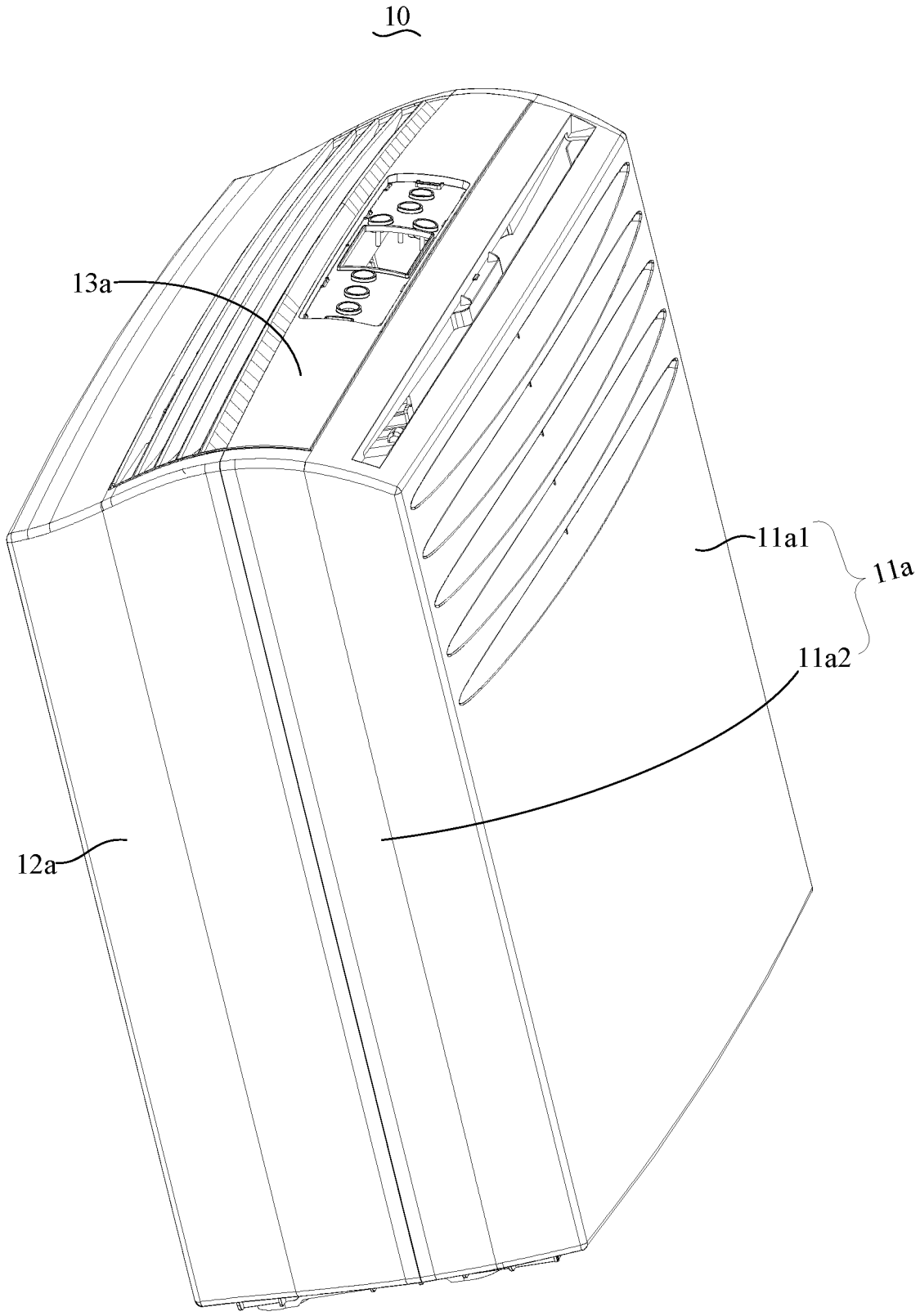
FIG. 33 is a schematic structural view of the housing according to another embodiment of the present disclosure.

As shown in FIG. 33, the housing 10 includes a front housing 11*a*, a rear housing 12*a*, and a top plate 13*a* on top of the front housing 11*a* and the rear housing 12*a*. In order to avoid problems such as skewing and loosening and uneven clearance when the front housing 11*a* and the top plate 13*a* are installed during the installation of the housing 10. In this embodiment, by disposing the first positioning member on the front housing 11*a* and the second positioning member on the top plate 13*a*, the front housing 11*a* and the top plate 13*a* are pre-fixed by the positioning and cooperation of the first positioning member and the second positioning member, thereby effectively avoiding the problem of skewing and loosening of the housing 10 and uneven gaps during the installation process. At the same time, by disposing the first locking member on the front housing 11*a* and the second locking member on the top plate 13*a*, the front housing 11*a* and the top plate 13*a* are fixedly installed by using the fixed connection of the first locking member and the second locking member, thereby improving the installation stability of the front housing 11*a* and the top plate 13*a*.

During the installation process of the housing 10, in order to avoid problems such as skewing and loosening and uneven clearance when the rear housing 12*a* and the top plate 13*a* are installed, in this embodiment, the rear housing 12*a* is provided with a third positioning member and a third locking member, and the top plate 13*a* is provided with a fourth positioning member and a fourth locking member, the top plate 13*a* is connected to the rear housing 12*a* through the positioning cooperation of the third positioning member and the fourth positioning member, and is fixedly connected by the third locking member and the fourth locking member, so that the top plate 13*a* is fixedly connected to the rear housing 12*a*.

It can be understood that a third positioning member and a fourth positioning member are respectively provided on the rear housing 12*a* and the top plate 13*a*, such that the rear housing 12*a* and the top plate 13*a* are pre-fixed by the positioning cooperation of the third positioning member and the fourth positioning member, thereby effectively preventing the housing 10 from being skewed and loosened during the installation process and the problem of uneven gaps. At the same time, a third locking member and a fourth locking member are respectively provided on the rear housing 12*a* and the top plate 13*a*, such that the rear housing 12*a* and the top plate 13*a* are fixedly installed by using the fixed connection of the first locking member and the second locking member, thereby improving the installation stability of the rear housing 12*a* and the top plate 13*a*.

Figure 34:
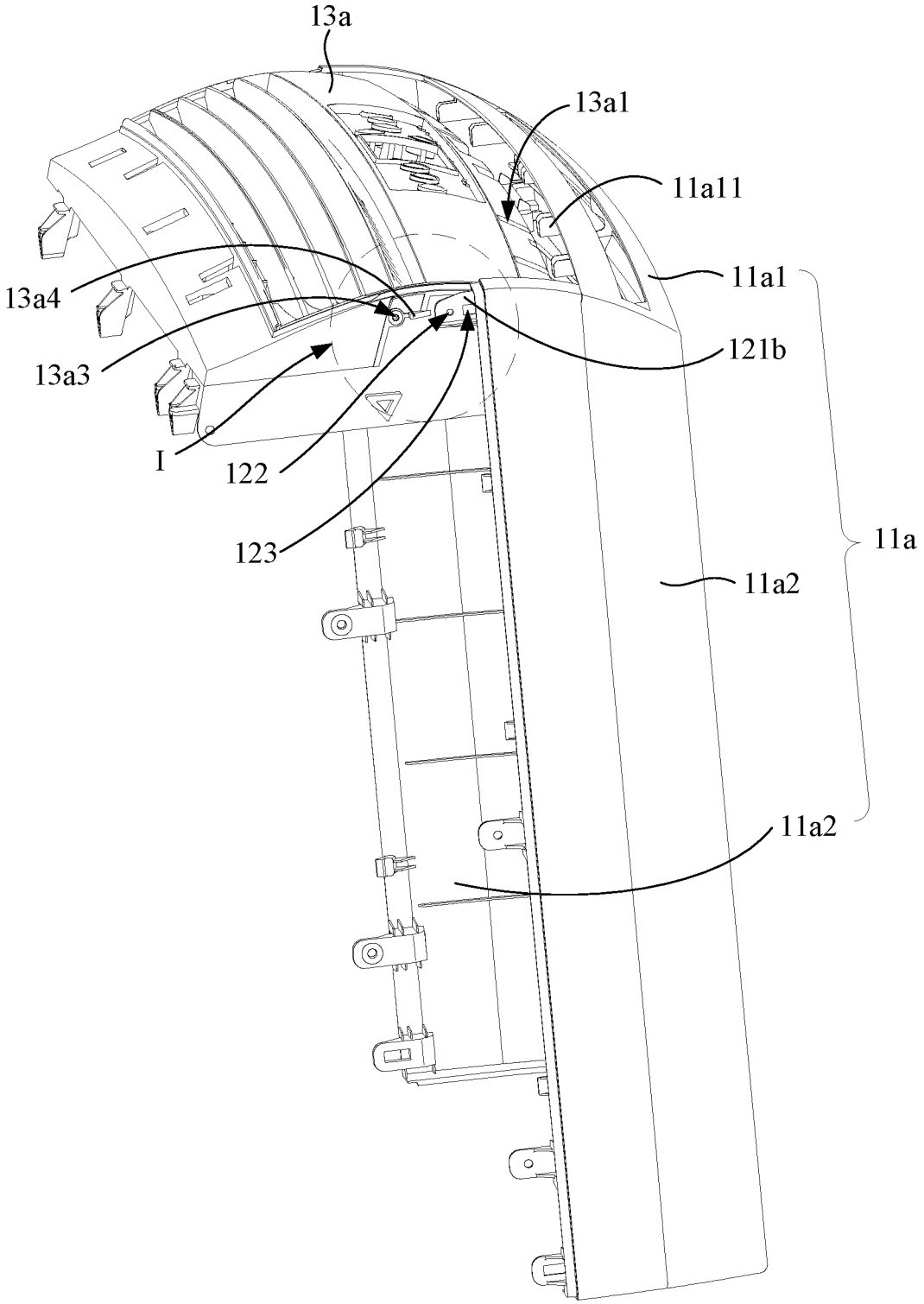
FIG. 34 is a schematic structural view of the housing with a front housing and a top plate removed according to another embodiment of the present disclosure.
Figure 38:
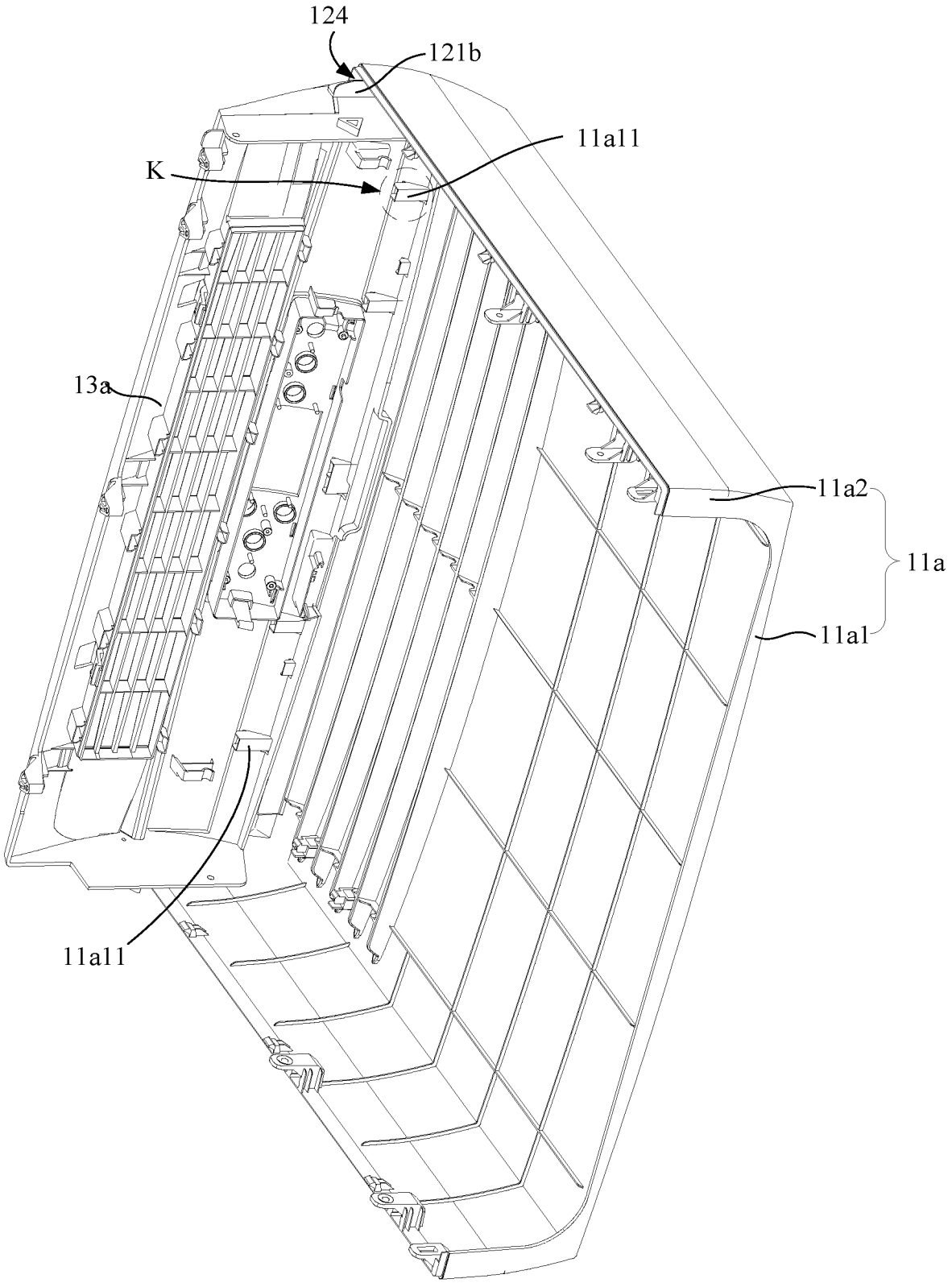
FIG. 38 is a schematic structural view of the housing with the front housing and the top plate assembled from another perspective according to another embodiment of the present disclosure.
Figure 39:
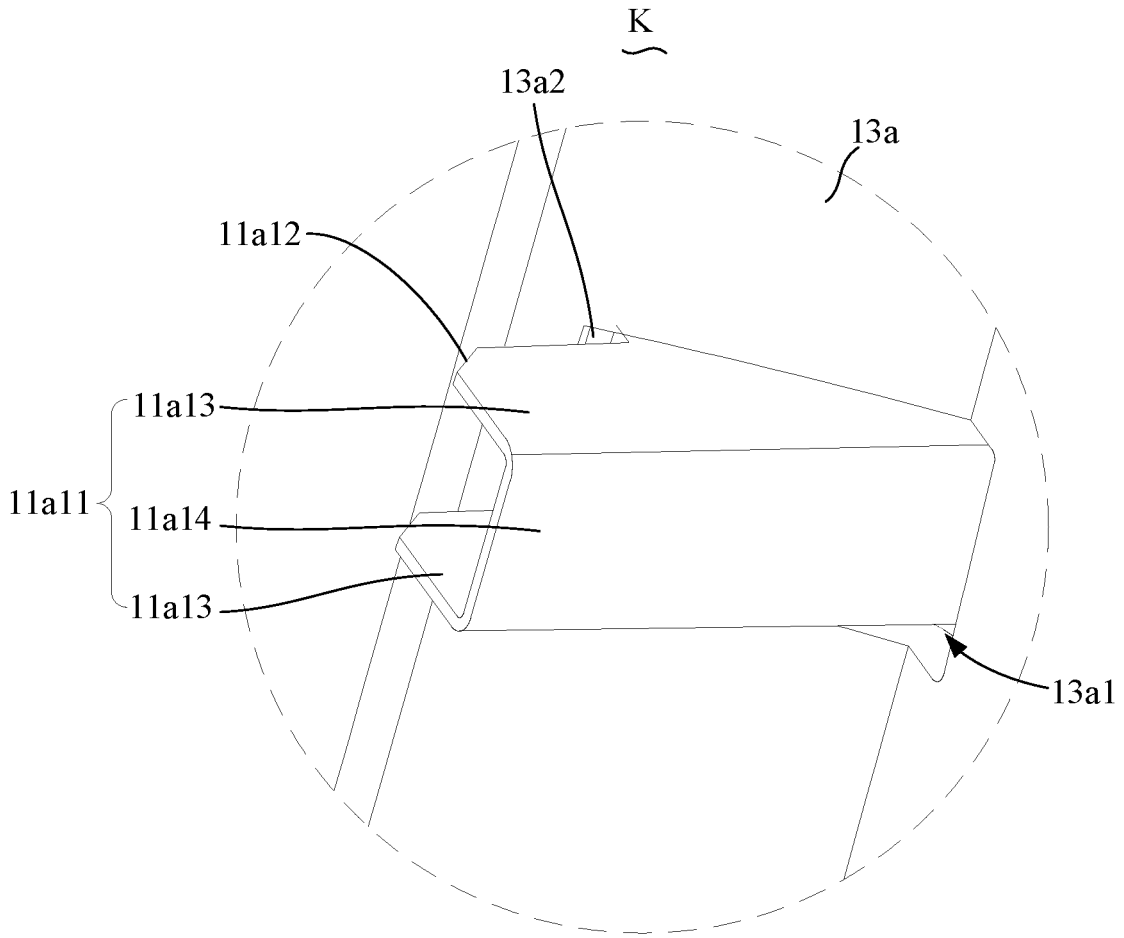
FIG. 39 is an enlarged view of portion K in FIG. 38.

In an embodiment, as shown in FIG. 34, FIG. 38 and FIG. 39, one of the first positioning member and the second positioning member is provided with a buckle 11*a*11, the other of the first positioning member and the second positioning member is provided with an insertion hole 13*a*1, and the top plate 13*a* is connected to the front housing 11*a* through the plug-in fitting of the buckle 11*a*11 and the insertion hole 13*a*1.

It can be understood that one of the third positioning member and the fourth positioning member is provided with the buckle 11*a*11, the other one of the third positioning member and the fourth positioning member is provided with an insertion hole 13*a*1, and the top plate 13*a* is connected to the rear housing 12*a* through the plug-fit of the buckle 11*a*11 and the insertion hole 13*a*1.

In this embodiment, one of the front housing 11*a* and the top plate 13*a* is provided with a buckle 11*a*11, and the other of the front housing 11*a* and the top plate 13*a* is provided with an insertion hole 13*a*1, the top plate 13*a* is connected to the front housing 11*a* through the plug-in fitting of the buckle 11*a*11 and the insertion hole 13*a*1, so as to implement the pre-fixation during the installation process of the top plate 13*a* and the front housing 11*a*. Alternatively, one of the rear housing 12*a* and the top plate 13*a* is provided with a buckle 11*a*11, and the other of the rear housing 12*a* and the top plate 13*a* is provided with an insertion hole 13*a*1, the top plate 13*a* is connected to the rear housing 12*a* through the plug-in fitting of the buckle 11*a*11 and the insertion hole 13*a*1, so as to implement the pre-fixation during the installation of the top plate 13*a* and the rear housing 12*a*.

In an embodiment, the front housing 11*a* is provided with a buckle 11*a*11, and the top plate 13*a* is provided with an insertion hole 13*a*1, and the top plate 13*a* is pre-fixed with the front housing 11*a* through the insertion of the buckle 11*a*11 and the insertion hole 13*a*1. In other embodiments, the front housing 11*a* may also be provided with an insertion hole 13*a*1, and the top plate 13*a* is provided with a buckle 11*a*11, which is not limited herein.

In another embodiment, the rear housing 12*a* may also be provided with a buckle 11*a*11, the top plate 13*a* is provided with an insertion hole 13*a*1, and the top plate 13*a* is pre-fixed to the rear housing 12*a* through the cooperation of the buckle 11*a*11 and the insertion hole 13*a*1. In other embodiments, the rear housing 12*a* may also be provided with the insertion hole 13*a*1, and the top plate 13*a* is provided with the buckle 11*a*11, which is not limited herein.

In still another embodiment, both the front housing 11*a* and the rear housing 12*a* are provided with the buckles 11*a*11, the top plate 13*a* is provided with the insertion hole 13*a*1, the top plate 13*a* is pre-fixed with the front housing 11*a* and the rear housing 12*a* through the plug-in engagement of the buckle 11*a*11 and the insertion hole 13*a*1. In other embodiments, the front housing 11*a* and the rear housing 12*a* may also be provided with insertion holes 13*a*1, and the top plate 13*a* may be provided with the buckles 11*a*11. Alternatively, the front housing 11*a* is provided with the buckle 11*a*11, the rear housing 12*a* is provided with the insertion hole 13*a*1, and the side of the top plate 13*a* facing the front housing 11*a* is provided with an insertion hole 13*a*1, the side of the top plate 13*a* facing the rear housing 12*a* is provided with a buckle 11*a*11, such that the two sides of the top plate 13*a* can be pre-fixed with the front housing 11*a* and the rear housing 12*a* through the plug-in fitting of the buckle 11*a*11 and the insertion hole 13*a*1 respectively, which is not limited herein.

It can be understood that in order to achieve rapid pre-fixation of the front housing 11*a* and/or the rear housing 12*a* and the top plate 13*a*, the buckle 11*a*11 can be selected as a structure such as a plug board, a plug post, and a plug strip, and the insertion hole 13*a*1 can be selected as a structure such as a through hole or a groove.

In this embodiment, the housing 10 is a housing of the mobile air conditioner, the front housing 11*a* is located at the front of the mobile air conditioner, and the rear housing 12*a* is located at the rear of the mobile air conditioner. The front housing 11*a* and the rear housing 12*a* enclose an installation space for installing other components of the mobile air conditioner.

In order to enable the front housing 11*a* and the rear housing 12*a* to be connected to each other and enclose an installation space, the front housing 11*a* includes a front panel 11*a*1 and front side plates 11*a*2 located on both sides of the front panel 11*a*1, the two front side plates 11*a*2 are formed by bending two sides of the front panel 11*a*1, that is, the front panel 11*a*1 and the two front side plates 11*a*2 are integrally formed. Optionally, the front housing 11*a* has a U-shaped structure. Correspondingly, the rear housing 12*a* includes a rear panel and rear side panels located on both sides of the rear panel, and the two rear side panels are formed by bending two sides of the rear panel, that is, the rear panel and the two rear side panels are integrally formed. Optionally, the rear housing 11 has a U-shaped structure.

It can be understood that in order to improve the installation convenience of the housing 10, the front housing 11*a* and the rear housing 12*a* are connected in a detachable manner, such as snap connection, plug fit, screw connection or pin connection, etc., as long as the structure can implement the detachable connection between the front housing 11*a* and the rear housing 12*a*, which is not limited herein.

In an embodiment, one of the front housing 11*a* and the rear housing 12*a* is provided with a clamping protrusion, and the other one of the front housing 11*a* and the rear housing 12*a* is provided with a clamping slot, and the front housing 11*a* is detachably connected to the rear housing 12*a* through the cooperation of the clamping protrusion and the clamping slot.

It can be understood that the front housing 11*a* is provided with a clamping protrusion, the rear housing 12*a* is provided with a clamping slot, and the front housing 11*a* is detachably connected to the rear housing 12*a* through the cooperation of the clamping protrusion and the clamping slot. In other embodiments, the front housing 11*a* may also be provided with a clamping slot, and the rear housing 12*a* may be provided with a clamping protrusion. This arrangement can facilitate the disassembly and assembly of the housing 10.

In this embodiment, the sides of the two front side plates 11*a*2 of the front housing 11*a* away from the front panel 11*a*1 are provided with a plurality of spaced-apart clamping protrusions, and the sides of the two rear side panels of the rear housing 12*a* away from the rear panel are provided with a plurality of spaced-apart clamping slots. In this way, when the front housing 11*a* and the rear housing 12*a* are connected, each clamping protrusion is snap-fitted or plug-fitted with each clamping slot.

Figure 36:
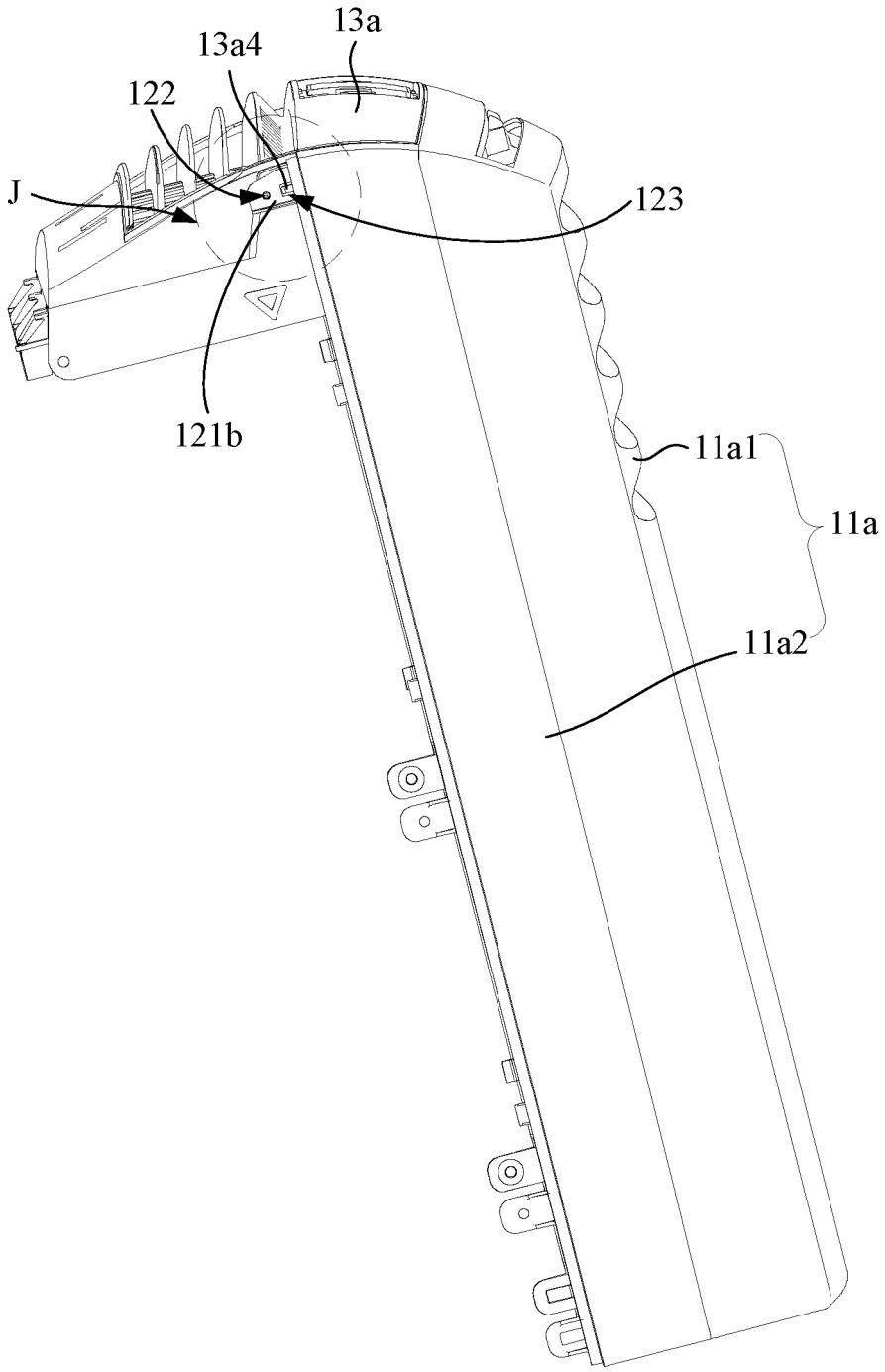
FIG. 36 is a schematic structural view of the housing with the front housing and the top plate assembled according to another embodiment of the present disclosure.
Figure 37:
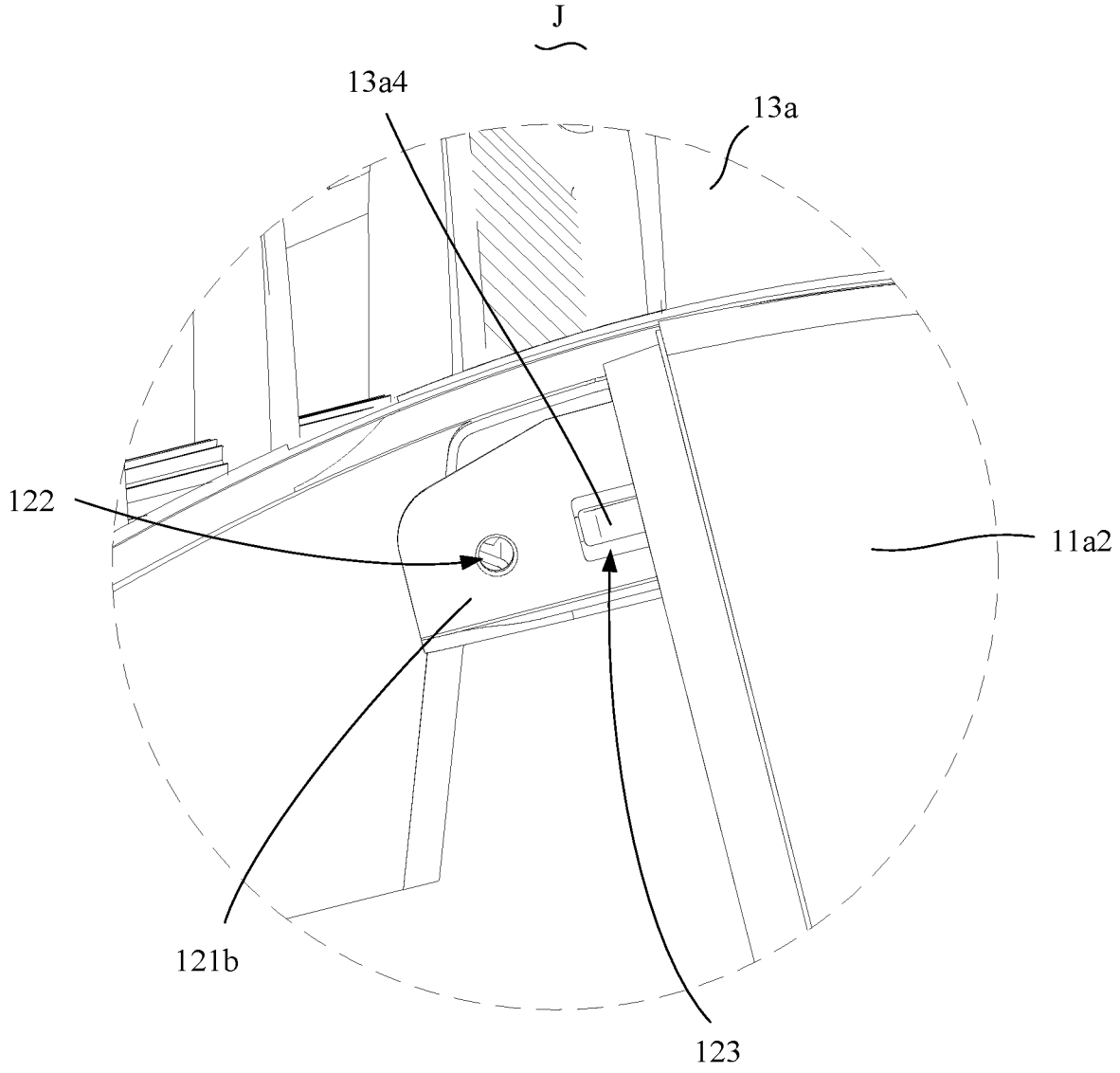
FIG. 37 is an enlarged view of portion J in FIG. 36.

In an embodiment, as shown in FIG. 34, FIG. 36 and FIG. 37, the front housing 11*a* protrudes with a plurality of spaced-apart buckles 11*a*11, the top plate 13*a* defines an insertion hole 13*a*1 corresponding to each buckle 11*a*11, and each buckle 11*a*11 is inserted into each insertion hole 13*a*1.

It can be understood that the installation space enclosed by the front housing 11*a* and the rear housing 12*a* forms an installation opening at the top thereof that communicates with the installation space, and the top plate 13*a* is installed at the installation opening. In this embodiment, the installation opening formed by the front housing 11*a* and the rear housing 12*a* is square or quadrilateral, and the shape and outline of the top plate 13*a* are equivalent to the shape and outline of the installation opening. Optionally, the top plate 13*a* is formed with four side edges corresponding to the front panel 11*a*1 of the front housing 11*a*, the rear panel of the rear housing 12*a*, the two front side plates of the front housing 11*a*, and the two rear side panels of the rear housing 12*a*.

In this embodiment, the front panel 11*a*1 of the front housing 11*a* is provided protrudingly with a plurality of spaced-apart buckles 11*a*11, a side edge of the top plate 13*a* corresponding to the front panel 11*a*1 of the front housing 11*a* is provided with an insertion hole 13*a*1 corresponding to each buckle 11*a*11, and the front panel 11*a*1 and the top plate 13*a* of the front housing 11*a* are inserted into each insertion hole 13*a*1 through each buckle 11*a*11 to achieve pre-fixation. In other embodiments, the rear panel of the rear housing 12*a* is provided protrudingly with a plurality of spaced-apart buckles 11*a*11, a side edge of the top plate 13*a* corresponding to the rear panel of the rear housing 12*a* is provided with an insertion hole 13*a*1 corresponding to each buckle 11*a*11, and the rear panel and the top plate 13*a* of the rear housing 12*a* are inserted into each insertion hole 13*a*1 through each buckle 11*a*11 to achieve pre-fixation.

In an embodiment, as shown in FIG. 34 and FIG. 39, the end of the buckle 11*a*11 away from the front housing 11*a* is provided with a guide slope 11*a*12, and the buckle 11*a*11 fits with the guide slope 11*a*12 and slides into the insertion hole 13*a*1.

It can be understood that a guide slope 11*a*12 is provided at the end of the buckle 11*a*11, when the buckle 11*a*11 is inserted into the insertion hole 13*a*1, the guide slope 11*a*12 of the buckle 11*a*11 fits with the hole wall of the insertion hole 13*a*1 and can be easily slid into the insertion hole 13*a*1, thereby improving the efficiency and convenience of plugging.

In an embodiment, as shown in FIG. 34 and FIG. 39, the hole wall of the insertion hole 13*a*1 is provided with a guide surface 13*a*2, and the buckle 11*a*11 slides into the insertion hole 13*a*1 along the guide surface 13*a*2.

It can be understood that the guide surface 13*a*2 is provided on the hole wall of the insertion hole 13*a*1, when the buckle 11*a*11 is inserted into the insertion hole 13*a*1, the end of the buckle 11*a*11 fits the guide surface 13*a*2 of the hole wall of the insertion hole 13*a*1 and can be easily slid into the insertion hole 13*a*1, thereby improving the efficiency and convenience of plugging.

In order to further improve the pre-fixing efficiency between the top plate 13*a* and the front housing 11*a* and/or the rear housing 12*a*, the end of each buckle 11*a*11 is provided with a guide slope 11*a*12, and the hole wall of each insertion hole 13*a*1 is provided with a guide surface 13*a*2. In this way, when each buckle 11*a*11 is inserted into each insertion hole 13*a*1, the guide slope 11*a*12 of each buckle 11*a*11 fits with the guide surface 13*a*2 of the hole wall of each insertion hole 13*a*1 to facilitate sliding into the insertion hole 13*a*1.

In an embodiment, as shown in FIG. 34, FIG. 38 and FIG. 39, the buckle 11*a*11 includes two oppositely arranged first connecting plates 11*a*13 and a second connecting plate 11*a*14 connecting the two first connecting plates 11*a*13, the buckle 11*a*11 is inserted into the insertion hole 13*a*1, so that the side of the two first connecting plates 11*a*13 facing away from the second connecting plate 11*a*14 is in limited contact with the top plate 13*a*.

It can be understood that setting the buckle 11*a*11 as a plug structure formed by the cooperation of two first connecting plates 11*a*13 and one second connecting plate 11*a*14 is beneficial to improve the structural stability of the buckle 11*a*11. At the same time, when the buckle 11*a*11 is inserted into the insertion hole 13*a*1, the two first connecting plates 11*a*13 of the buckle 11*a*11 are in contact with the inner wall of the top plate 13*a*, thereby improving the pre-fixing stability of the top plate 13*a* and the front housing 11*a* and/or the rear housing 12*a*, thereby effectively avoiding problems such as skewing and loosening and uneven gaps occurring when the front housing 11*a* and/or the rear housing 12*a* and the top plate 13*a* are installed.

Alternatively, the second connecting plate 11*a*14 and the two first connecting plates 11*a*13 are enclosed to form a groove structure, so that the cost of the structure of the buckle 11*a*11 can be saved. It can be understood that, in order to facilitate the insertion of the buckle 11*a*11 into the insertion hole 13*a*1, the insertion hole 13*a*1 is a rectangular elongated hole or a strip-shaped hole.

In an embodiment, as shown in FIG. 34, FIG. 35, FIG. 36 and FIG. 37, the first locking member is a connecting portion 121*b* protruding from the front housing 11*a*, and the connecting portion 121*b* is provided with a through hole 122. The second locking member is provided with a connecting hole 13*a*3 located on the top plate 13*a*, and the top plate 13*a* is fixedly connected to the front housing 11*a* through the through hole 122 and the connecting hole 13*a*3 in sequence through fasteners.

It can be understood that a connecting portion 121*b* is provided on the front side plate 11*a*2 of the front housing 11*a*, and a via hole 122 is defined at the connecting portion 121*b*, and a connecting hole 13*a*3 is defined on the side of the top plate 13*a* corresponding to the front side plate 11*a*2 corresponding to the via hole 122, such that the top plate 13*a* can be fixedly connected to the front side plate 11*a*2 of the front housing 11*a* through the through holes 122 and the connecting holes 13*a*3 through the fasteners in turn, thereby improving the installation stability of the top plate 13*a* and the front housing 11*a*.

In other embodiments, the third locking member is a connecting portion 121*b* protruding from the rear housing 12*a*, the connecting portion 121*b* is provided with a through hole 122, and the fourth locking member is provided with a connecting hole 13*a*3 located on the top plate 13*a*, and the top plate 13*a* is fixedly connected to the rear housing 12*a* through the through hole 122 and the connecting hole 13*a*3 in sequence through fasteners.

It can be understood that a connecting portion 121*b* is protruded on the rear side panel of the rear housing 12*a*, a via hole 122 is defined at the connecting portion 121*b*, and a connecting hole 13*a*3 is defined at the side of the top plate 13*a* corresponding to the rear side panel corresponding to the via hole 122, such that the top plate 13*a* can be fixedly connected to the rear side panel of the rear housing 12*a* through the through hole 122 and the connecting hole 13*a*3 through the fasteners in sequence, thereby improving the installation stability of the top plate 13*a* and the rear housing 12*a*.

In order to further improve the installation stability of the top plate 13*a* and the front housing 11*a* and/or the rear housing 12*a*, in an embodiment, the two front side plates 11*a*2 of the front housing 11*a* are both protrudingly provided with connecting portions 121*b*, and the top plate 13*a* corresponding to the opposite sides of the two front side plates 11*a*2 corresponding to the via holes 122 are provided with connecting holes 13*a*3. Alternatively, the two rear side panels of the rear housing 12*a* are protrudingly provided with connecting portions 121*b*, and the top plate 13*a* corresponding to the opposite sides of the two rear side panels are provided with connecting holes 13*a*3 corresponding to the via holes 122, such that the opposite sides of the top plate 13*a* are securely connected to the front housing 11*a* and/or the rear housing 12*a*.

In an embodiment, as shown in FIG. 34, FIG. 35, FIG. 36, FIG. 37 and FIG. 38, the front panel 11*a*1 is provided protrudingly with a first positioning member, and the side of the two front side plates 11*a*2 facing away from the front panel 11*a*1 is provided protrudingly with a first locking member, and the extending direction of the first locking member is the same as the extending direction of the first positioning member.

It can be understood that a connecting portion 121*b* is protruded from the side of the two front side plates 11*a*2 of the front housing 11*a* facing away from the front panel 11*a*1, the extending direction of the connecting portion 121*b* is the same as the extending direction of the first positioning member, that is, the extending direction of the connecting portion 121*b* is the same as the extending direction of the buckle 11*a*11. This arrangement can facilitate the pre-fixing of the top plate 13*a* and the front housing 11*a*, and at the same time, the via hole 122 of the connecting portion 121*b* can be quickly corresponding to the connecting hole 13*a*3 of the top plate 13*a*, which is beneficial to improve the installation efficiency of the housing 10. The connecting portion 121*b* may also be provided on the rear side panel of the rear housing 12*a*, which is not limited here.

In this embodiment, a connecting portion 121*b* is protruded from the front side plate 11*a*2 of the front housing 11*a* or the rear side panel of the rear housing 12*a*, and a through hole 122 is defined at the connecting portion 121*b*. After the housing 10 is assembled, the front housing 11*a* or the rear housing 12*a* can be used to hide the connecting portion 121*b*, the via hole 122 and the fastener, which effectively ensures the overall appearance of the housing 10.

In an embodiment, as shown in FIG. 34, FIG. 35, FIG. 36, FIG. 37 and FIG. 38, the connecting portion 121*b* is provided with a socket 123 adjacent to the via hole 122, and the second locking member further includes a buckle position 13*a*4 provided on the top plate 13*a*. The buckle position 13*a*4 is disposed adjacent to the connecting hole 13*a*3, and the buckle position 13*a*4 is snapped into the socket 123, so that the via hole 122 is directly opposite to the connecting hole 13*a*3.

It can be understood that a buckle position 13*a*4 is provided on the top plate 13*a*, a socket 123 is provided on the connecting portion 121*b*. While the top plate 13*a* is pre-fixed to the front housing 11*a* and/or the rear housing 12*a* through the buckle 11*a*11 and the insertion hole 13*a*1, the buckle position 13*a*4 of the top plate 13*a* is snapped into the socket 123 of the connecting portion 121*b*, further ensuring that the via hole 122 is directly opposite to the connecting hole 13*a*3, thereby improving the installation efficiency of the housing 10.

Figure 35:
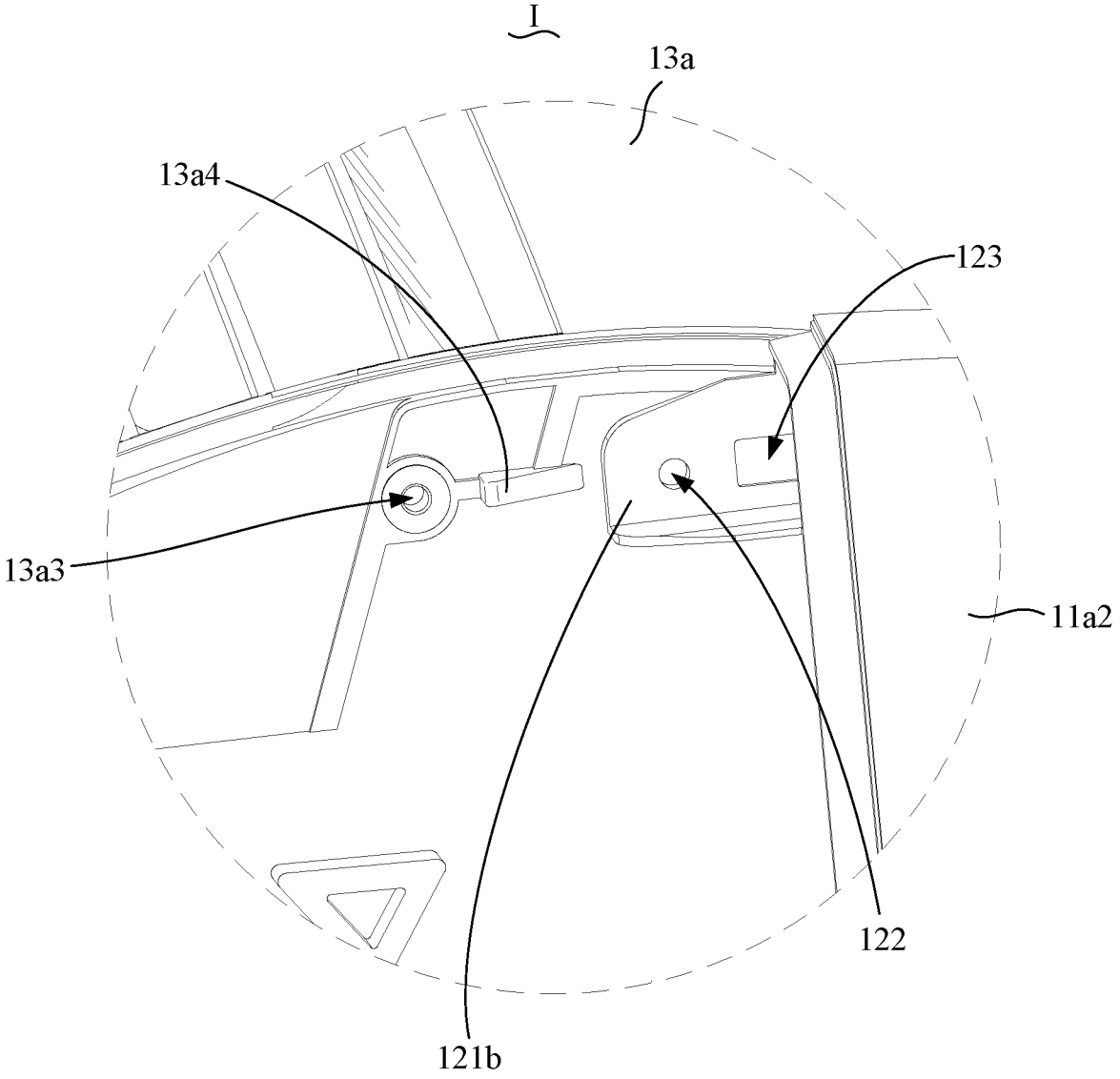
FIG. 35 is an enlarged view of portion I in FIG. 34.

In an embodiment, as shown in FIG. 35, the buckle position 13*a*4 is an inclined boss, that is, the buckle position 13*a*4 is a wedge-shaped boss. In order to facilitate the pre-fixation of the top plate 13*a* with the front housing 11*a* and/or the rear housing 12*a* through the buckle 11*a*11 and the insertion hole 13*a*1, the buckle position 13*a*4 is snapped into the socket 123. As shown in FIG. 34 and FIG. 35, in this embodiment, the extending direction of the boss is the same as the extending direction of the buckle 11*a*11, that is, the extending direction of the buckle position 13*a*4 is the same as the extending direction of the buckle 11*a*11.

In order to further ensure that when the buckle position 13*a*4 is snapped into the socket 123, the via hole 122 and the connecting hole 13*a*3 are directly facing each other, the thickness of the boss gradually decreases from the end adjacent to the connecting hole 13*a*3 to the end away from the connecting hole 13*a*3, that is, the end of the buckle position 13*a*4 adjacent to the connecting hole 13*a*3 is formed with a clamping surface, such that when the buckle position 13*a*4 is clamped in the socket 123, the engaging surface of the buckle position 13*a*4 is in limited contact with the hole wall of the socket 123. Therefore, it is ensured that the via hole 122 of the connecting portion 121*b* is directly opposite to the connecting hole 13*a*3 on the top plate 13*a*, which is beneficial to improve the installation efficiency of the housing 10.

In an embodiment, as shown in FIG. 35, FIG. 37 and FIG. 38, the connecting portion 121*b* and the front housing 11*a* are enclosed to form an avoidance space 124 connected to the through hole 122.

It can be understood that the connecting portion 121*b* is in an L-shaped plate-like structure or a U-shaped plate-like structure, so that the connecting portion 121*b* and the front side plate 11*a*2 are enclosed to form an avoidance space 124, such that when the buckle position 13*a*4 is snapped into the socket 123, the portion of the buckle position 13*a*4 protruding from the socket 123 extends into the avoidance space 124 to avoid interference from the front side plate 11*a*2.

In an embodiment, the housing 10 also includes a chassis 14*a* located at the bottom of the front housing 11*a* and the rear housing 12*a*. It can be understood that the chassis 14*a* is detachably connected with the front housing 11*a* and the rear housing 12*a*, such as snap connection, plug fit, screw connection or pin connection, which is not limited herein.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A mobile air conditioner comprising:

a housing provided with a hidden opening; and a storage box comprising a storage cavity and a storage opening in communication with the storage cavity;

wherein:

the storage box is movably provided on the housing, and the storage box has a first position extending out of the hidden opening to expose the storage opening, and a second position hidden in the housing;

the storage box is rotatably provided on the housing, such that the storage box has the first position and the second position; and at least one support protrusion is provided on an inner wall surface of the housing and the storage box is rotatably connected to the at least one support protrusion, such that the storage box is rotatably provided on the housing, wherein the at least one support protrusion is provided with a guide groove in communication with a rotating hole, one end of the guide groove away from the rotating hole defines an opening, and the guide groove is configured to guide a rotating shaft to slide into the rotating hole.

2. The mobile air conditioner of claim 1, wherein the storage box is configured to block the hidden opening in the second position.

3. The mobile air conditioner of claim 1, wherein:

the at least one support protrusion comprises two support protrusions, and the two support protrusions are respectively provided on opposite sides of the hidden opening; and the storage box is provided between the two support protrusions, and two sides of the storage box are respectively rotatably provided on the two support protrusions.

4. The mobile air conditioner of claim 1, wherein the rotating shaft is provided on the storage box, the rotating hole is provided on the at least one support protrusion, the rotating shaft is rotatably disposed in the rotating hole, so that the storage box is rotatably connected to the at least one support protrusion.

5. The mobile air conditioner of claim 4, wherein:

the guide groove is flared; or a connection between the guide groove and the rotating hole is provided with a locking protrusion, and the locking protrusion is configured to limit the rotating shaft from the rotating hole; or a thickening portion is provided on a side of the at least one support protrusion facing away from the storage box, and the thickening portion is provided on a periphery of the rotating hole; or a protrusion is provided on a side of the at least one support protrusion facing the storage box, and the protrusion is configured to abut an outer wall surface of the storage box when the storage box is rotated.

6. The mobile air conditioner of claim 1, wherein:

the storage box comprises a first side wall covering the hidden opening in the second position, and two second side walls adjacent to the first side wall, an open end of the second side wall is formed with an avoidance notch at the connection with the first side wall, and the avoidance notch is configured to avoid an edge of the hidden opening when the storage box is rotated; or an open end of the storage box is inclined and configured to avoid the edge of the hidden opening when the storage box is rotated.

7. The mobile air conditioner of claim 1, wherein:

a guide structure is provided on the storage box and the housing, and the guide structure is configured to guide the rotation of the storage box;

an inner wall surface of the housing is provided with a guide support portion;

the guide structure comprises: a guide protrusion laterally protruding from the guide support portion, and a guide groove provided on an outer wall surface of the storage box; and the guide protrusion is slidably provided in the guide groove and configured to guide the rotation of the storage box.

8. The mobile air conditioner of claim 7, wherein:

a depth of the guide groove is increased inwardly; and/or the guide groove comprises an arc groove.

9. The mobile air conditioner of claim 1, wherein:

the storage box and the housing are provided with a first limiting structure, and the first limiting structure is configured to limit the storage box and the housing in the second position; and/or the storage box and the housing are provided with a second limiting structure, and the second limiting structure is configured to limit the storage box and the housing in the first position.

10. The mobile air conditioner of claim 9, wherein:

the second limiting structure comprises a stop protrusion provided on the storage box, and the stop protrusion is provided in the housing;

the stop protrusion is in contact with an inner wall surface of the housing in the first position, and is configured to limit the storage box; and the stop protrusion is away from a rotation axis of the storage box, and/or the stop protrusion is rotatably provided on the storage box.

11. The mobile air conditioner of claim 1, wherein:

an open end of a side wall of the storage box is formed with a gripping notch, and the gripping notch is recessed toward a bottom of the storage cavity; and the gripping notch is configured to break a guide groove of the storage box to form two guide sub-grooves, and a fracture is formed between the two guide sub-grooves.

12. The mobile air conditioner of claim 1, wherein the storage box comprises a first side wall covering the hidden opening in the second position, the first side wall is provided with a gripping structure, and the gripping structure is configured for a user to grasp.

13. The mobile air conditioner of claim 1, wherein:

guide ribs are provided on an inner wall surface of the storage cavity, the guide ribs extending in a depth direction of the storage cavity; and a height of the guide ribs is increased in a direction from the storage opening to a bottom of the storage cavity, and/or a width of the guide ribs is increased in the direction from the storage opening to the bottom of the storage cavity.

14. The mobile air conditioner of claim 1, wherein the storage box is slidably provided in the housing, and is configured to have the first position and the second position.

15. The mobile air conditioner of claim 1, wherein:

the housing is provided with an indoor air inlet, a top of the housing is provided with an indoor air outlet, and an indoor air duct communicating the indoor air inlet with the indoor air outlet is formed inside the housing; and the mobile air conditioner further comprises a cross-flow fan provided in the indoor air duct.

16. The mobile air conditioner of claim 15, wherein:

the indoor air inlet is provided at a front or a rear of the housing; and the indoor air outlet is provided with a guide grille, the guide grille comprises a plurality of longitudinal grille strips extending in a length direction of the indoor air inlet and a plurality of horizontal grille strips extending in a width direction of the indoor air outlet, the horizontal grille strips and the longitudinal grille strips are alternately arranged, the longitudinal grille strips are arranged obliquely forwardly, and the longitudinal grille strips are protruded above the horizontal grille strips.

17. The mobile air conditioner of claim 1, wherein:

the housing comprises a housing body and a reinforcing housing, and the reinforcing housing is provided in the housing body and is fixedly connected with an inner surface of the housing body; and the reinforcing housing comprises a front plate, a rear plate, a left plate and a right plate, and the front plate, the rear plate, the left plate and the right plate are fixedly connected with the inner surface of the housing body.

18. The mobile air conditioner of claim 1, wherein:

the housing comprises a front housing and a top plate, the front housing is provided with a first positioning member and a first locking member, and the top plate is provided with a second positioning member and a second locking member; and the top plate is connected to the front housing through a cooperation of the first positioning member and the second positioning member, the top plate is fixedly connected through the first locking member and the second locking member, and the top plate is configured to fixedly connect the top plate with the front housing.

19. The mobile air conditioner of claim 18, wherein:

one of the first positioning member and the second positioning member comprises a buckle, another of the first positioning member and the second positioning member is provided with an insertion hole, the top plate is connected to the front housing through plug-in fitting of the buckle and the insertion hole; and/or the first locking member comprises a connecting portion protruding from the front housing, the connecting portion is provided with a through hole, the second locking member is provided with a connecting hole located on the top plate, and the top plate is fixedly connected to the front housing through the through hole and the connecting hole in sequence by a fastener.

* * * * *